US008274454B2

(12) United States Patent
Yamamoto et al.

(10) Patent No.: US 8,274,454 B2
(45) Date of Patent: Sep. 25, 2012

(54) EL DISPLAY PANEL, ELECTRONIC APPARATUS AND A METHOD OF DRIVING EL DISPLAY PANEL

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 899 days.

(21) Appl. No.: 12/320,967

(22) Filed: Feb. 10, 2009

(65) Prior Publication Data

US 2009/0219231 A1 Sep. 3, 2009

(30) Foreign Application Priority Data

Feb. 28, 2008 (JP) ..... 2008-047180

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS

| | | | | |
|---|---|---|---|---|
| 6,191,764 | B1 * | 2/2001 | Kono et al. | 345/76 |
| 6,380,689 | B1 * | 4/2002 | Okuda | 315/169.3 |
| 6,731,276 | B1 * | 5/2004 | Ishizuka | 345/211 |
| 7,057,588 | B2 | 6/2006 | Asano et al. | |
| 7,102,202 | B2 | 9/2006 | Kobayashi et al. | |
| 7,109,952 | B2 | 9/2006 | Kwon et al. | |
| 2002/0089291 | A1 * | 7/2002 | Kaneko et al. | 315/169.3 |
| 2003/0209989 | A1 * | 11/2003 | Anzai et al. | 315/169.3 |
| 2004/0032380 | A1 * | 2/2004 | Kanauchi | 345/63 |
| 2004/0041751 | A1 * | 3/2004 | Takahashi | 345/76 |
| 2005/0206590 | A1 | 9/2005 | Sasaki et al. | |
| 2008/0094320 | A1 * | 4/2008 | Parikh et al. | 345/76 |
| 2008/0284679 | A1 | 11/2008 | Ishizuka | |
| 2009/0219231 | A1 * | 9/2009 | Yamamoto et al. | 345/76 |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-118132 | A | 4/2004 |
| JP | 2004-133240 | A | 4/2004 |
| JP | 2005-164894 | A | 6/2005 |
| JP | 2005-195756 | A | 7/2005 |
| JP | 2006-119179 | A | 5/2006 |
| JP | 2006-243740 | A | 9/2006 |
| JP | 2009-168969 | A | 7/2009 |
| WO | WO-2006/121138 | A1 | 11/2006 |

OTHER PUBLICATIONS

Japanese Office Action issued Mar. 2, 2010 for corresponding Japanese Application No. 2008-047180.

* cited by examiner

*Primary Examiner* — Peter Vincent Agustin
(74) *Attorney, Agent, or Firm* — Rader Fishman & Grauer, PLLC

(57) ABSTRACT

Disclosed herein is an electro luminescence display panel having a pixel structure corresponding to an active matrix drive system, including: a reverse bias potential generating portion configured to generate a reverse bias potential in which corresponding one of gradation values of pixels is reflected; and a voltage applying portion configured to apply the reverse bias potential to a gate electrode of a drive transistor composing a pixel circuit adapted to operate for a non-emission time period.

13 Claims, 56 Drawing Sheets

1

I-V CARACTERISTICS OF OLED

FIG.6A WSL

FIG.6B VSSL

FIG.6C OFSL

FIG.6D DTL

FIG.6E RSL

IN PHASE OF APPLICATION OF POSITIVE BIAS

IN PHASE OF APPLICATION OF NEGATIVE BIAS

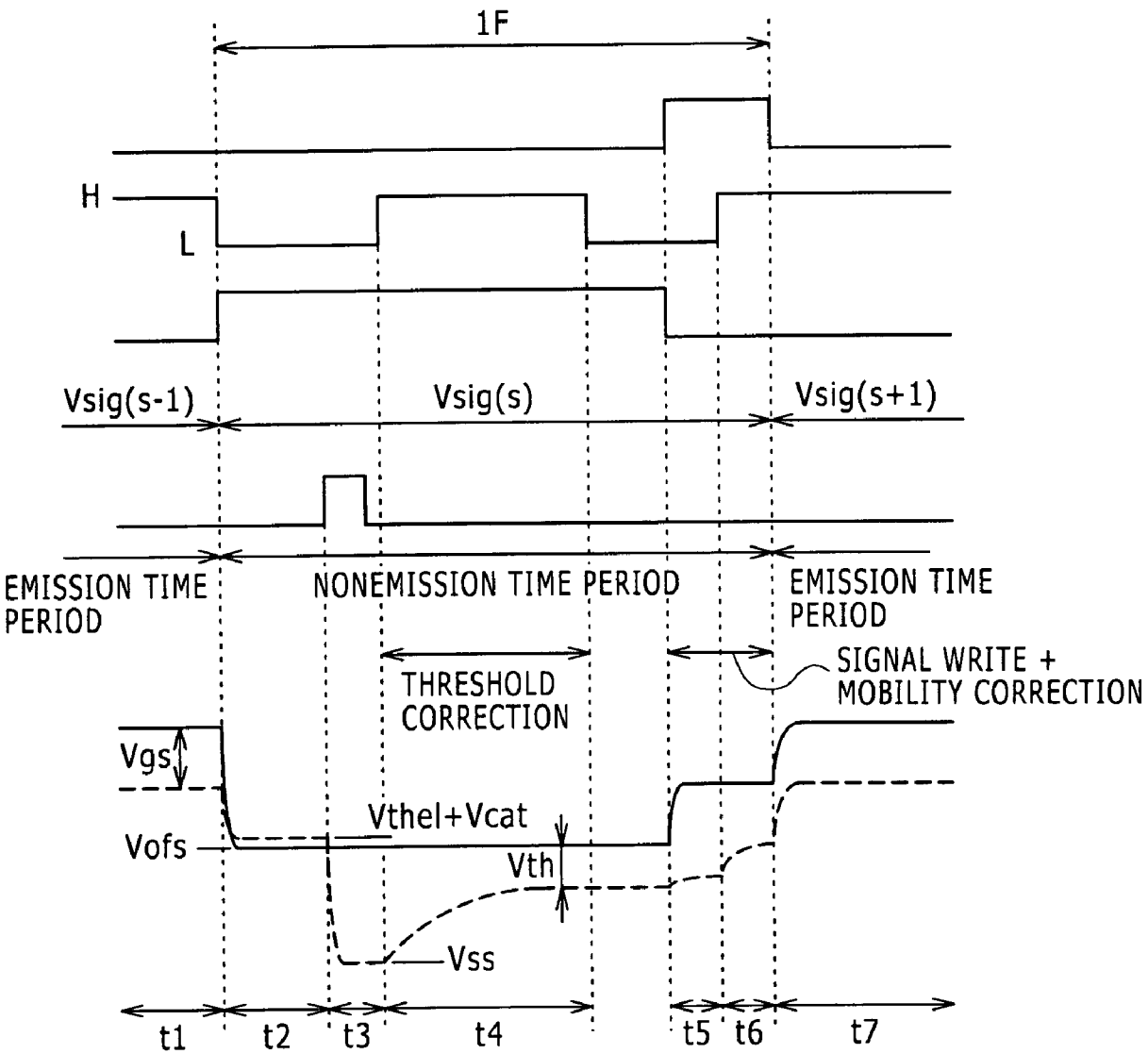
FIG.16A WSL
FIG.16B VSSL
FIG.16C OFSL
FIG.16D DTL
FIG.16E RSL
FIG.16F Vg
FIG.16G Vs

REVERSE BIAS VOLTAGE (SMALL)

REVERSE BIAS VOLTAGE (INTERMEDIATE)

REVERSE BIAS VOLTAGE (LARGE)

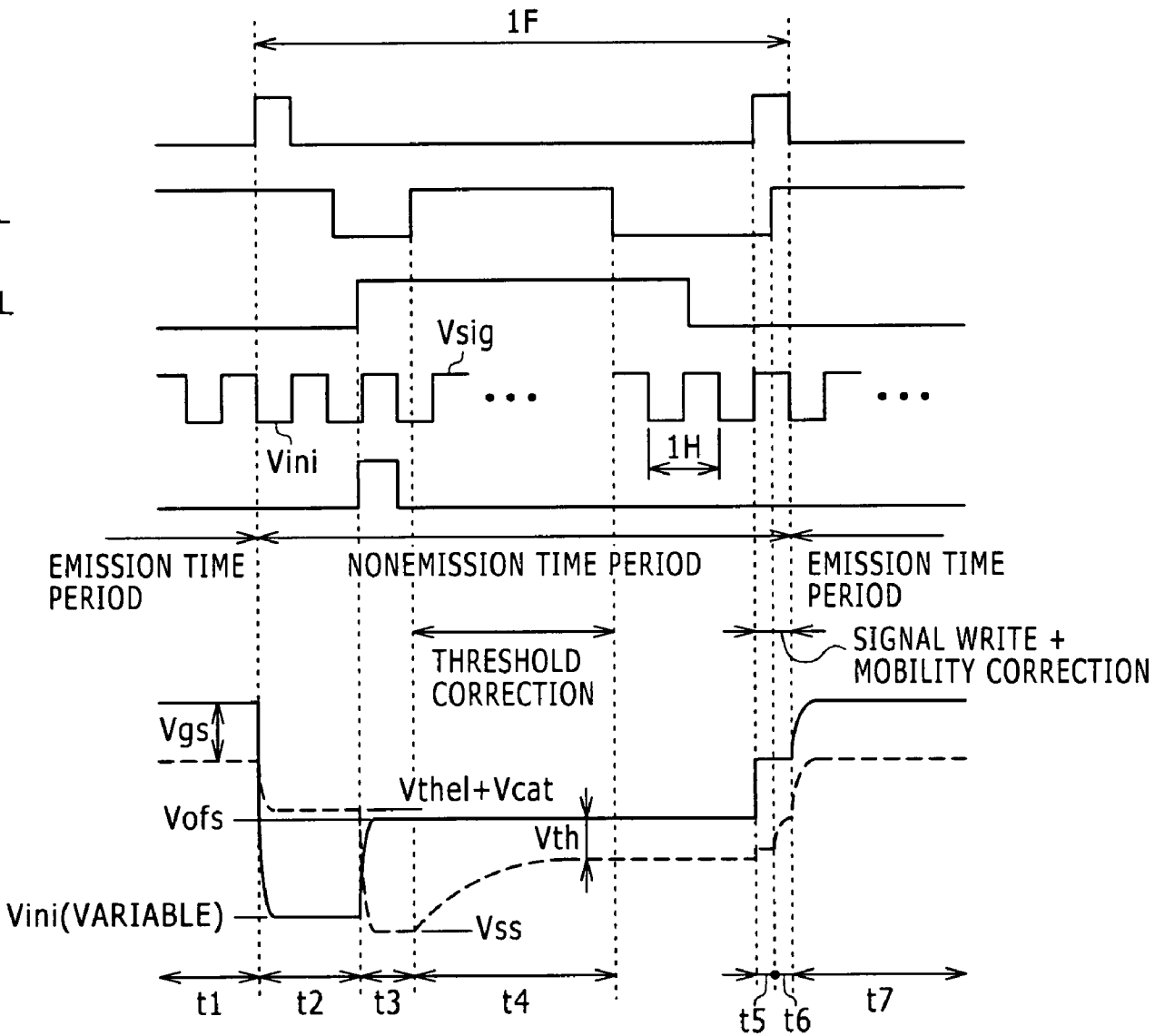
FIG.23A WSL
FIG.23B VSSL
FIG.23C OFSL
FIG.23D DTL
FIG.23E RSL
FIG.23F Vg
FIG.23G Vs FIG.26A
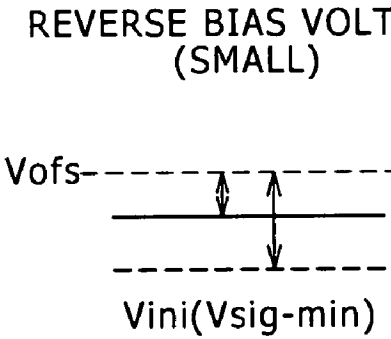
FIG.26B
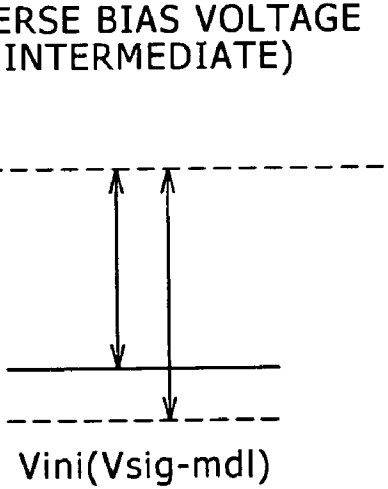
FIG.26C
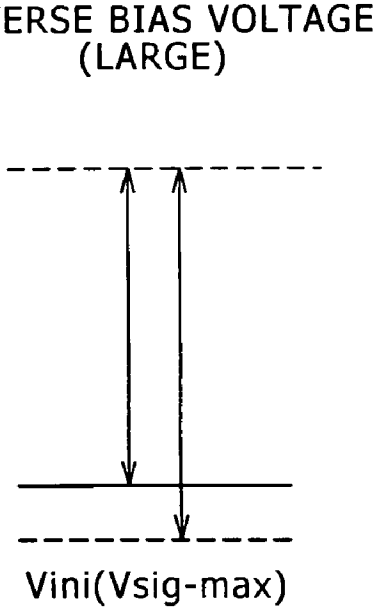
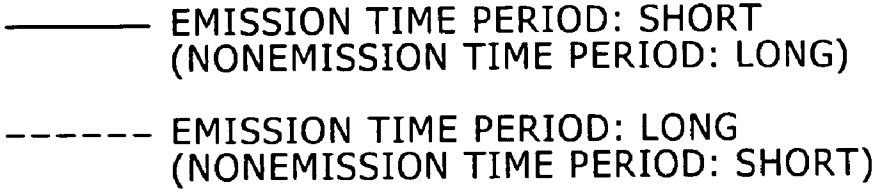

FIG.36A WSL

FIG.36B DSL

FIG.36C DTL

EL DISPLAY PANEL, ELECTRONIC APPARATUS AND A METHOD OF DRIVING EL DISPLAY PANEL

CROSS REFERENCES TO RELATED APPLICATIONS

The present invention contains subject matter related to Japanese Patent Application JP 2008-047180 filed in the Japan Patent Office on Feb. 28, 2008, the entire contents of which being incorporated herein by reference.

BACKGROUND OF THE INVENTION

1. Field of the Invention

The present invention relates to an EL (Electro Luminescence) display panel, an electronic apparatus, and a method of driving the EL display panel, and more particularly to an EL display panel which is driven and controlled by using an active matrix drive system, an electronic apparatus, and a method of driving the EL display panel.

2. Description of the Related Art

FIG. 1 shows a general circuit block of a configuration of an active matrix drive type organic EL display panel. As shown in FIG. 1, an organic EL display panel 1 is composed of a pixel array portion 3, a signal write control line driving portion 5, and a horizontal selector 7 which operate as drive circuits for driving the pixel array portion 3. It is noted that in the pixel array portion 3, a pixel circuit 9 is disposed in each of intersections between signal lines DTLs and write control lines WSLs.

Now, an organic EL element is a current light emitting element. For this reason, a drive system for controlling a gradation by controlling amounts of currents caused to flow through the organic EL elements corresponding to pixels, respectively, is adopted for the organic EL display panel.

FIG. 2 shows one of the simplest circuit configurations of this sort of pixel circuit 9. This pixel circuit 9 is composed of thin film transistors T1 and T2, and a hold capacitor Cs. Hereinafter, the thin film transistor T1 is referred to as "the sampling transistor T1," and the thin film transistor T2 is referred to as "the drive transistor T2."

The sampling transistor T1 is an N-channel thin film transistor for controlling an operation for writing a signal potential Vsig corresponding to a gradation of the corresponding one of the pixels to the hold capacitor Cs. In addition, the drive transistor T2 is a P-channel thin film transistor for supplying a drive current Ids to an organic EL element OLED based on a gate-to-source voltage Vgs determined depending on the signal potential Vsig held in the hold capacitor Cs.

In the case of the circuit configuration shown in FIG. 2, a source electrode of the drive transistor T2 is connected to a power source line to which a power source potential Vcc is fixedly applied, and thus the drive transistor T2 usually operates in a saturated region. That is to say, the drive transistor T2 operates as a constant current source for supplying a drive current Ids having a magnitude corresponding to the signal potential Vsig to the organic EL element OLED. In this case, the drive current Ids is expressed by Expression (1):

$$Ids=k\cdot\mu\cdot(Vgs-Vth)^2/2 \quad (1)$$

where μ is a mobility of a majority carrier of the drive transistor T2, Vth is a threshold voltage of the drive transistor T2, and k is a coefficient given by (W/L)·Cox where W is a channel width, L is a channel length, and Cox is a gate capacitance per unit area.

It is noted that in the case of the pixel circuit having this configuration, it is known that there are the characteristics in which a drain voltage of the drive transistor T2 changes with a temporal change of I-V characteristics of the organic EL element shown in FIG. 3. However, since the gate-to-source voltage Vgs is held constant, there is no change in amount of current supplied to the organic EL element. As a result, an emission luminance can be held constant.

The organic EL display panel device adopting the active matrix drive system, for example, is described in Japanese Patent Laid-Open Nos. 2003-255856, 2003-271095, 2004-133240, 2004-029791, and 2004-093682.

SUMMARY OF THE INVENTION

Now, the circuit configuration shown in FIG. 2 cannot be adopted depending on the kinds of thin film processes in some cases. That is to say, in the current thin film process, a P-channel thin film transistor cannot be adopted in some cases. In such cases, the drive transistor T2 is necessarily replaced with the N-channel thin film transistor.

FIG. 4 shows a configuration of this sort of pixel circuit. In this case, a source electrode of a drive transistor T12 is connected to an anode terminal of an organic EL element OLED. However, in the case of this pixel circuit 11, there is encountered a problem that a gate-to-source voltage Vgs changes with a temporal change of I-V characteristics of the organic EL element OLED. This change in gate-to-source voltage Vgs causes an amount of drive current to change, thereby changing an emission luminance.

In addition thereto, a threshold and a mobility of the drive transistor T12 composing each of pixel circuits 11 differs every pixel. A difference in threshold or mobility of the drive transistor T12 among the pixel appears in the form of a dispersion of a drive current value, thereby causing the emission luminance to change every pixel.

Thus, FIG. 5 shows a connection relationship between a pixel circuit 21 of an organic EL panel 1 adopting a circuit configuration adapted to prevent the dispersion of the characteristics of the drive transistor composed of an N-channel thin film transistor, and a drive circuit for driving the pixel circuit 21.

The pixel circuit 21 is composed of N-channel thin film transistors T21, T22, T23, T24, and T25, and a hold capacitor Cs.

It is noted that the thin film transistor T21 (hereinafter referred to as "the first sampling transistor T21") operates as a switch for controlling an operation for writing a signal potential Vsig to the hold capacitor Cs. The thin film transistor T22 (hereinafter referred to as "the second sampling transistor T22") operates as a switch for controlling an operation for writing an offset signal potential Vofs to a gate electrode of the thin film transistor T25.

The thin film transistor T23 (hereinafter referred to as "the first switching transistor T23") operates as a switch for controlling an operation for supplying a power source potential Vcc to the thin film transistor T25. The thin film transistor T24 (hereinafter referred to as "the second switching transistor T24") operates as a switch for controlling an operation for supplying an initialization potential Vss to the thin film transistor T25.

The thin film transistor T25 (hereinafter referred to as "the drive transistor T25") operates as a constant current source for supplying a drive current to the organic EL element OLED in a phase of a turn-ON operation.

A signal write control line driving portion 23, an offset signal line driving portion 25, a power feeding control switch driving portion 27, an initialization control switch driving portion 29, and a horizontal selector 31 are used to drive the pixel circuit 21.

The signal write control line driving portion 23 is a drive circuit for controlling an operation for turning ON/OFF the first sampling transistor T21.

The offset signal line driving portion 25 is a drive circuit for controlling an operation for turning ON/OFF the second sampling transistor T22.

The power feeding control switch driving portion 27 is a drive circuit for controlling an operation for turning ON/OFF the first switching transistor T23.

The initialization control switch driving portion 29 is a drive circuit for controlling an operation for turning ON/OFF the second switching transistor T24.

The horizontal selector 31 is a drive circuit for applying the signal potential Vsig corresponding to pixel data Din to each of the signal lines DTLs.

FIGS. 6A to 6G are a timing chart explaining an operation of the pixel circuit using these drive circuits 23, 25, 27, 29, and 31.

Firstly, FIG. 7 shows an operation state within the pixel circuit 21 in an emission state. At this time, only the first switching transistor T23 is held in an ON state (t1 in FIGS. 6A to 6G). On the other hand, the drive transistor T25 operates in a saturated region, and supplies a drive current Ids having a magnitude depending on a gate-to-source voltage Vgs to the organic EL element OLED.

Next, an operation state within the pixel circuit 21 in a non-emission state will be described. The first switching transistor T23 is controlled so as to be turned OFF, thereby starting the non-emission state (t2 in FIGS. 6A to 6G). That is to say, all the thin film transistors T21 to T24 are controlled so as to be turned OFF, thereby starting the non-emission state. By carrying out this operation, the supply of the drive current Ids to the organic EL element OLED is cut, so that an anode potential Vel of the organic EL element OLED (a source potential Vs of the drive transistor T25) is reduced.

The reduction of the anode potential Vel of the organic EL element OLED is stopped at a time point when a potential corresponding to a sum of a threshold voltage Vthel and a cathode potential Vcat of the organic EL element OLED is reached. By the way, since a gate electrode of the drive transistor T25 is a free end, a gate potential Vg of the drive transistor T25 is also reduced in conjunction with the reduction of the anode potential Vel of the organic EL element OLED.

After that, the second sampling transistor T22 and the second switching transistor T24 are each switched from the OFF state over to the ON state, thereby starting a threshold correction preparing operation (t3 in FIGS. 6A to 6G).

FIG. 8 shows a connection state within the pixel circuit 21 at this time point. In this case, the gate potential Vg of the drive transistor T25 is controlled so as to become equal to the offset signal potential Vofs, and the source potential Vs of the drive transistor T25 is controlled so as to become equal to an initialization potential Vss. That is to say, the gate-to-source voltage Vgs of the drive transistor T25 is controlled so as to become equal to a voltage of (Vofs−Vss). This voltage of (Vofs−Vss) is set at a larger value than that of the threshold voltage Vth. Therefore, a drive current Ids' having a magnitude corresponding to the voltage of (Vofs−Vss) is caused to flow from a power source line (at Vcc) into an initialization potential line (at Vss).

However, when the drive current Ids' is caused to flow into the organic EL element OLED, the organic EL element OLED emits a light with a luminance unrelated to the signal potential Vsig. In order to cope with this situation, both the offset signal potential Vofs and the initialization potential Vss are set so that the non-emission state of the organic EL element OLED is held.

That is to say, the initialization potential Vss is set so that the anode potential Vel of the organic EL element OLED becomes smaller than a sum of the threshold voltage Vthel and the cathode potential Vcat of the organic EL element OLED. It is noted that any one of the second sampling transistor T22 and the second switching transistor T24 may be first controlled so as to be turned ON.

Next, only the second switching transistor T24 is controlled so as to be turned OFF, and subsequently the first switching transistor T23 is controlled so as to be turned ON while the second sampling transistor T22 is kept controlled in an ON state (t4 in FIGS. 6A to 6G). FIG. 9 shows an operation state in the pixel circuit 21 at this time point. Note that, in FIG. 9, the organic EL element OLED is shown in the form of an equivalent circuit having a diode and a capacitor.

In this case, a current caused to flow through the drive transistor T25 is used to charge both the hold capacitor Cs and a parasitic capacitance Cel of the organic EL element OLED with the electricity as long as a relationship of (Vel≦Vcat+Vthel) is maintained (a magnitude of a leakage current of the organic EL element OLED is considerably smaller than that of the current caused to flow through the drive transistor T25).

Carrying out this charging operation results in that the anode potential Vel of the organic EL element OLED rises with time. FIG. 10 shows a change in source potential Vs of the drive transistor T25 with time during the charging operation.

It is noted that the rise of the source potential Vs of the drive transistor T25 ends at a time point when the gate-to-source voltage Vgs of the drive transistor T25 reaches the threshold voltage Vth of the drive transistor T25. At this time, the anode potential Vel fulfills a relationship of Vel=Vofs−Vth≦Vcat+Vthel. This operation is a threshold correcting operation for the drive transistor T25. After that, the first switching transistor T23 is first controlled so as to be turned OFF, and subsequently the second sampling transistor T22 is controlled so as to be turned OFF.

The turn-OFF control is carried out in the order of the first switching transistor T23 and the second sampling transistor T22, thereby making it possible to suppress the change in gate potential Vg of the drive transistor T25.

Next, only the first sampling transistor T21 is controlled so as to be turned ON, thereby starting a mobility correcting operation used as a signal writing operation as well (t5 in FIGS. 6A to 6G). FIG. 11 shows an operation state within the pixel circuit 21 at this time point. At this time, the gate-to-source voltage Vgs of the drive transistor T25 is expressed by Expression (2):

$$Vgs=\{Cel/(Cel+Cs+Ctr)\}\cdot(Vsig-Vofs)+Vth \quad (2)$$

where Cel is a parasitic capacitance of the organic EL element OLED, Ctr is a parasitic capacitance of the drive transistor T25, and Cs is a capacitance of the hold capacitor Cs.

In this case, the parasitic capacitance Cel is larger than each of the parasitic capacitances Cs and Ctr. Therefore, the gate-to-source voltage Vgs is approximately given by (Vsig+Vth).

In this state, the first switching transistor T23 is controlled so as to be turned ON (t6 in FIGS. 6A to 6G). In this case as well, the current caused to flow through the drive transistor T25 is used to charge each of the hold capacitor Cs, and the parasitic capacitance Cel of the organic EL element OLED with the electricity as long as the source potential Vs of the drive transistor T25 does not exceed the sum of the threshold voltage Vthel and the cathode potential Vcat of the organic EL element OLED (the magnitude of the leakage current of the organic EL element OLED is considerably smaller than that of the current caused to flow through the drive transistor T25).

FIG. 12 shows an operation state within the pixel circuit 21 at this time point. It is noted that at this time point, the threshold correcting operation for the drive transistor T25 has already been completed. For this reason, the current caused to flow through the drive transistor T25 has a value in which the mobility μ is reflected.

Specifically, an amount of current caused to flow through the drive transistor T25 having the large mobility μ becomes large, and thus the source potential Vs of the drive transistor T25 speedily rises.

On the other hand, an amount of current caused to flow through the drive transistor T25 having the small mobility μ becomes small, and thus the source potential Vs of the drive transistor T25 slowly rises.

FIG. 13 shows a relationship between the source voltage Vs of the drive transistor T25 vs. time. In terms of results, the gate-to-source voltage Vgs of the drive transistor T25 becomes small because the mobility μ is reflected in the gate-to-source voltage Vgs. Thus, after a lapse of a predetermined time period, the gate-to-source voltage Vgs of the drive transistor T25 converges to the gate-to-source voltage Vgs obtained by perfectly correcting the mobility μ.

After completion of the mobility correcting operation used as the signal writing operation as well, the first sampling transistor T21 is controlled so as to be turned OFF, and the gate electrode of the drive transistor T25 is controlled as the free end. Along with this operation, the drive current Ids' for the drive transistor T25 is caused to flow into the organic EL element OLED, so that the organic EL element OLED starts to emit a light with a luminance corresponding to a value of the drive current. It is noted that the source potential Vs of the drive transistor T25 rises up to a voltage Vx corresponding to the value of the drive current caused to flow through the organic EL element OLED (t7 in FIGS. 6A to 6G).

FIG. 14 shows an operation state within the pixel circuit 21 at this time point.

It is noted that in the case as well of the pixel circuit 21 stated here, the I-V characteristics themselves of the organic EL element OLED change as an emission time period gets longer. That is to say, the voltage Vx also changes.

However, in the case of this circuit configuration, the value of the current caused to flow through the organic EL element OLED does not change because the gate-to-source voltage Vgs of the drive transistor T25 is held constant.

That is to say, even when the I-V characteristics of the organic EL element OLED change with the temporal change, a constant current Ids' usually continues to be caused to flow through the drive transistor T25. As a result, the luminance of the organic EL element OLED can be held constant.

Really, the pixel circuit 21 shown in FIG. 5 effectively functions against the change in characteristics of the organic EL element OLED.

From other reasons, however, there is the possibility that the luminance changes due to the temporal change. This change is one in each of the threshold voltages of the thin film transistors T21 to T25 composing the pixel circuit 21.

FIG. 15A shows a change in general bias characteristics which the threshold voltage of the thin film transistor has when a positive bias is continuously applied to the gate electrode of the thin film transistor. Also, FIG. 15B shows a change in general bias characteristics which the threshold voltage of the thin film transistor has when a negative bias is continuously applied to the gate electrode of the thin film transistor.

As shown in FIG. 15A, the characteristics in which the threshold voltage Vth of the thin film transistor moves in a positive direction in the phase of the continuous application of the positive bias are recognized in the thin film transistor. On the other hand, as shown in FIG. 15B, the characteristics in which the threshold voltage Vth of the thin film transistor moves in a negative direction in the phase of the continuous application of the negative bias are recognized in the thin film transistor.

In the case of the circuit configuration shown in FIG. 5, the positive bias and the negative bias are alternately applied to each of the thin film transistors T21 to T24 within one frame. Therefore, the change in each of the threshold voltages Vth of the thin film transistors T21 to T24 is not large.

However, only the drive transistor T25 is driven in a state of usually applying thereto the positive bias. As a result, only the threshold voltage Vth of the drive transistor T25 largely changes in the positive direction. In particular, when the amorphous silicon process is used in formation of the drive transistor T25, an amount of change in threshold voltage Vth of the drive transistor T25 is easy to become very large with a lapse of time.

On the other hand, in the case of the pixel circuit 21 shown in FIG. 5, the gate-to-source voltage Vgs of the drive transistor T25 needs to be controlled to become equal to or larger than the threshold voltage Vth prior to the threshold correcting operation for the drive transistor T25.

The reason for this is because when the gate-to-source voltage Vgs is equal to or smaller than the threshold voltage Vth, only a leakage current is caused to flow as the current through the drive transistor T25, and thus the gate-to-source voltage Vgs of the drive transistor T25 hardly changes from the voltage of (Vofs−Vss). However, when the threshold voltage Vth largely changes in such a manner, it is feared that the precondition for the threshold correction is not fulfilled. As a result, it is impossible to normally carry out the threshold correcting operation for the drive transistor T25.

In order to cope with such a situation, the application of the drive system is expected such that as shown in a time period t2 of FIGS. 16A to 16G, a negative bias is applied to the drive transistor T25 in the phase of start of the non-emission time period, thereby reducing the change in threshold voltage as much as possible. It is noted that in the case of the timing chart shown in FIGS. 16A to 16G, for this time period t2, the second sampling transistor T22 is controlled so as to be turned ON, and the gate potential Vg of the drive transistor T25 is controlled so as to become equal to the offset potential Vofs, thereby carrying out the operation in the drive system described above.

However, with the drive system shown in the timing chart shown in FIGS. 16A to 16G, in the phase of the black display as well as in the phase of the white display, the value of the reverse bias is usually fixed at the same value. That is to say, an amount of change in threshold voltage Vth in the negative direction in the phase of the white display is identical to that in threshold voltage Vth in the negative direction in the phase of the black display. On the other hand, an amount of change in threshold voltage Vth in the positive direction in the phase of the white display is different from that in threshold voltage Vth in the positive direction in the phase of the black display. For this reason, even in the case of the pixel circuit 21 shown in FIG. 5, there is caused a problem that the generation of the burn-in following a lapse of time cannot be avoided in principle.

In the light of the foregoing, it is therefore desirable to provide an EL display panel in which there is less deterioration in characteristics of a pixel circuit, an electronic apparatus including the EL display panel, and a method of driving the EL display device.

In order to attain the desire described above, according to an embodiment of the present invention, there is provided an EL display panel having a pixel structure corresponding to an active matrix drive system, including: a reverse bias potential generating portion configured to generate a reverse bias potential in which corresponding one of gradation values of pixels is reflected; and a voltage applying portion configured to apply the reverse bias potential to a gate electrode of a drive transistor composing a pixel circuit adapted to operate for a non-emission time period.

Here, a reverse bias voltage corresponding to a high luminance is preferably set at a larger voltage than a reverse bias voltage corresponding to a low luminance. The reason for this is because an amount of movement of a threshold voltage in a positive direction becomes larger as the luminance becomes higher, and thus in order to cancel this situation, an amount of movement of the threshold voltage in a negative direction needs to be made larger.

It is noted that the application of the reverse bias potential may be carried out through an exclusive line, or may be carried out by sharing a signal line through which a signal potential is applied. In this connection, when the application of the reverse bias potential is carried out by sharing the signal line, a reverse bias potential and the signal potential have to be supplied to the signal line in a time division manner.

In addition, when a duty of a length of an emission time period occupied in one frame time period is switchable, a width of a change in reverse bias potential is preferably set so as to be inversely proportional to a duty of an emission time period. That is to say, when the duty of the emission time period is long (a non-emission time period is short), the width of the change in reverse bias potential is preferably made large, whereas the duty of the emission time period is short (the non-emission time period is long), the width of the change in reverse bias potential is preferably made small. By carrying out such a control operation, it is possible to balance an amount of change in threshold voltage Vth in the positive direction, and an amount of change in threshold voltage Vth in the negative direction with each other.

According to another embodiment of the present invention, there is provided an electronic apparatus including: an EL display panel having a pixel structure corresponding to an active matrix drive system, a reverse bias potential generating portion configured to generate a reverse bias potential in which corresponding one of gradation values of pixels is reflected, and a voltage applying portion configured to apply the reverse bias potential to a gate electrode of a drive transistor composing a pixel circuit adapted to operate for a non-emission time period; a system controlling portion configured to control an operation of an entire system; and a manipulation inputting portion configured to receive a manipulation input to the system controlling portion.

According to still another embodiment of the present invention, there is provided a method of driving an EL display panel having a pixel structure corresponding to an active matrix drive system, the method including the steps of: generating a reverse bias potential in which corresponding one of gradation values of pixels is reflected; and applying the reverse bias potential to a gate electrode of a drive transistor composing a pixel circuit adapted to operate for a non-emission time period.

According to the present invention, the reverse potential (the reverse bias voltage in terms of results) in which the corresponding one of the gradation values of the pixels is reflected is set. Thus, the setting can be made so that the amount of change in threshold voltage within one frame in the positive direction can be canceled with the amount of change in threshold voltage within the one frame in the negative direction. That is to say, the control can be carried out so that either no temporal change occurs in the drive transistor, or the temporal change occurring in the drive transistor becomes very small. As a result, it is possible to realize the EL display panel in which non-uniformity in a luminance hardly occurs owing to the pixels.

BRIEF DESCRIPTION OF THE DRAWINGS

FIGS. 16A to 16G are a timing chart explaining a driving method of applying a fixed reverse bias voltage;

FIGS. 23A to 23G are a timing chart showing an operation for driving the pixel circuit shown in FIG. 20;

FIGS. 26A to 26C are respectively diagrams each showing setting of a reverse bias potential corresponding to a duty of a length of an emission time period within one frame time period;

DETAILED DESCRIPTION OF THE PREFERRED EMBODIMENTS

Hereinafter, a description will be given with respect to the case where embodiments of the present invention is applied to an active matrix drive type organic EL display panel.

It is noted that the well-known or known techniques are applied to portions which are not especially illustrated or described in this specification. In addition, embodiments which will be described below are merely illustrations of the present invention, and thus the present invention is by no means limited thereto.

(A) Structure of Exterior Appearance

Note that, in this specification, not only a display panel in which a pixel array portion and drive circuits are formed on the same substrate by utilizing the same semiconductor process, but also a panel in which drive circuits, for example, made as a specific application oriented IC are mounted on a substrate having a pixel array portion formed thereon are each referred to as an organic EL display panel.

Figure 17:
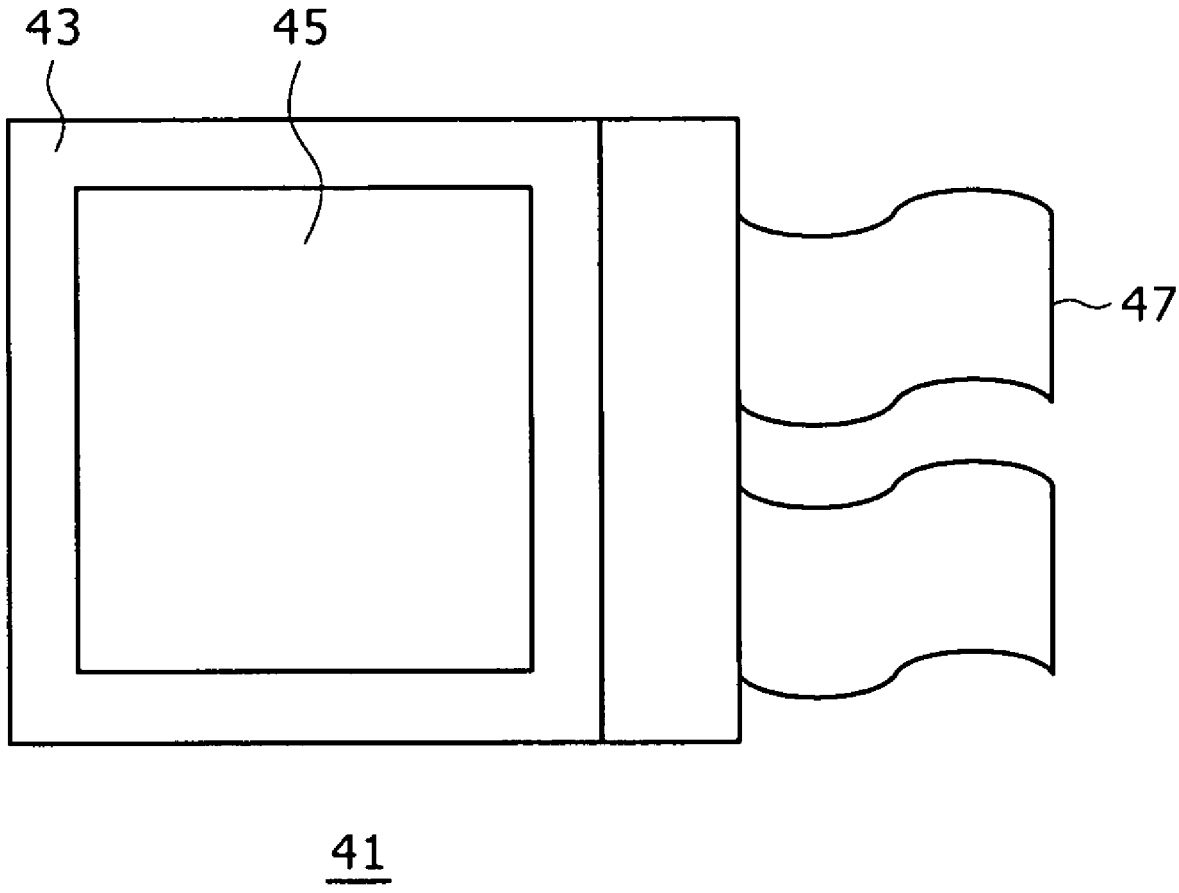
FIG. 17 is a view showing a structure of an exterior appearance of an organic EL display panel.

FIG. 17 shows a structure of an exterior appearance of an organic EL display panel.

The organic EL display panel 41 has a structure in which a counter portion 45 is stuck to a formation area of a pixel array portion of a support substrate 43.

The support substrate 43 is made of a glass, a plastic or any other suitable substrate, and has a structure in which an organic EL layer, a protective film, and the like are laminated on a surface of the support substrate 43. A glass, a plastic or any other suitable transparent member is used as a substrate for the counter portion 45. It is noted that a Flexible Printed Circuit (FPC) board 47 through which a signal or the like is inputted/outputted to/from the support substrate 43 from/to the outside is disposed in the organic EL panel 41.

(B) First Embodiment (B-1) System Configuration

A first embodiment of the organic EL display panel 41 in which a reverse voltage can be made variable in accordance with a signal potential Vsig will be described in detail hereinafter.

Figure 18:
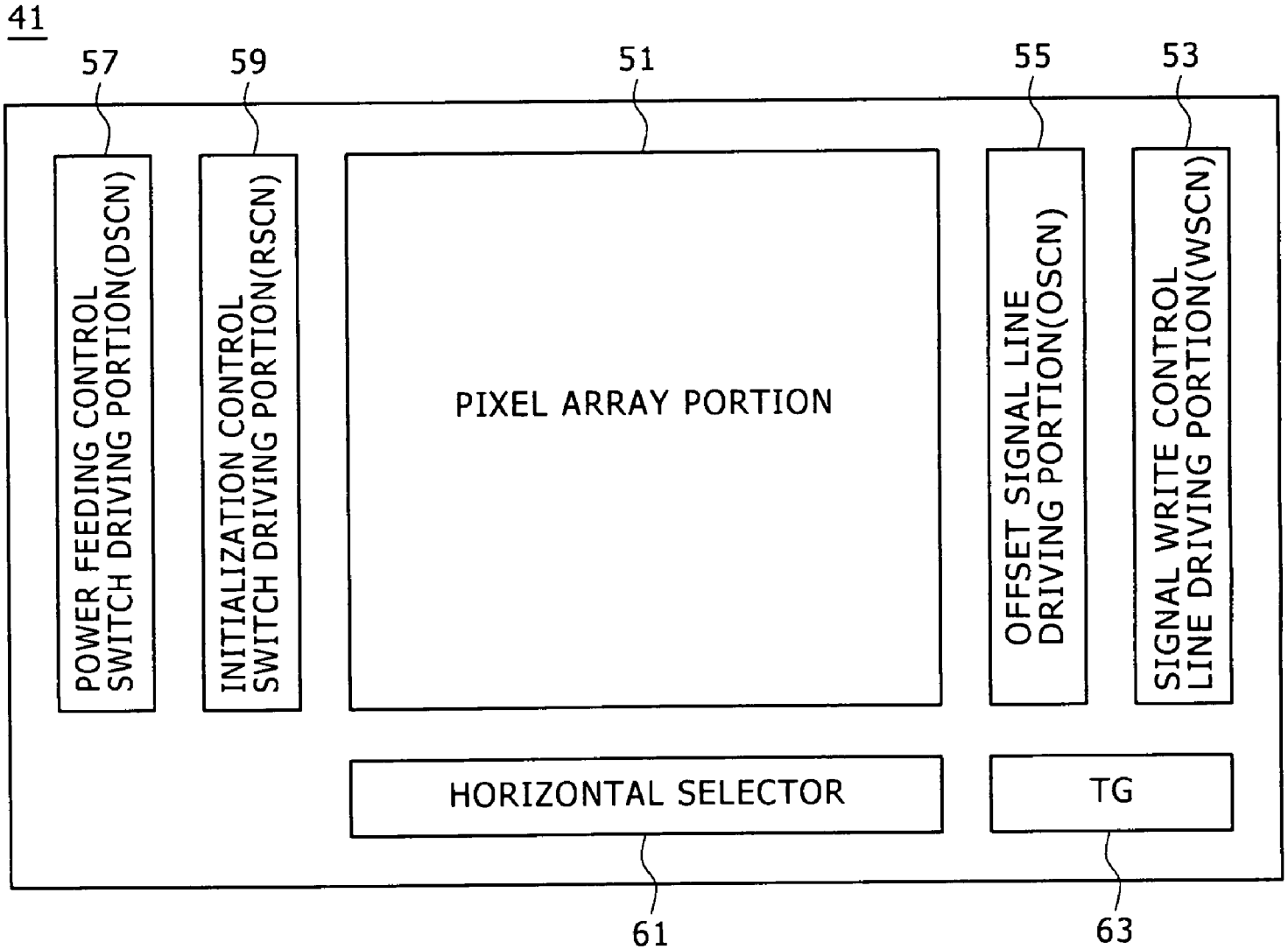
FIG. 18 is a block diagram showing a system configuration of an organic EL display panel according to a first embodiment of the present invention.

FIG. 18 shows a system configuration of the organic EL display panel 41 of the first embodiment. The organic EL display panel 41 shown in FIG. 18 is composed of a pixel array portion 51, a signal write control line driving portion 53, an offset signal line driving portion 55, a power feeding control switch driving portion 57, and an initialization control switch driving portion 59, and a horizontal selector 61 which serve as drive circuits for the pixel array portion 51, and a timing generator 63.

The pixel array portion 51 has a matrix structure in which sub-pixels are disposed in intersection positions between signal lines DTLs and write control lines WSLs, respectively. In this connection, the sub-pixel is a minimum unit of a pixel structure composing one pixel. For example, one pixel as a write unit is composed of three sub-pixels, made of different organic EL materials, corresponding to the three primary colors R (Red), G (Green) and B (Blue), respectively.

Figure 1:
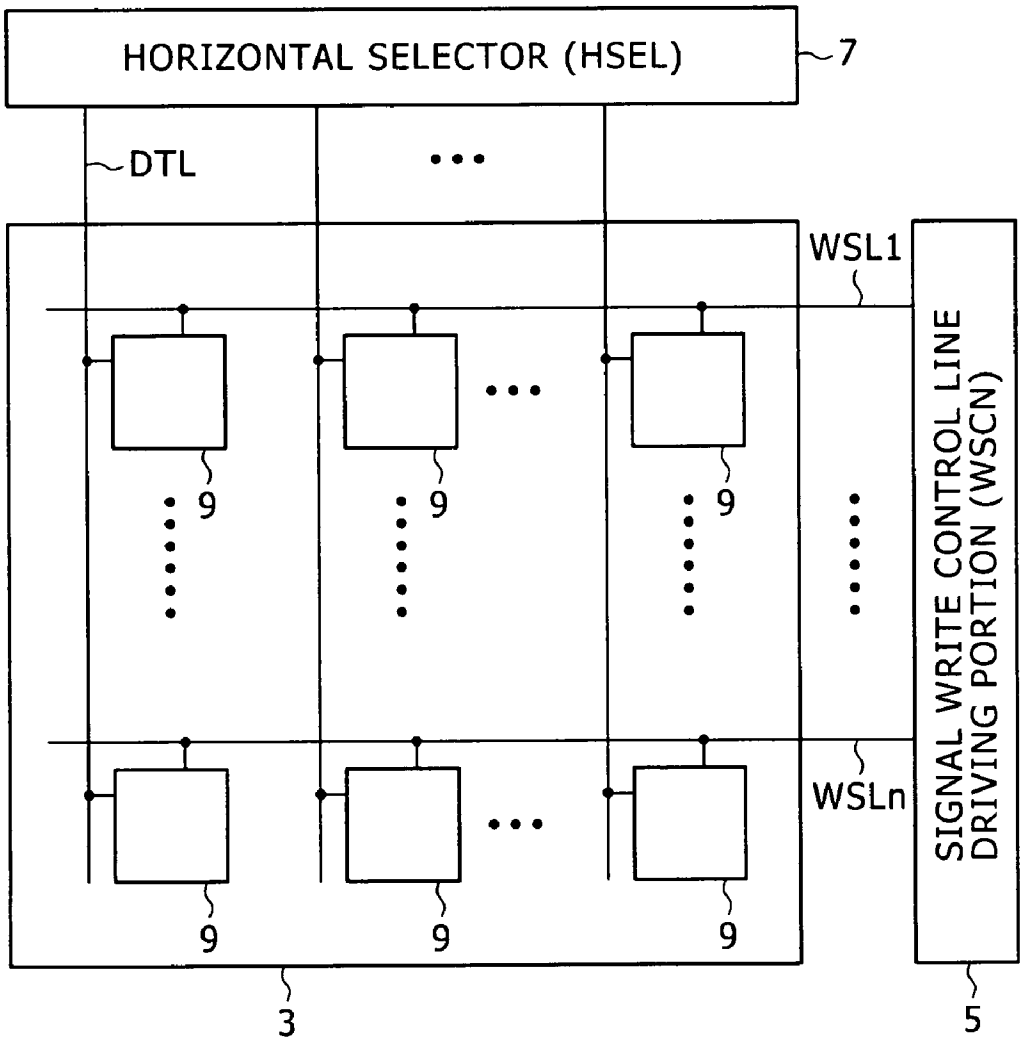
FIG. 1 is a block diagram explaining a functional block of a configuration of an organic EL panel in the related art.
Figure 2:
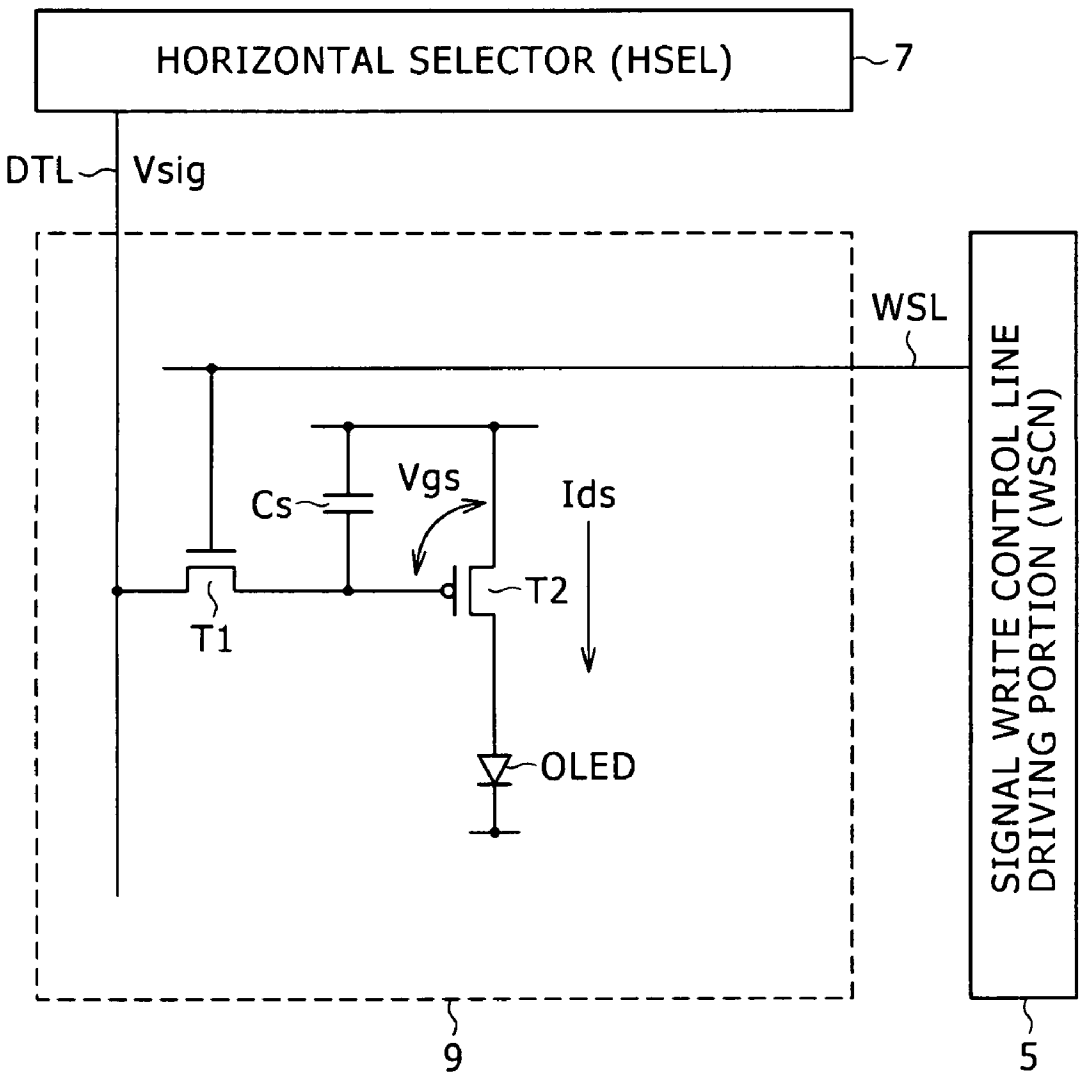
FIG. 2 is a circuit diagram, partly in block, explaining a connection relationship between a pixel circuit and a drive circuit in the related art.
Figure 3:
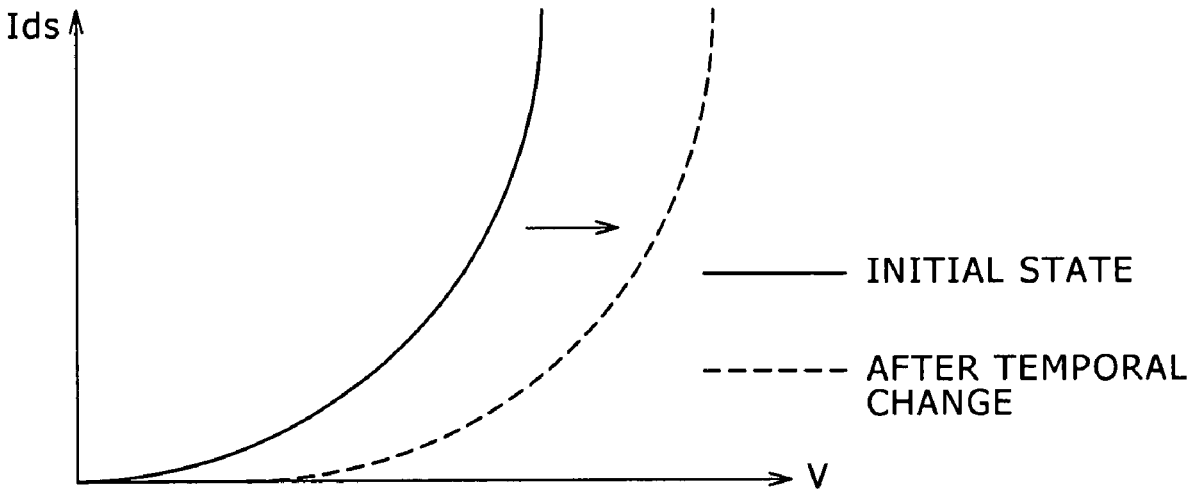
FIG. 3 is a graphical representation explaining a temporal change in I-V characteristics of an organic EL element in the related art.
Figure 4:
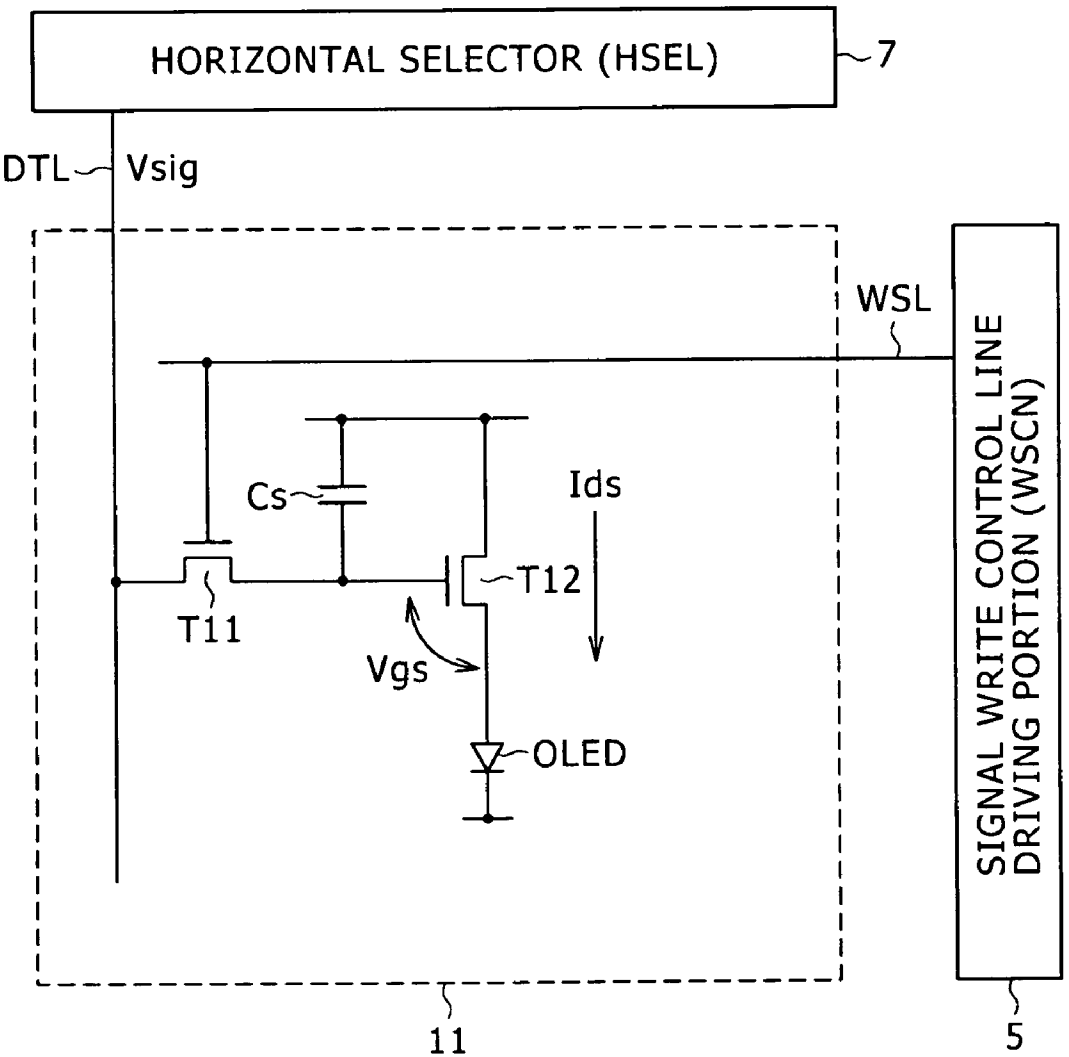
FIG. 4 is a circuit diagram, partly in block, explaining another connection relationship between a pixel circuit and a drive circuit in the related art.
Figure 5:
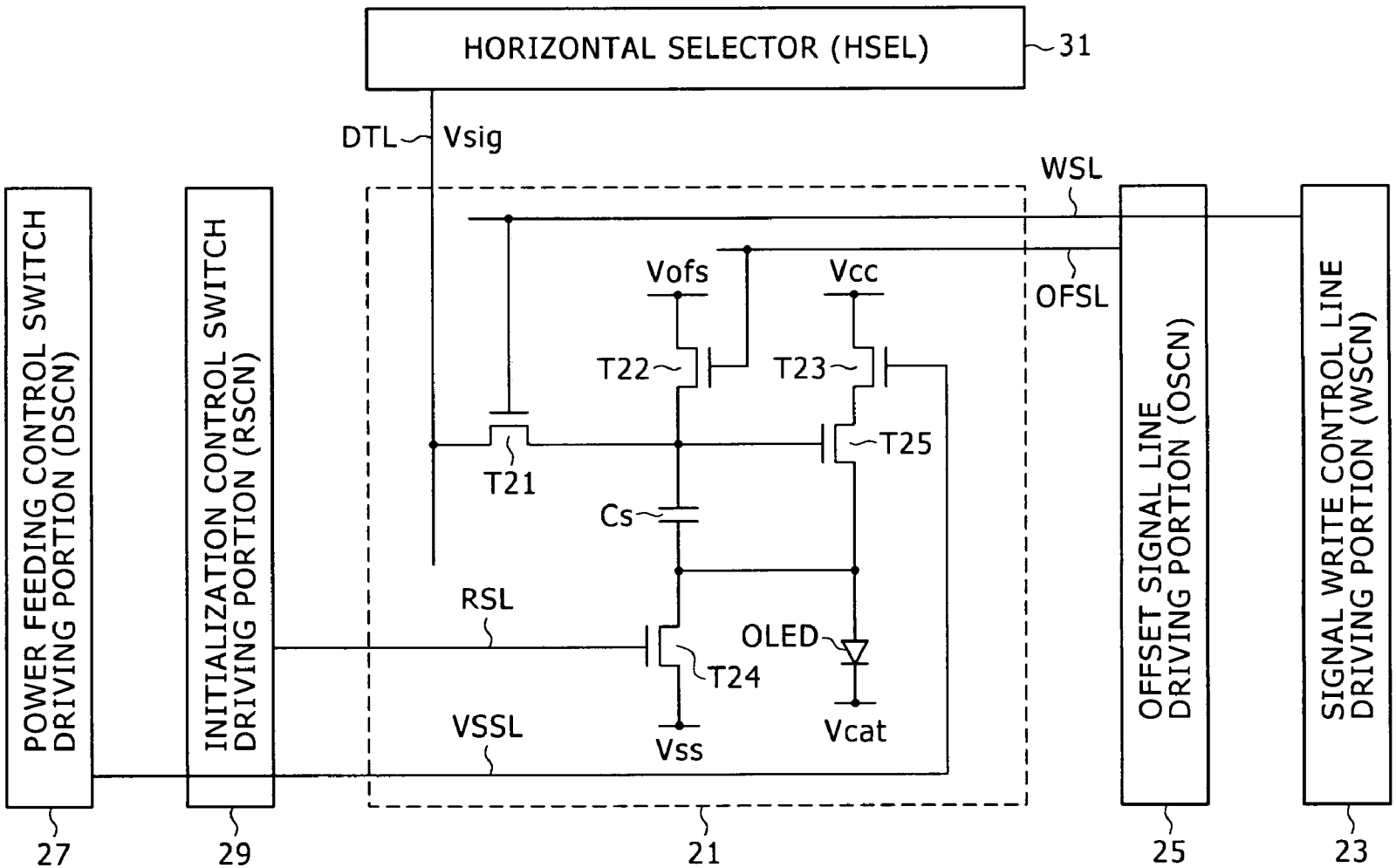
FIG. 5 is a circuit diagram, partly in block, explaining still another connection relationship between a pixel circuit and a drive circuit in the related art.
Figure 6:
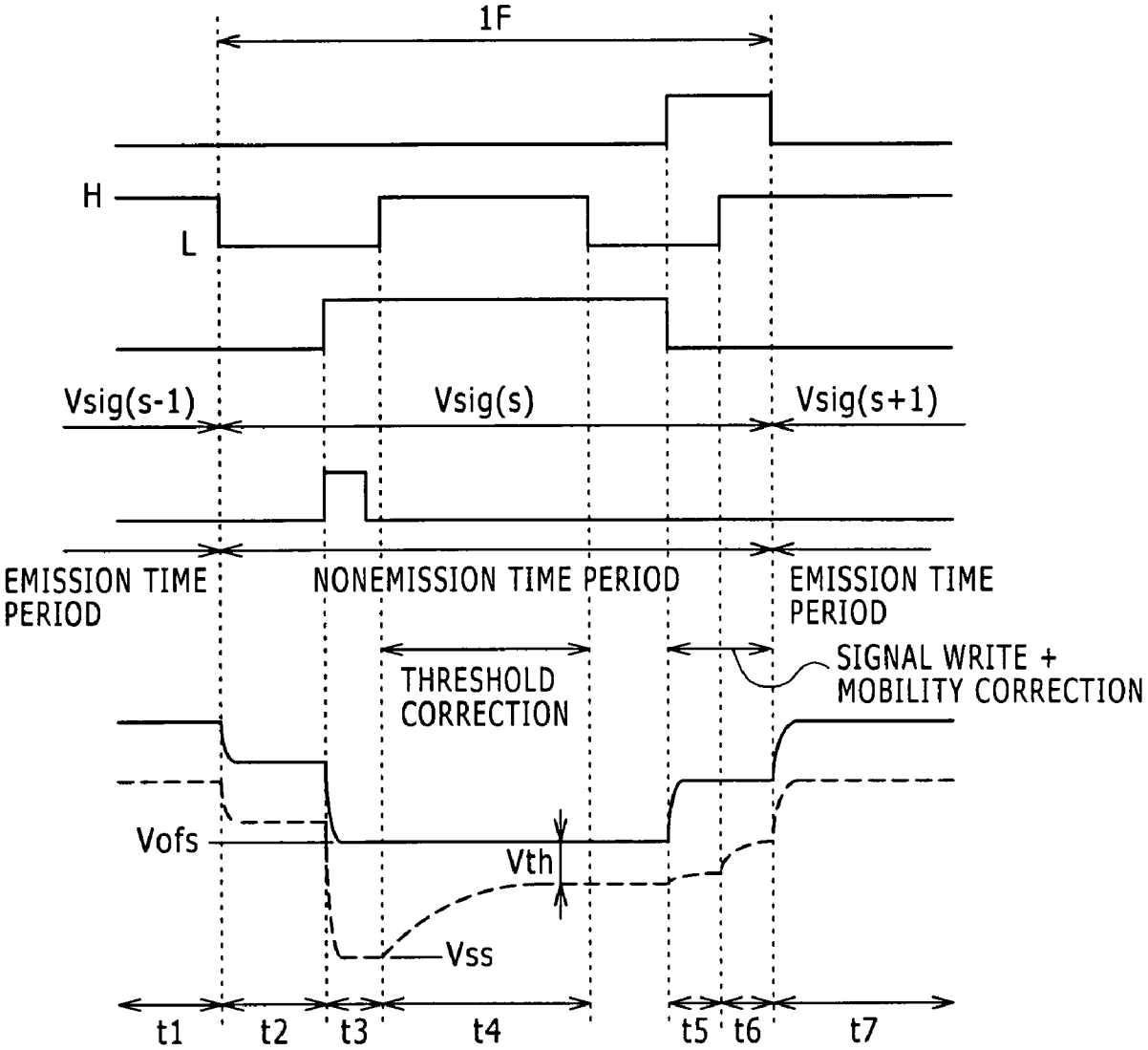
FIGS. 6A to 6G are a timing chart showing a driving operation of the pixel circuit shown in FIG. 5 in the related art.
Figure 7:
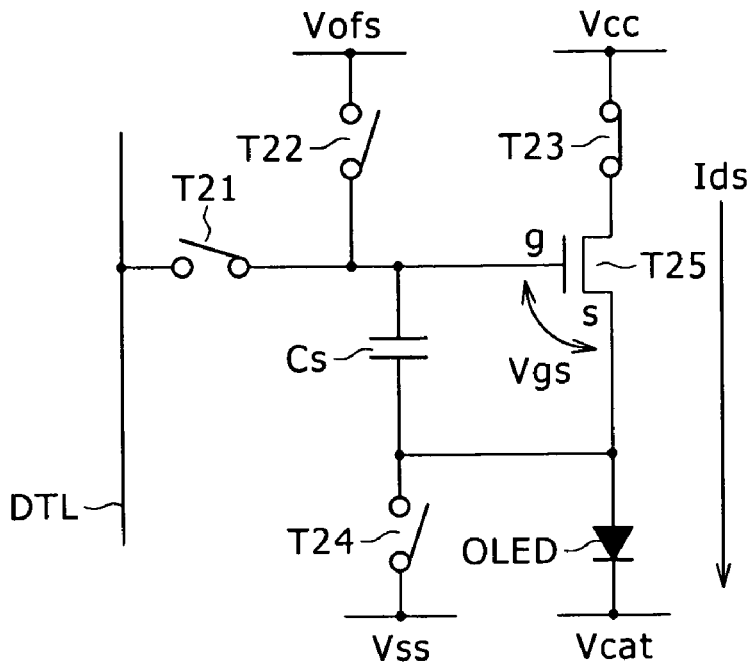
FIGS. 7 to 9 are circuit diagrams explaining operation states in the pixel circuit shown in FIG. 5.
Figure 8:
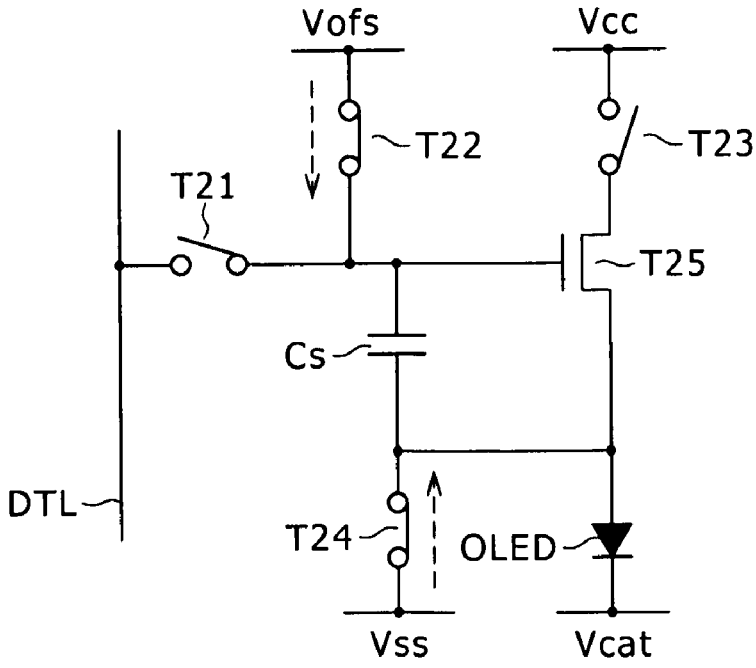
Figure 9:
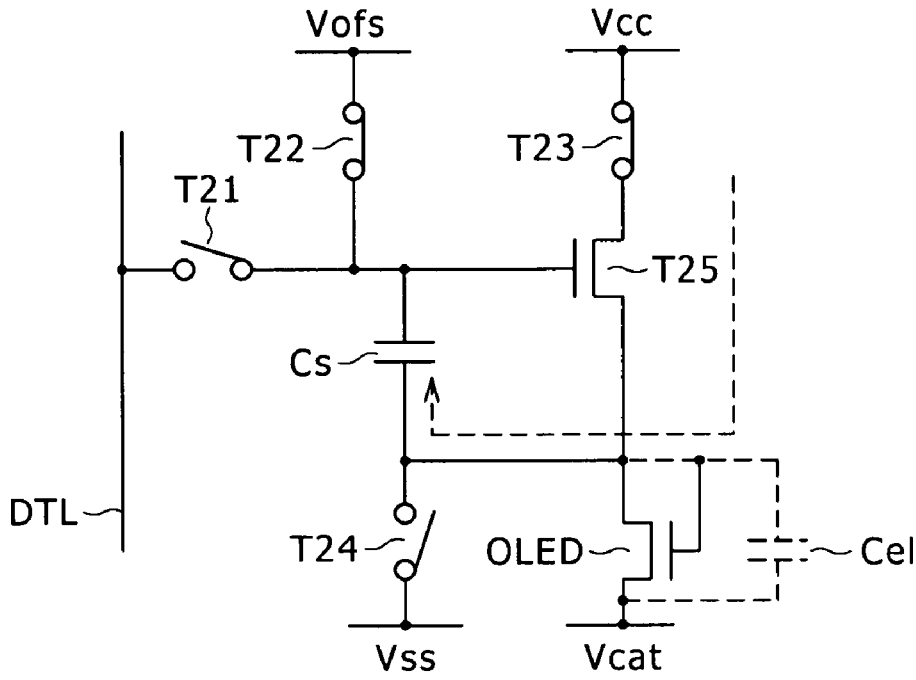
Figure 10:
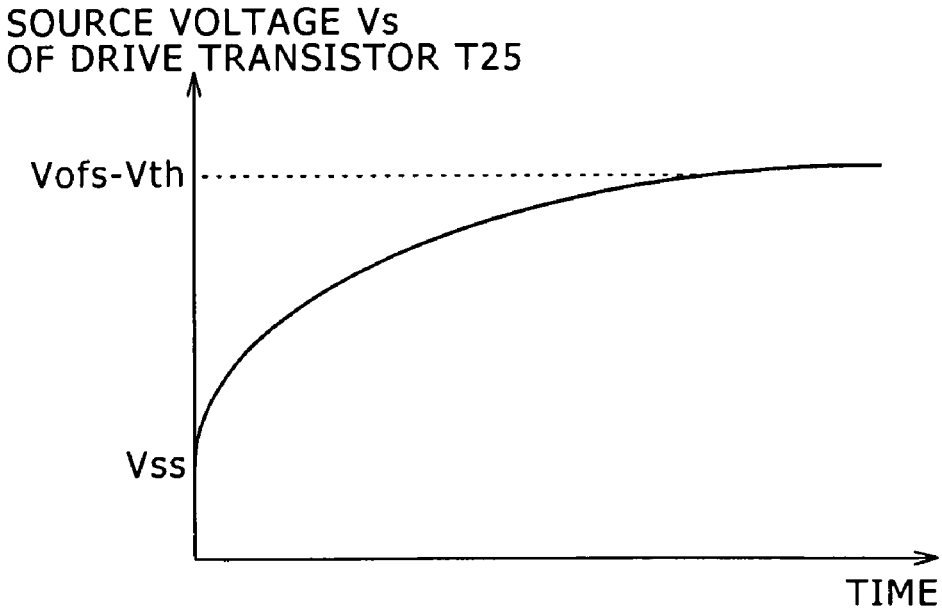
FIG. 10 is a graphical representation explaining a temporal change in source potential of a drive transistor.
Figure 11:
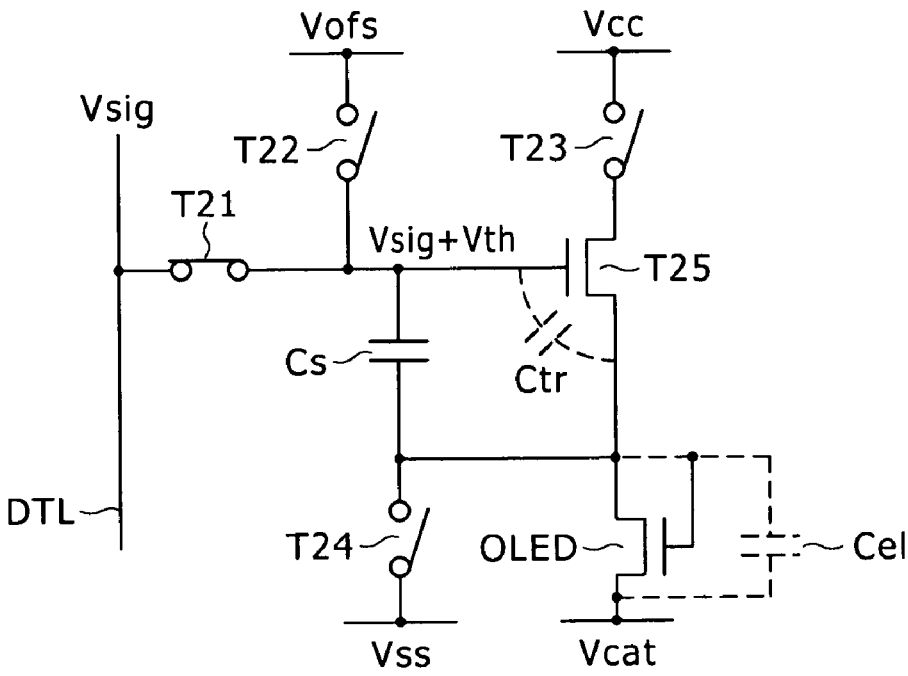
FIGS. 11 and 12 are circuit diagrams explaining operation states in the pixel circuit shown in FIG. 5.
Figure 12:
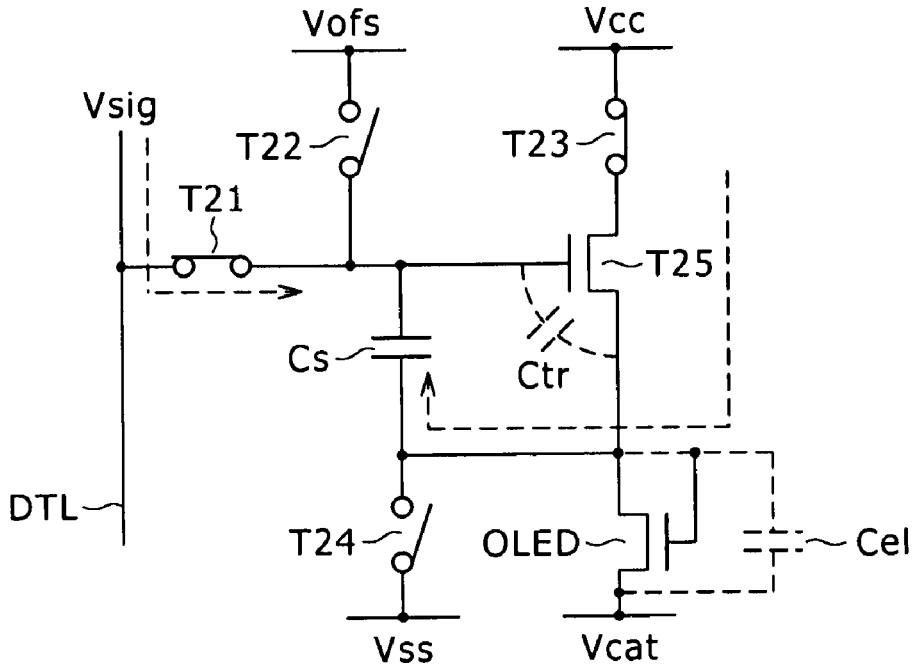
Figure 13:
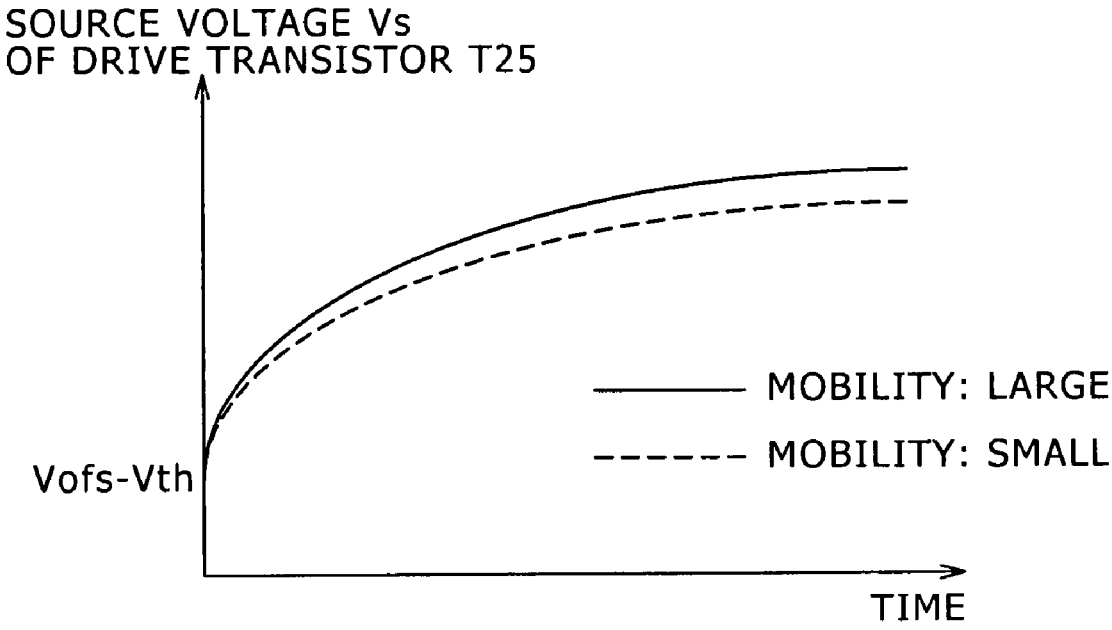
FIG. 13 is a graphical representation explaining a difference in temporal change in source voltage of the drive transistor due to a difference in mobility.
Figure 14:
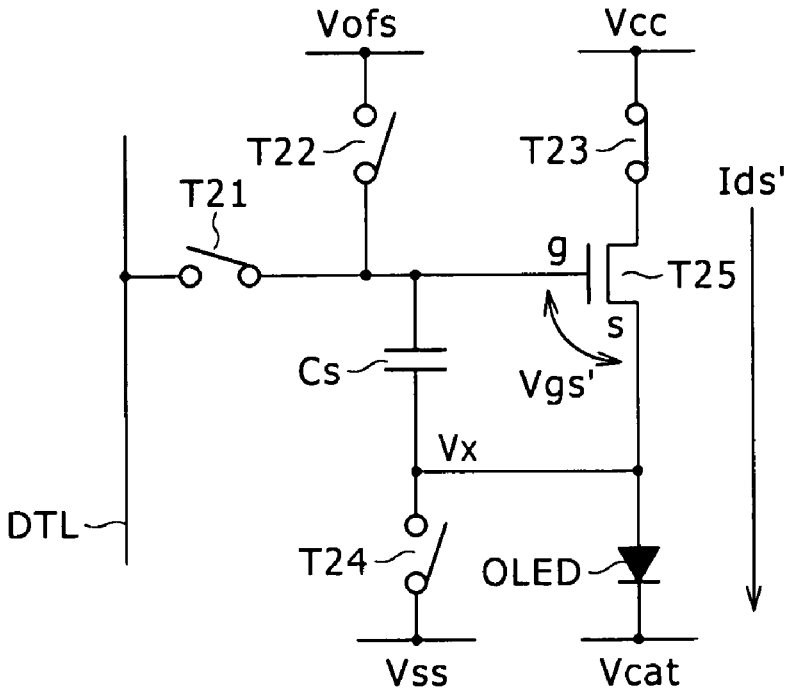
FIG. 14 is a circuit diagram explaining an operation state in the pixel circuit shown in FIG. 5.
Figure 15A:
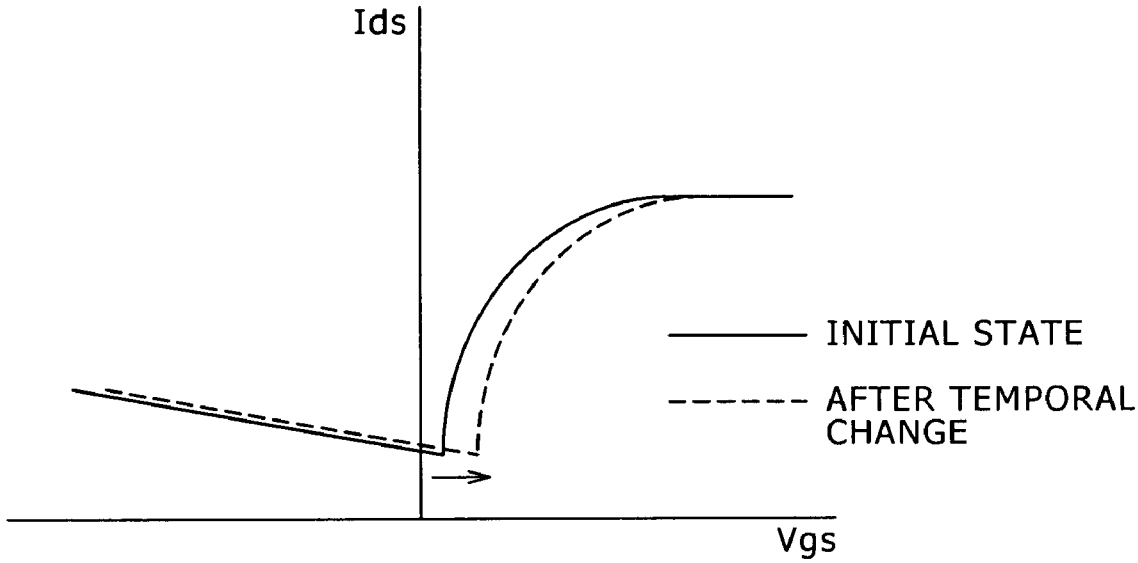
FIGS. 15A and 15B are respectively a graphical representation explaining a phenomenon of a change with time of a threshold voltage of the drive transistor in a phase of application of a positive bias, and a graphical representation explaining a phenomenon of a change with time of the threshold voltage of the drive transistor in a phase of application of a negative bias.
Figure 15B:
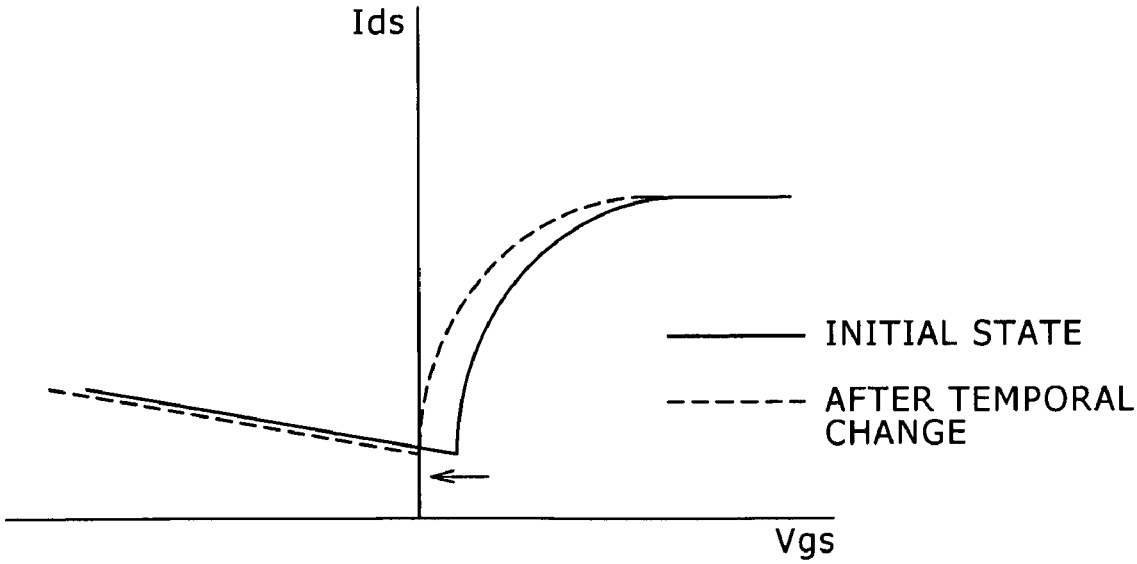
Figure 19:
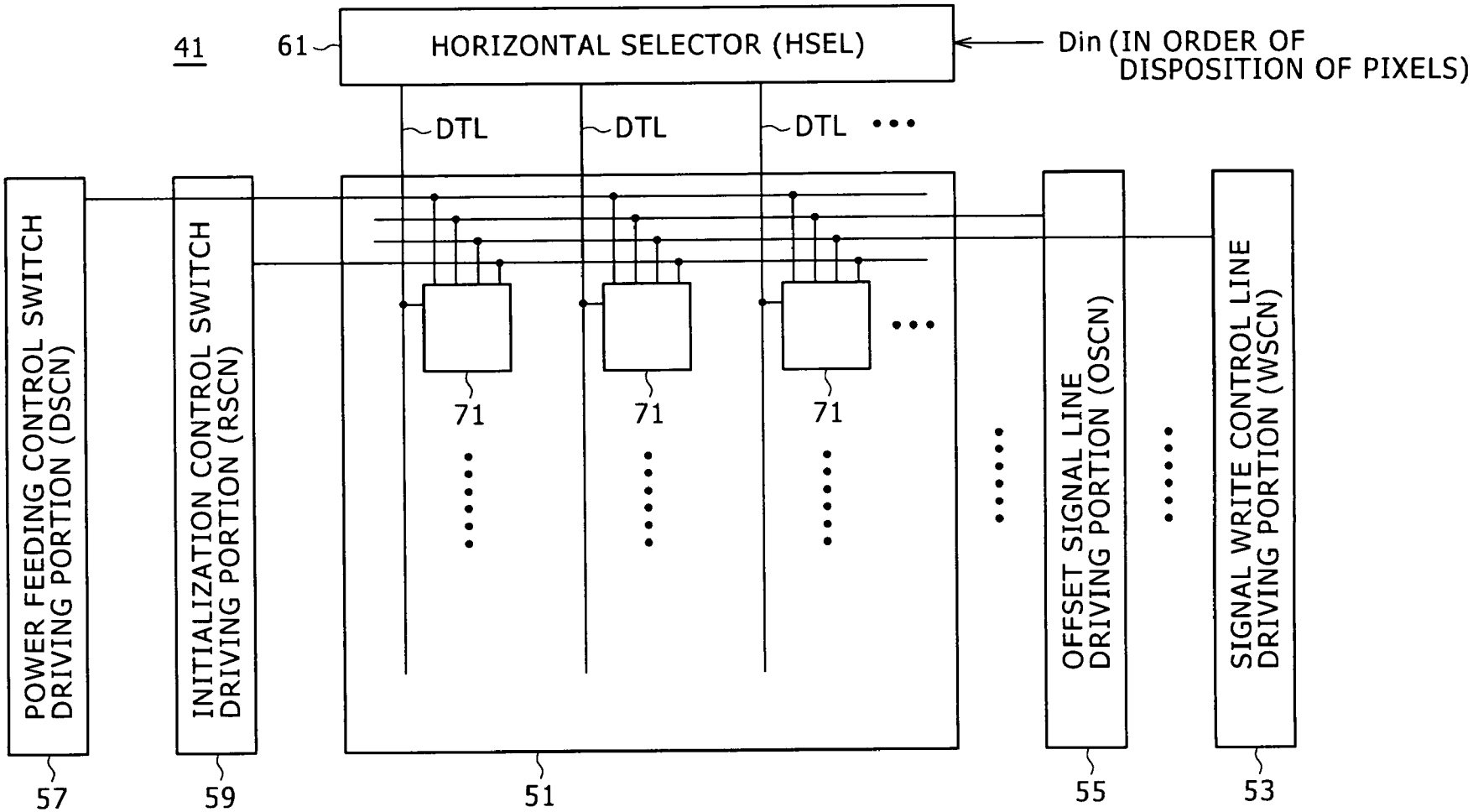
FIG. 19 is a block diagram explaining a connection relationship between pixel circuits and each of drive circuits in the organic EL display panel shown in FIG. 18.
Figure 20:
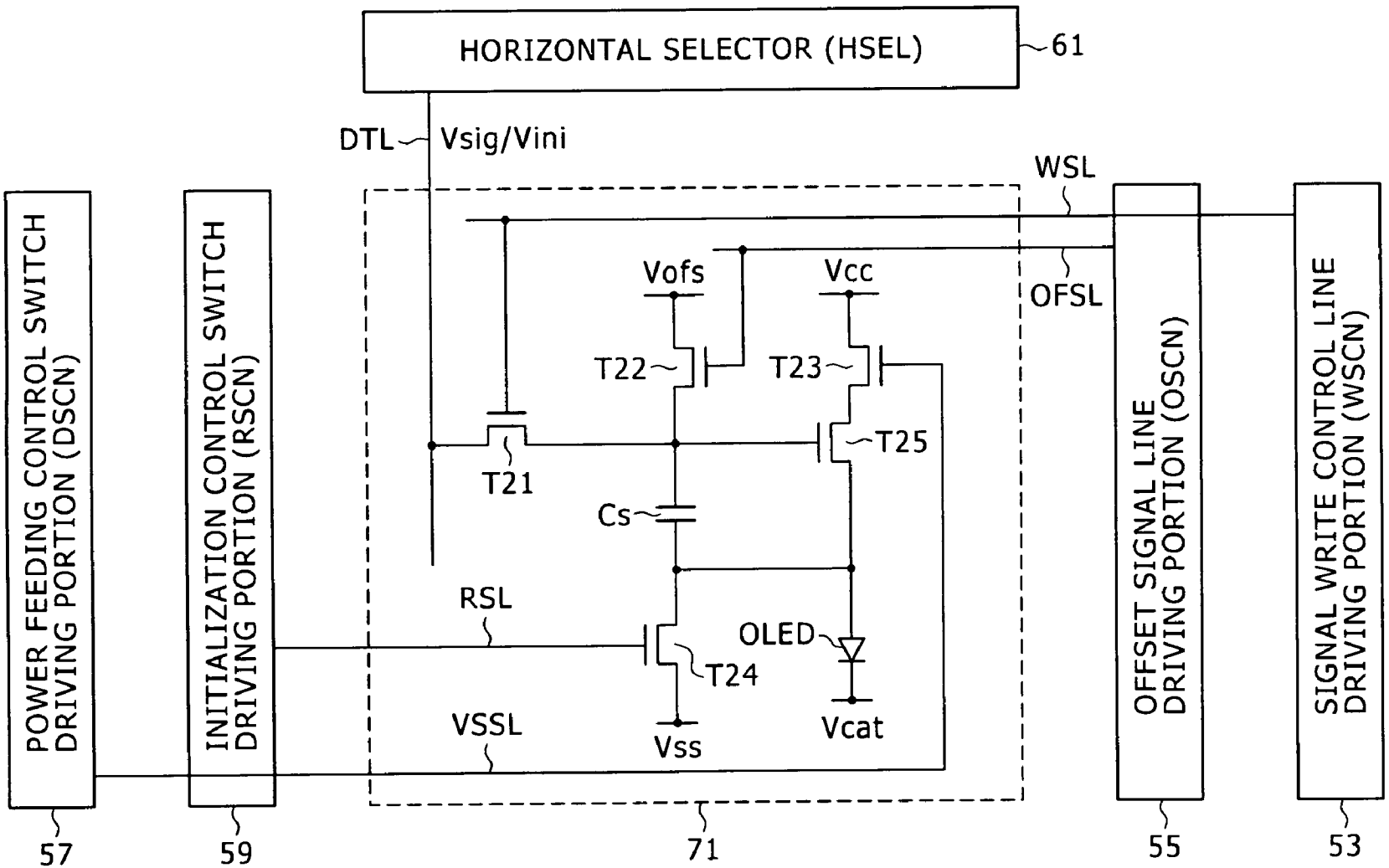
FIG. 20 is a circuit diagram, partly in block, showing a configuration of the pixel circuit in the first embodiment of the present invention.

FIG. 19 shows a connection relationship between pixel circuits 71 corresponding to the sub-pixels, respectively, and each of the driving circuits 53, 55, 57, 59, and 61. In addition, FIG. 20 shows an internal configuration of the pixel circuit 71 in the organic EL display panel 41 of the first embodiment. It is noted that the pixel circuit 71 is identical to the pixel circuit 21 shown in FIG. 5 in that the pixel circuit 71 is composed of five N-channel thin film transistors T21, T22, T23, T24, and T25, a hold capacitor Cs, and an organic EL element OLED.

The signal write control line driving portion 53 is the drive circuit by which the N-channel thin film transistor T21 (hereinafter referred to as "the first sampling transistor T21") is controlled so as to be turned ON/OFF. When the first sampling transistor T21 is controlled so as to be turned ON, a signal potential of the corresponding one of the signal lines DTLs (referred to as "a signal line potential" as well in this specification) is applied to a gate electrode of the drive transistor T25.

The offset signal line driving portion 55 is the drive circuit by which the N-channel thin film transistor T22 (hereinafter referred to as "the second sampling transistor T22") is controlled so as to be turned ON/OFF. When the second sampling transistor T22 is controlled so as to be turned ON, an offset potential Vofs is applied to the gate electrode of the drive transistor T25.

The power feeding control switch driving portion 57 is the drive circuit by which the N-channel thin film transistor T23 (hereinafter referred to as "the first switching transistor T23") is controlled so as to be turned ON/OFF. When the first switching transistor T23 is controlled so as to be turned ON, a high drive potential (that is, a power source potential Vcc) is applied to a drain electrode of the drive transistor T25.

The initialization control switch driving portion 59 is the drive circuit by which the N-channel thin film transistor T24 (hereinafter referred to as "the second switching transistor T24") is controlled so as to be turned ON/OFF. When the second switching transistor T24 is controlled so as to be turned ON, a low drive potential (that is, an initialization potential Vss) is applied to a source electrode of the drive transistor T25.

Each of these driving portions 53, 55, 57, and 59 is composed of a shift register having output stages the number of which corresponds to a vertical resolution. Thus, each of the driving portions 53, 55, 57, and 59 outputs a necessary drive pulse to the corresponding one of the control lines in accordance with a timing signal supplied thereto from the timing generator 63.

The horizontal selector 61 is the drive circuit by which either a signal potential Vsig corresponding to pixel data Din or a reverse bias potential Vini corresponding to the signal potential Vsig is applied to the signal lines DTLs in a time division manner.

The timing generator 63 generates a timing pulse necessary for the driving for the write control lines WSLs, signal lines DTLs, power feeding control lines VSSLs, and initialization control lines RSLs.

(B-2) Configuration of Horizontal Selector

Figure 21:
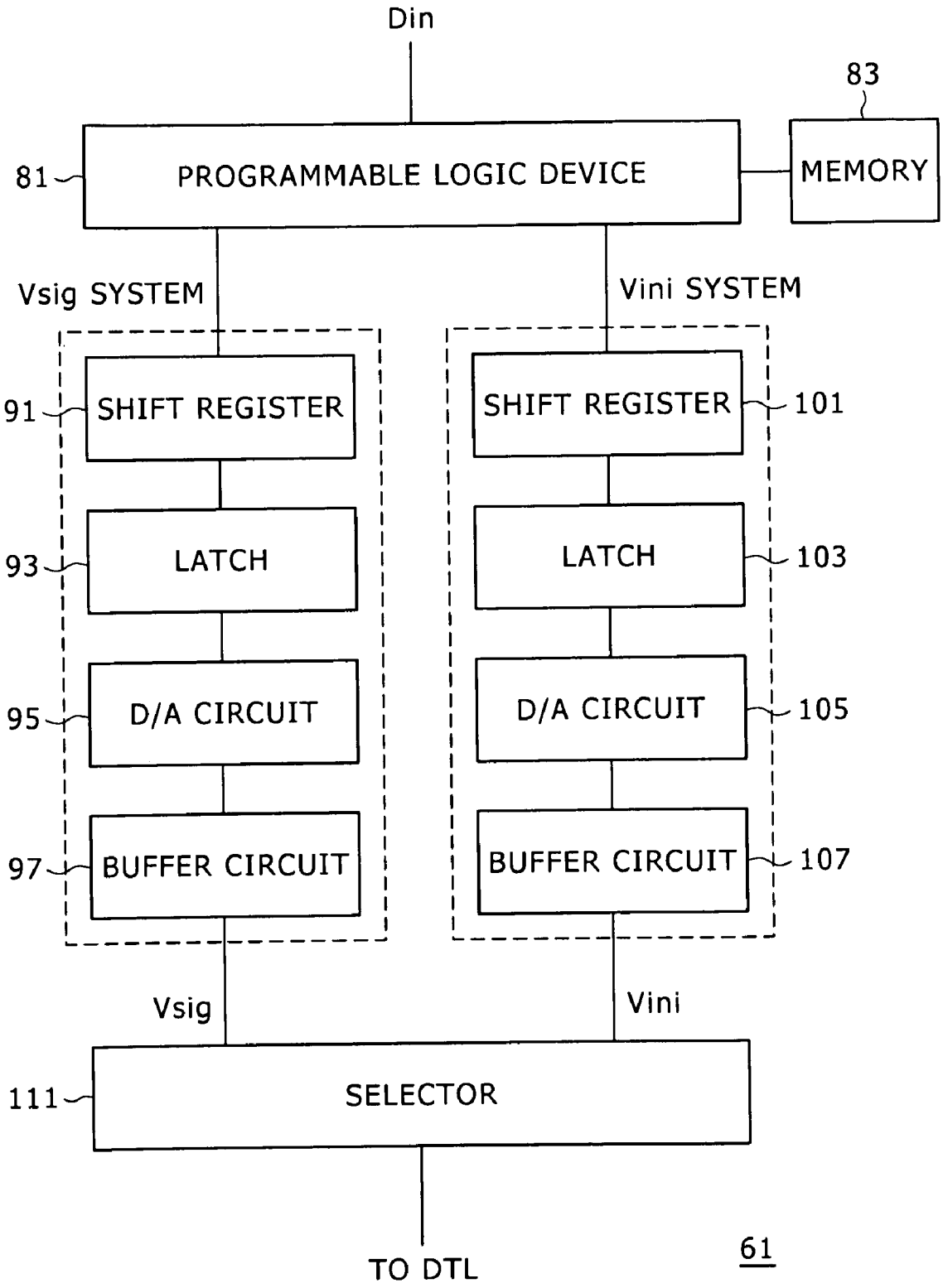
FIG. 21 is a block diagram showing a configuration of a horizontal selector in the organic EL display panel of the first embodiment of the present invention.

FIG. 21 shows a circuit configuration of the horizontal selector 61 as the key device in the organic EL display device of the first embodiment.

The horizontal selector 61 is composed of a programmable logic device 81, a memory 83, shift registers 91 and 101, latch circuits 93 and 103, D/A conversion circuits 95 and 105, buffer circuits 97 and 107, and a selector 111.

Of these constituent elements, the programmable logic device 81, and the shift register 101, the latch 103, the D/A circuit 105, and the buffer circuit 107 in a reverse bias potential system (Vini system) correspond to "a reverse bias potential generating portion" claimed in the appended claims. In addition, the selector 111 corresponds to "a voltage applying portion" in the appended claims.

The programmable logic device 81 is a circuit device for generating pixel data Din' (gradation value) corresponding to a reverse bias potential Vini.

In the case of the first embodiment, the memory 83 is used when a non-emission time period extends over a plurality of horizontal scanning time periods. Therefore, when operations from a turn-OFF operation to various correction operations for the non-emission time period are all carried out for one horizontal scanning time period, it is also expected that no memory 83 is mounted in the horizontal selector 61.

The programmable logic device 81 operates while adjusting a time difference between a timing for application of the reverse bias potential Vini, and a timing for application of the signal potential Vsig by reading out the pixel data Din from the memory 83.

Here, the programmable logic device 81 directly outputs the pixel data Din read out from a corresponding area of the memory 83 to a signal potential system (Vsig system). On the other hand, the programmable logic device 81 outputs the pixel data Din' (gradation value) generated based on the pixel data Din read out from the corresponding area of the memory 83 to the reverse bias potential system (Vini system).

However, the reverse bias potential Vini thus generated is desired to be equal to or smaller than a total sum, (Vcat+Vthel+Vth), of the cathode potential Vcat, the threshold voltage Vthel of the organic EL element OLED, and the threshold voltage Vth of the drive transistor T25. This desire is made for the purpose of stopping the light emission of the organic EL element OLED.

Figures 22A, 22B, 22C:
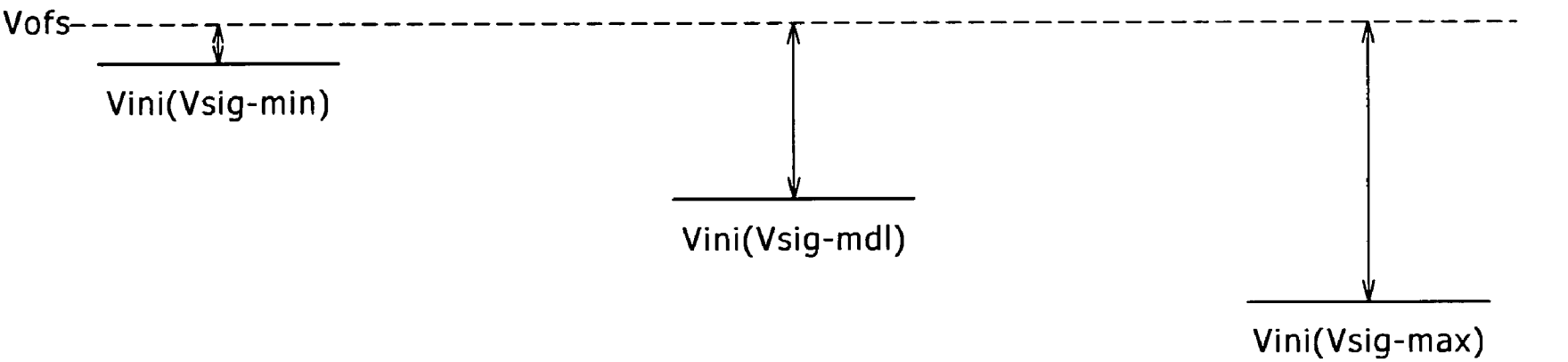
FIGS. 22A to 22C are respectively diagrams each showing a relationship between a reverse bias potential generated in accordance with a signal potential, and a magnitude of a reverse bias voltage.

Moreover, it is desired for the reverse bias potential Vini generated that the reverse bias voltage becomes large as the luminance becomes higher. That is to say, it is desired that the reverse bias potential Vini becomes small as the emission luminance of the organic EL element OLED becomes higher. FIGS. 22A to 22C are diagrams each showing a correspondence relationship between the signal potential Vsig and the reverse bias potential Vini corresponding thereto.

FIG. 22A shows an example of generation of the reverse bias potential Vini corresponding to black display (a minimum value of the signal potential Vsig). FIG. 22B shows an example of generation of the reverse bias potential Vini corresponding to intermediate luminance display (an intermediate value of the signal potential Vsig). Also, FIG. 22C shows an example of generation of the reverse bias potential Vini corresponding to white display (a maximum value of the signal potential Vsig).

In the case of the first embodiment, the programmable logic device 81 generates pixel data Din' corresponding to the reverse bias potential Vini in accordance with Expression (3):

$$Din'=Dthel+Dcat-(\alpha Din+\beta) \quad (3)$$

where Dthel is a data value corresponding to the threshold voltage Vthel of the organic EL element OLED, Dcat is a data value corresponding to the cathode potential Vcat, and $\alpha$ and $\beta$ are coefficients, respectively. In this case, values which fulfill relationships of $\alpha>0$ and $\beta\geqq 0$ are previously set for the coefficients $\alpha$ and $\beta$, respectively.

The programmable logic device 81 calculates the pixel data Din' for the reverse bias potentials Vini corresponding to the signal potentials Vsig, respectively, by substituting the pixel data Din inputted or read out into Expression (3).

As a result, the reverse bias potential Vini applied to the corresponding one of the signal lines DTLs fulfills Expression (4):

$$Vini=Vthel+Vcat-(\alpha Vsig+\beta)(\alpha>0 \text{ and } \beta\geqq 0) \quad (4)$$

Of course, the reverse bias potential Vini fulfills the above condition because it is smaller than a potential of (Vcat+Vthel+Vth). In addition, the reverse bias potential Vini fulfills the condition as well that the reverse bias potential Vini becomes small as the signal potential Vsig becomes larger.

The shift registers 91 and 101 are circuit devices for giving timings at which the pixel data Din and Din' are outputted, respectively.

The latch circuits 93 and 103 are storage devices for holding the pixel data Din and Din' for adjustment for the output timings of the pixel data Din and Din', respectively.

The D/A conversin circuits 95 and 105 are circuit devices for converting digital signals input thereto into analog signals. Incidentally, negative supply is used for the D/A conversion circuit 105 of Vini system.

The buffer circuits 97 and 107 are circuit devices for converting the analog signals from the D/A conversion circuits 95 and 105 into analog signals each having a signal level suitable for driving the pixel circuit, respectively.

The selector 111 is a circuit device for outputting the reverse bias potential Vini and the signal potential Vsig withing one horizontal scannint time period in a time sequential manner.

(B-3) Drive Operation

FIGS. 23A to 23G are a timing chart showing an operation for driving the pixel circuit shown in FIG. 20.

Figure 24:
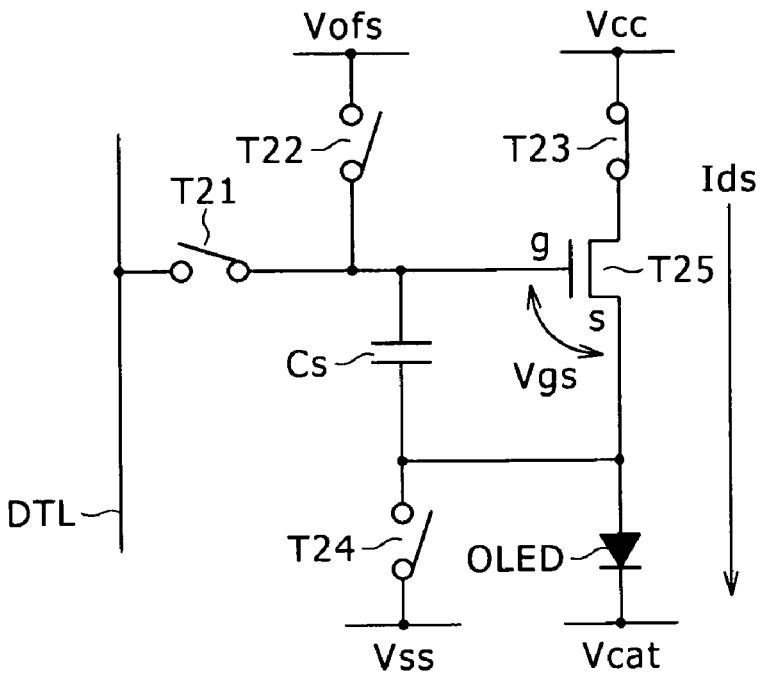
FIGS. 24 and 25 are circuit diagrams explaining operation states in the pixel circuit shown in FIG. 20.

Firstly, FIG. 24 shows an operation state within the pixel circuit 71 in the emission state. At this time, only the first switching transistor T23 is held in the ON state (t1 in FIGS. 23A to 23G). On the other hand, the drive transistor T25 operates in a saturated region, and supplies a drive current Ids having a magnitude depending on a gate-to-source voltage Vgs of the drive transistor T25 to the organic EL element OLED.

Next, an operation state of the pixel circuit 71 in the non-emission state will be described. The first sampling transistor T21 is newly controlled so as to be turned ON while the first switching transistor T23 is held in an ON state, thereby starting the non-emission state (t2 in FIGS. 23A to 23G). At this time, the reverse bias potential Vini is applied to the corresponding one of the signal lines DTLs.

Figure 25:
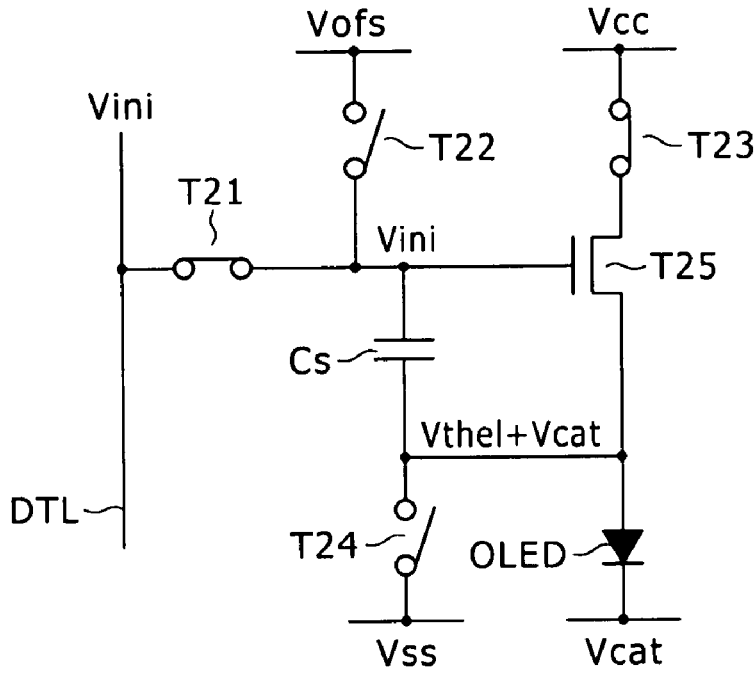

By carrying out this operation, a gate potential Vg of the drive transistor T25 is controlled so as to become the reverse bias potential Vini. FIG. 25 shows an operation state within the pixel circuit 71 at this time point.

At this time, a source potential Vs of the drive transistor T25 drops through a coupling operation of the hold capacitor Cs. During this change in source potential Vs, the gate-to-source voltage Vgs of the drive transistor T25 becomes equal to or lower than the threshold voltage Vth. As a result, the operation state of the organic EL element OLED is switched from the emission state over to the non-emission state.

It is noted that when the source potential Vs of the drive transistor T25 (an anode potential Vel of the organic EL element OLED) after completion of the coupling operation is equal to or smaller than a sum of the threshold voltage Vthel and the cathode potential Vcat of the organic EL element OLED, the source potential Vs of the drive transistor T25 is held as it is.

On the other hand, when the source potential Vs of the drive transistor T25 after completion of the coupling operation is equal to or larger than a sum of the threshold voltage Vthel and the cathode potential Vcat of the organic EL element OLED, the source potential Vs of the drive transistor T25 converges to a potential of (Vthel+Vcat) owing to the discharge of the electric charges accumulated in the organic EL element OLED. FIG. 25 shows a state in which when the source potential Vs of the drive transistor T25 after completion of the coupling operation converges to the potential of (Vthel+Vcat).

That is to say, the power source potential Vcc is applied to the drain electrode of the drive transistor T25, the reverse bias potential Vini is applied to the gate electrode of the drive transistor T25, and the potential of (Vthel+Vcat) is applied to the source electrode of the drive transistor T25. This state thus generated means that the reverse voltage is applied to the drive transistor T25.

In addition, as previously stated, a magnitude of the signal potential Vsig which is subsequently written to the pixel circuit 71 is reflected in the reverse potential Vini stated here. That is to say, when the signal potential Vsig which is subsequently written to the pixel circuit 71 is the black display potential, the reverse bias voltage becomes small accordingly, whereas when the signal potential Vsig is the white display potential, the reverse bias voltage becomes large accordingly.

As a result, an amount of change in threshold voltage Vth, in the positive direction, caused for the emission time period can be corrected with the reverse bias voltage which is applied to the gate electrode of the drive transistor T25 for the non-emission time period within the same one frame.

It is noted that in the case of the pixel circuit 71, a duty of the emission time within one frame time period can be made variable in accordance with the ON/OFF control for the first switching transistor T23. In addition, it is supposed that even when the variable control for such a length of the emission time period is not actively carried out, the duty of the emission time within one frame time period differs depending on the display systems.

Of course, when the duty of the emission time within one frame time period is large, the amount of change in threshold voltage Vth in the positive direction increases accordingly. Therefore, in this case, it is preferable that the reverse bias potential Vini is reduced, thereby applying the larger reverse bias voltage to the gate electrode of the drive transistor T25.

On the other hand, when the duty of the emission time is small, the amount of change in threshold voltage Vth decreases accordingly. Therefore, in this case, it is preferable that the reverse bias potential Vini is increased, thereby applying the smaller reverse bias voltage to the gate electrode of the drive transistor T25. Setting relationships between the reverse bias potentials Vini corresponding to the duties of the emission times, respectively, are exemplified in FIGS. 26A to 26C. In each of these figures, a solid line indicates an example of generation of the reverse potential Vini when the emission time period is short. Also, a broken line indicates an example of generation of the reverse potential Vini when the emission time period is long.

After that, each of the first sampling transistor T21 and the first switching transistor T23 is controlled so as to be turned OFF, and the state of each of the second sampling transistor T22 and the second switching transistor T24 is switched from the OFF state over to the ON state. By carrying out this operation, a threshold correction preparing operation is started (t3 in FIGS. 23A to 23G).

Figure 27:
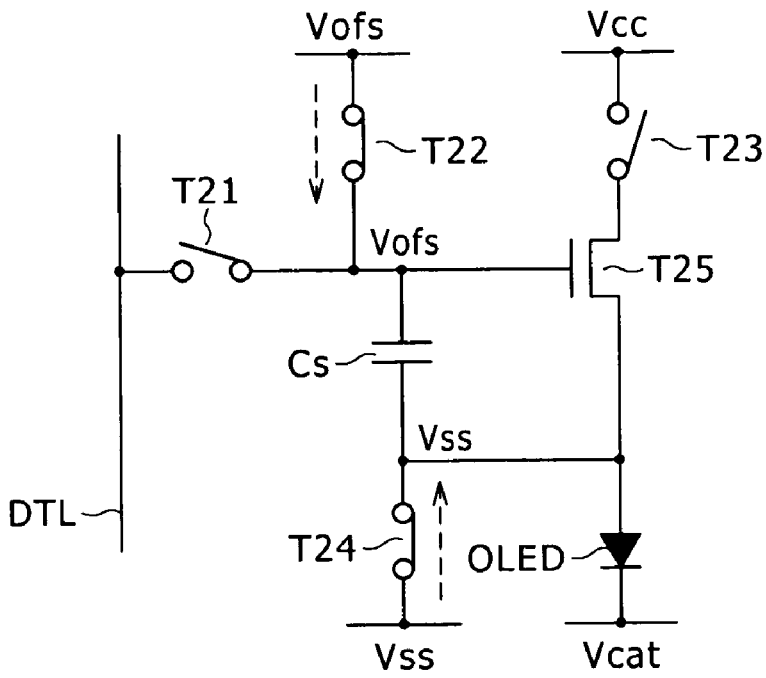
FIGS. 27 to 31 are circuit diagrams explaining operation states in the pixel circuit shown in FIG. 20.

FIG. 27 shows a connection state within the pixel circuit 71 at this time point. In this case, the gate potential Vg and the source potential Vs of the drive transistor T25 are controlled so as to become equal to an offset potential Vofs and an initialization potential Vss, respectively. That is to say, the gate-to-source voltage Vgs of the drive transistor T25 is controlled so as to become equal to the voltage of (Vofs−Vss). This voltage of (Vofs−Vss) is set at a value larger than the threshold voltage Vth. As a result, a drive current Ids' having a magnitude corresponding to the voltage of (Vofs−Vss) is caused to flow from a power source potential line (at Vcc) into an initialization potential line (at Vss).

However, when the drive current Ids' is caused to flow through the organic EL element OLED, the organic EL element OLED emits a light with a luminance unrelated to the signal potential Vsig. In order to cope with this situation, both the offset potential Vofs and the initialization potential Vss are set for the purpose of holding the organic EL element OLED in the non-emission state.

That is to say, the anode potential Vel of the organic EL element OLED is set so as to become smaller than the sum of the threshold voltage Vthel and the cathode potential Vcat of the organic EL element OLED. It is noted that any one of the second sampling transistor T22 and the second switching transistor T24 may be first controlled so as to be turned ON.

Figure 28:
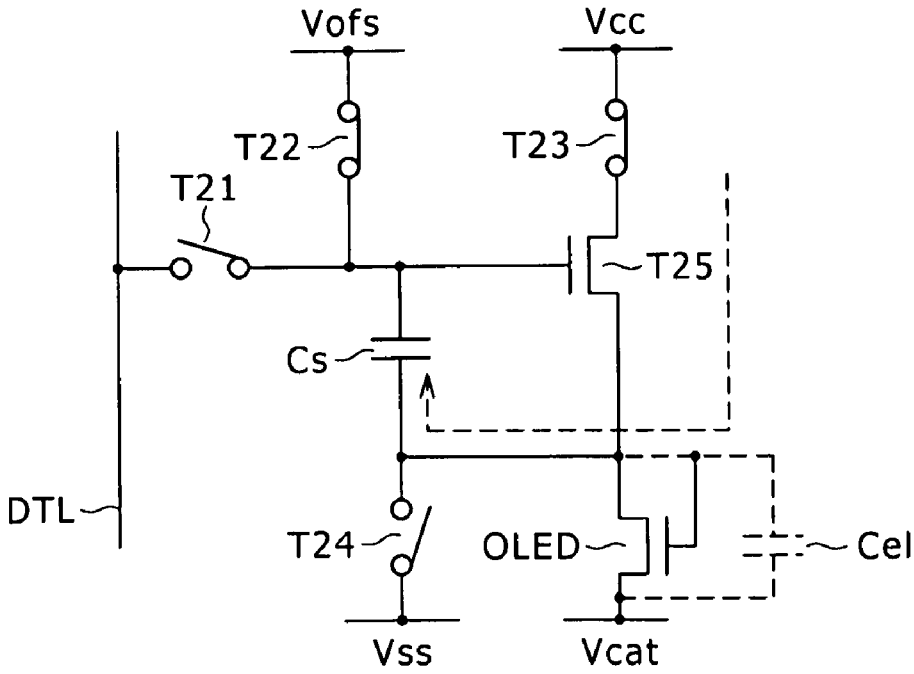

Next, only the second switching transistor T24 is controlled so as to be turned OFF while the second sampling transistor T22 is held in the ON state (t4 in FIGS. 23A to 23G). FIG. 28 shows an operation state within the pixel circuit 71 at this time point. It is noted that in FIG. 28, the organic EL element OLED is shown in the form of an equivalent circuit having a diode and a capacitor.

In this case, the current caused to flow through the drive transistor T25 is used to charge both the hold capacitor Cs, and a parasitic capacitance Cel of the organic EL element OLED with the electricity as long as a relationship of (Vel≦Vcat+Vthel) is maintained (the leakage current of the organic EL element OLED is considerably smaller than the current caused to flow through the drive transistor T25).

By carrying out this charging operation, the anode potential Vel rises with time.

It is noted that the rise of the source potential Vs of the drive transistor T25 ends at a time point when the gate-to-source voltage Vgs of the drive transistor T25 reaches the threshold voltage Vth of the drive transistor T25. At this time, the anode potential Vel fulfills a relationship of Vel=Vofs−Vth≦Vcat+Vthel. This operation is a threshold correcting operation for the drive transistor T25. After that, the first switching transistor T23 is first controlled so as to be turned OFF, and subsequently the second sampling transistor T22 is controlled so as to be turned OFF.

The turn-OFF control is carried out in this order of the first switching transistor T23 and the second sampling transistor T22, thereby making it possible to suppress the change in gate potential Vg of the drive transistor T25.

Figure 29:
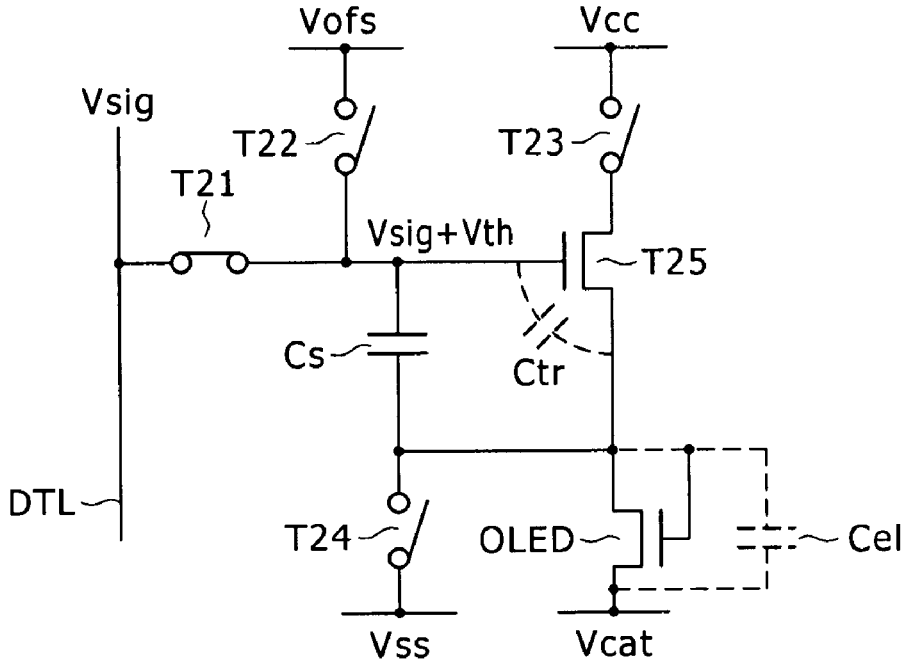

Next, only the first sampling transistor T21 is newly controlled so as to be turned ON, thereby starting a mobility correcting operation used as a signal writing operation as well (t5 in FIGS. 23A to 23G). FIG. 29 shows an operation state within the pixel circuit 71 at this time point. At this time, the gate-to-source voltage Vgs of the drive transistor T25 is expressed by Expression (5):

$$Vgs=\{Cel/(Cel+Cs+Ctr)\}\cdot(Vsig-Vofs)+Vth \quad (5)$$

where Cel is a parasitic capacitance of the organic EL element OLED, Ctr is a parasitic capacitance of the drive transistor T25, and Cs is a capacitance of the hold capacitor Cs.

In this case, the parasitic capacitance Cel is larger than each of the parasitic capacitances Cs and Ctr. Therefore, the gate-to-source voltage Vgs is approximately given by (Vsig+Vth).

In this state, the first switching transistor T23 is newly controlled so as to be turned ON (t6 in FIGS. 23A to 23G). In this case as well, the current caused to flow through the drive transistor T25 is used to charge each of the hold capacitor Cs and the parasitic capacitance Cel of the organic EL element OLED with the electricity as long as the source potential Vs of the drive transistor T25 does not exceed the sum of the threshold voltage Vthel and the cathode potential Vcat of the organic EL element OLED (the magnitude of the leakage current of the organic EL element OLED is considerably smaller than that of the current caused to flow through the drive transistor T25).

Figure 30:
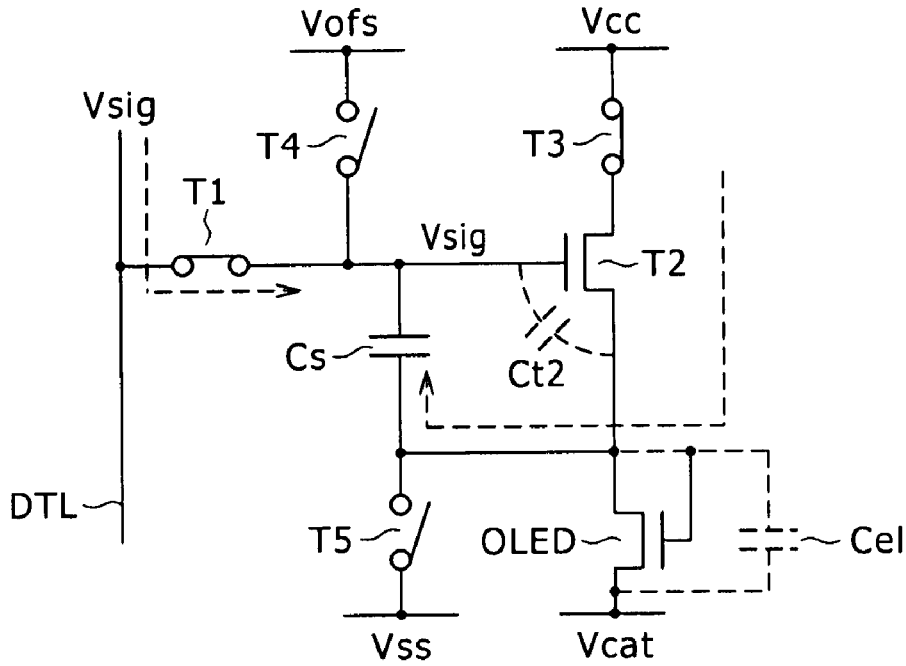

FIG. 30 shows an operation state within the pixel circuit 71 at this time point. It is noted that at this time point, the threshold correcting operation for the drive transistor T25 has already been completed. For this reason, the current caused to flow through the drive transistor T25 has a value in which the mobility μ is reflected.

Specifically, an amount of current caused to flow through the drive transistor T25 having the large mobility μ becomes large, and thus the source potential Vs of the drive transistor T25 speedily rises.

On the other hand, an amount of current caused to flow through the drive transistor T25 having the small mobility μ becomes small, and thus the source potential Vs of the drive transistor T25 slowly rises.

As a result, the gate-to-source voltage Vgs of the drive transistor T25 decreases because the mobility μ is reflected therein. Thus, after a lapse of a given time, the gate-to-source voltage Vgs of the drive transistor T25 converges to the gate-to-source voltage Vgs obtained by perfectly correcting the mobility μ.

After completion of the mobility correcting operation used as the signal writing operation as well, the first sampling transistor T21 is controlled so as to be turned OFF, and the gate electrode of the drive transistor T25 is controlled as the free end. Along with this operation, the drive current Ids' for the drive transistor T25 is caused to flow into the organic EL element OLED, so that the organic EL element OLED starts to emit a light with a luminance corresponding to a value of the drive current. It is noted that the source potential Vs of the drive transistor T25 rises up to a voltage Vx corresponding to the value of the drive current caused to flow through the organic EL element OLED (t7 in FIGS. 23A to 23G).

Figure 31:
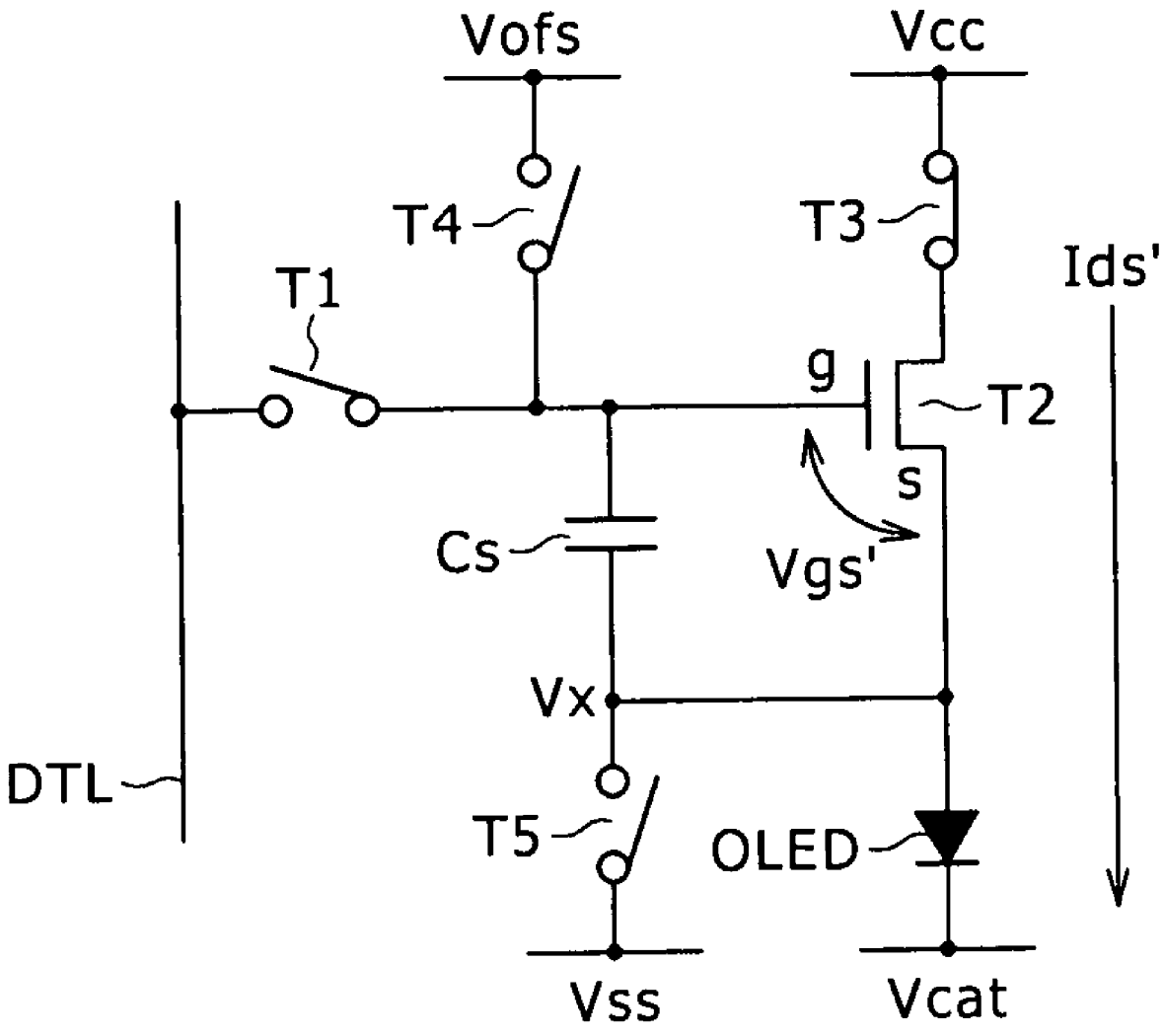

FIG. 31 shows an operation state within the pixel circuit 71 at this time point.

It is noted that in the case as well of the pixel circuit 71 stated here, the I-V characteristics themselves of the organic EL element OLED change as an emission time period gets longer. That is to say, the voltage Vx also changes.

However, in the case of this circuit configuration, the value of the current caused to flow through the organic EL element OLED does not change because the gate-to-source voltage Vgs of the drive transistor T25 is held constant.

That is to say, even when the I-V characteristics of the organic EL element OLED change with the temporal change, the constant current Ids' usually continues to be caused to flow through the drive transistor T25. As a result, the luminance of the organic EL element OLED can be held constant.

(B-4) Conclusion

As described above, the reverse bias voltage is set in accordance with the magnitude of the signal potential Vsig, which results in that an amount of change in threshold voltage Vth in the positive direction within one frame time period, and an amount of change in threshold voltage Vth in the negative direction within one frame time period can be equalized with each other.

As a result, it is possible to reduce the change generated in the threshold voltage Vth of the drive transistor T25, and it is possible to reduce the dispersion of the threshold voltages Vth of the pixels. This means that it is possible to efficiently suppress the phenomenon that a difference in luminance occurs between the pixels (the burn-in phenomenon). As a result, it is possible to realize the organic EL display panel in which even when the used time becomes long, the non-uniformity of the luminance hardly occurs.

In addition, in the case of this drive system, it is unnecessary to cause the source potential Vs of the drive transistor T25 to rise before the threshold correction preparation. For this reason, this drive system is also effective in cost saving of the organic EL display panel.

In addition, in the case of this drive system, it is advantageous that the amorphous silicon system process having a large amount of change in threshold voltage Vth is applied to the manufacture of the organic EL display panel.

(C) Second Embodiment (C-1) System Configuration

In a second embodiment, a description will now be given with respect to an organic EL display panel in which a pixel circuit is composed of two N-channel thin film transistors, a hold capacitor Cs, and an organic EL element OLED.

Figure 32:
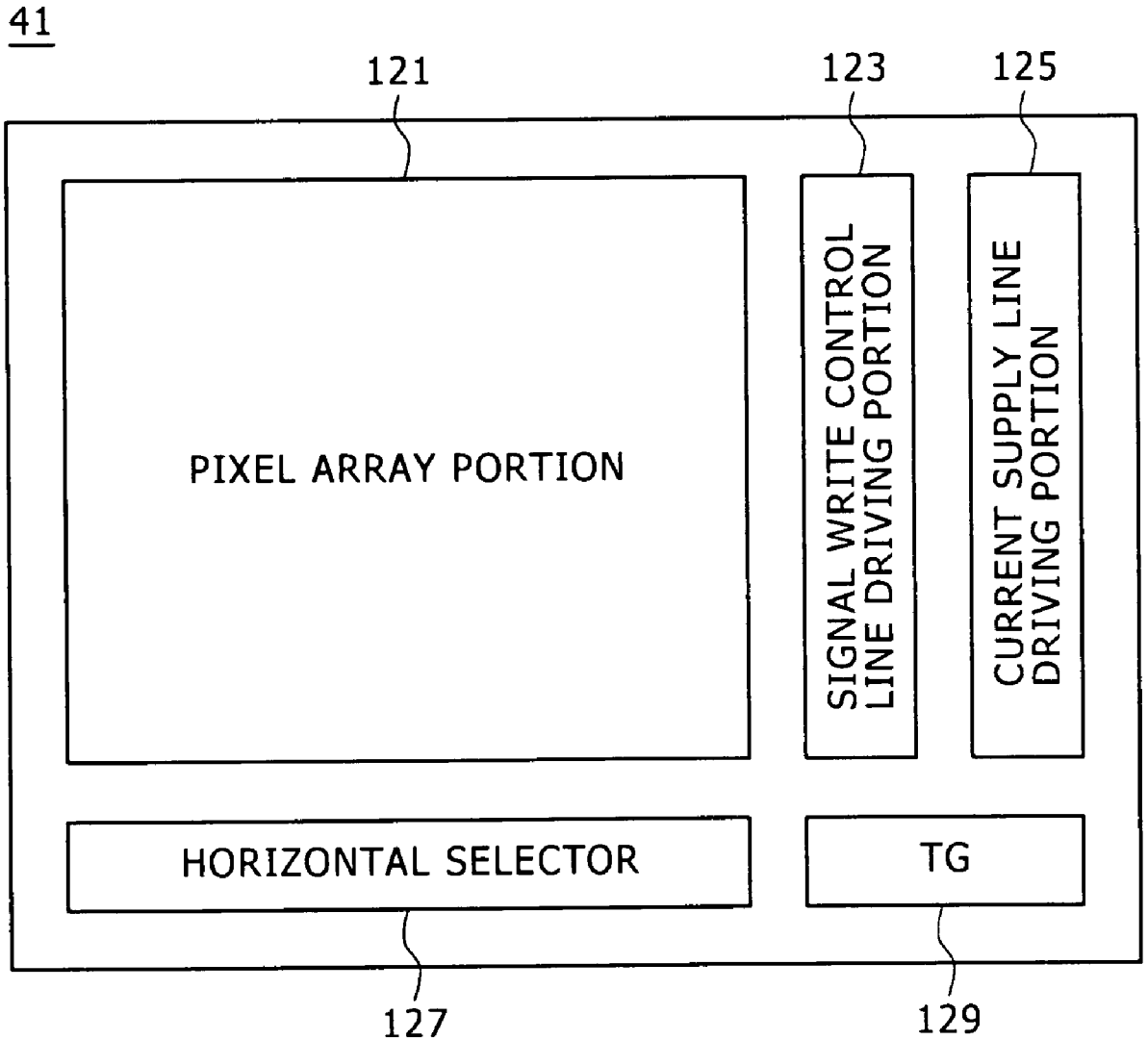
FIG. 32 is a block diagram showing a configuration of an organic EL display panel according to a second embodiment of the present invention.

FIG. 32 shows a system configuration of an organic EL display panel 41. The organic EL display panel 41 shown in FIG. 32 is composed of a pixel array portion 121, a signal write control line driving portion 123, a current supply line driving portion 125, and a horizontal selector 127 which operate as drive circuits for the pixel array portion 121, and a timing generator 129.

The pixel array portion 121 of the second embodiment also has the matrix structure in which the sub-pixel is disposed in each of intersection positions between the signal lines DTLs and the write control lines WSLs. However, the second embodiment is different from the first embodiment in that the number of N-channel thin film transistors composing the sub-pixel (pixel circuit) is two.

Figure 33:
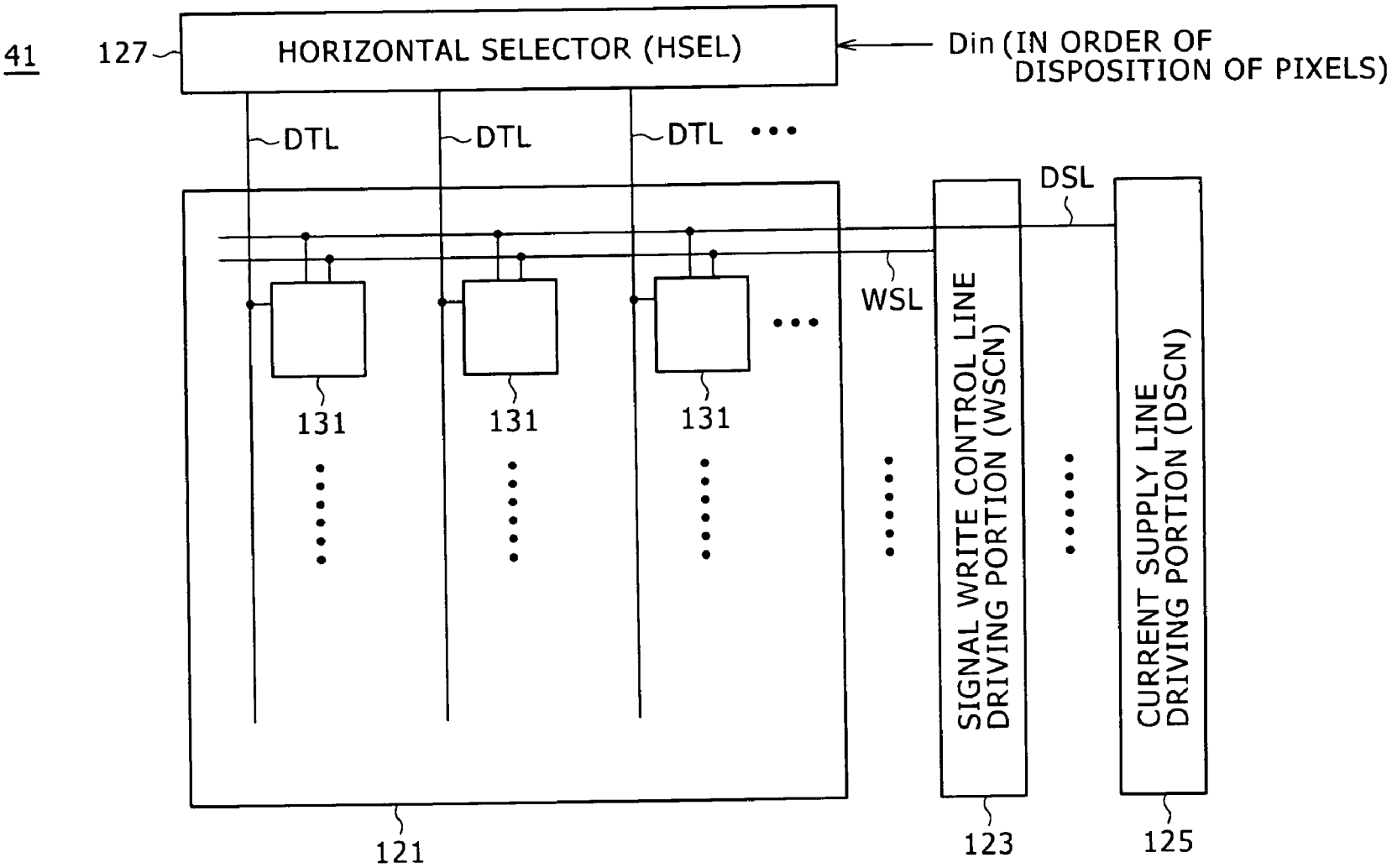
FIG. 33 is a block diagram showing a connection relationship between pixel circuits and each of drive circuits in the organic EL display panel shown in FIG. 32.
Figure 34:
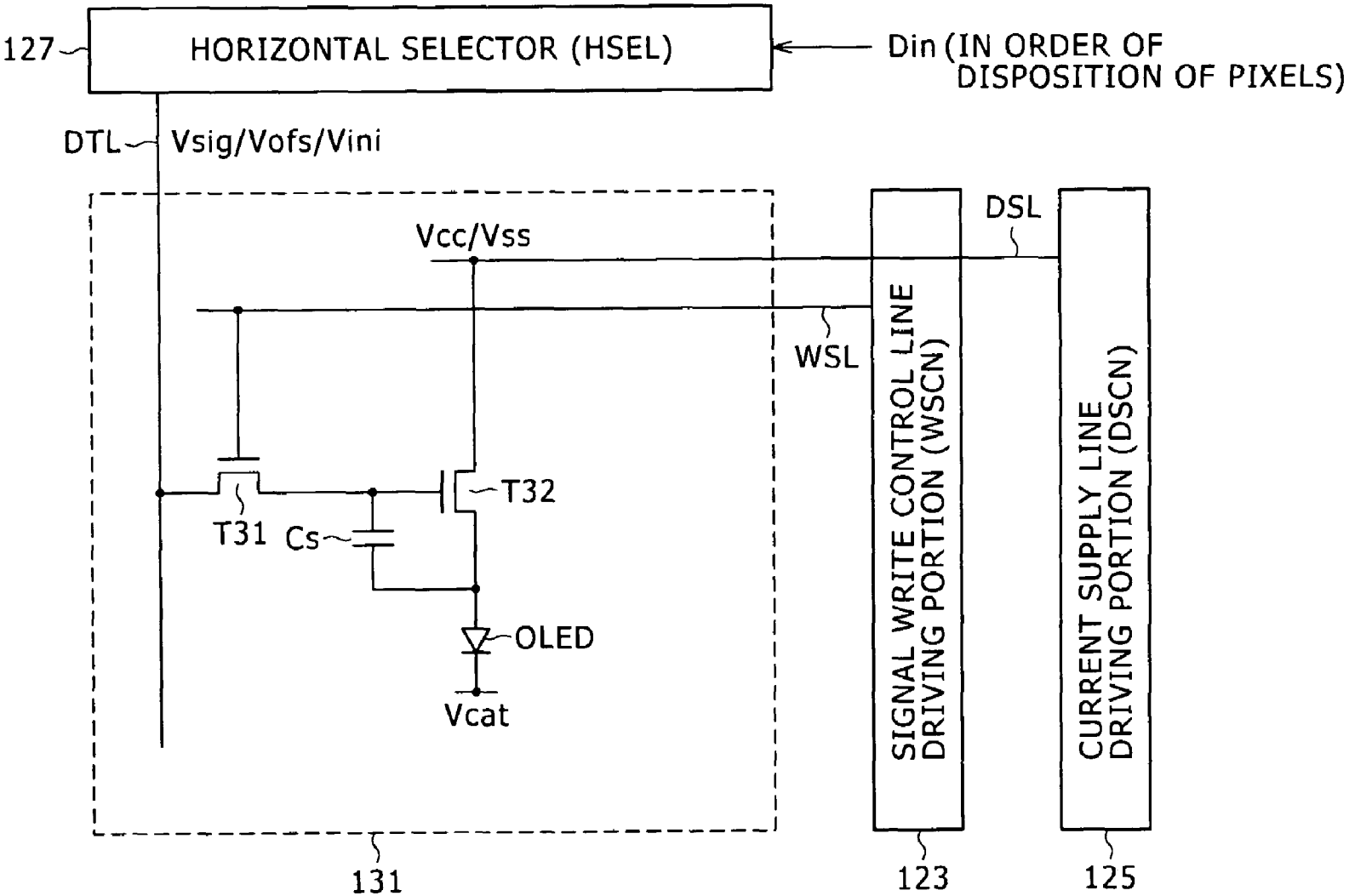
FIG. 34 is a circuit diagram, partly in block, showing a configuration of the pixel circuit in the second embodiment of the present invention.

FIG. 33 shows a connection relationship between pixel circuits 131 corresponding to the sub-pixels, respectively, and each of the drive circuits 123, 125 and 127. In addition, FIG. 34 shows an internal configuration of the pixel circuit 131 in the organic EL display panel 41 of the second embodiment. The pixel circuit 131 is composed of two N-channel thin film transistors T31 and T32, a hold capacitor Cs, and an organic EL element OLED.

Of these constituent elements, the thin film transistor T31 (hereinafter referred to as "the sampling transistor T31") operates as a switch for controlling an operation for writing the potential (the signal potential Vsig, the reverse bias potential Vini, or the offset signal potential Vofs in the second embodiment) of the corresponding one of the signal lines DTLs to a gate electrode of the thin film transistor T32.

The thin film transistor T32 (hereinafter referred to as "the drive transistor T32") operates as a constant current source for supplying an amount of drive current to the organic EL element OLED in the phase of the ON state thereof.

In the case of the second embodiment, the signal write control line driving portion 123, the current supply line driving portion 125, and the horizontal selector 127 are used to drive the pixel circuit 131.

The signal write control line driving portion 123 is the drive circuit by which the sampling transistor T31 is controlled so as to be turned ON/OFF. When the sampling transistor T31 is controlled so as to be turned ON, the potential of the corresponding one of the signal lines DTLs is applied to the gate electrode of the drive transistor T32.

The current supply line driving portion 125 is the drive circuit by which the corresponding one of the current supply lines DSLs is driven with two kinds of high potential Vcc and low potential Vss. In the case of the second embodiment, a low potential time period is set at least once within one frame time period.

Each of these drive circuits 123 and 125 is composed of a shift register having output stages the number of which corresponds to the vertical resolution. Thus, each of the drive circuits 123 and 125 outputs a necessary drive pulse to the corresponding one of the control lines in accordance with the timing signal supplied thereto from the timing generator 129.

The horizontal selector 127 is the drive circuit by which any one of the signal potential Vsig corresponding to the pixel data Din, the reverse bias potential Vini corresponding to the signal potential Vsig, and the offset signal potential Vofs is outputted to the corresponding one of the signal lines DTLs with one horizontal scanning time period as one period. Although the order of outputting the signal potential Vsig, the reverse bias potential Vini and the offset signal potential Vofs is arbitrarily set, in the second embodiment, the reverse bias potential Vini, the offset signal potential Vofs, and the signal potential Vsig are outputted in this order.

The timing generator 129 is the circuit device for generating the timing pulse necessary for driving the write control lines WSLs and the current supply lines DSLs.

(C-2) Configuration of Horizontal Selector

Figure 35:
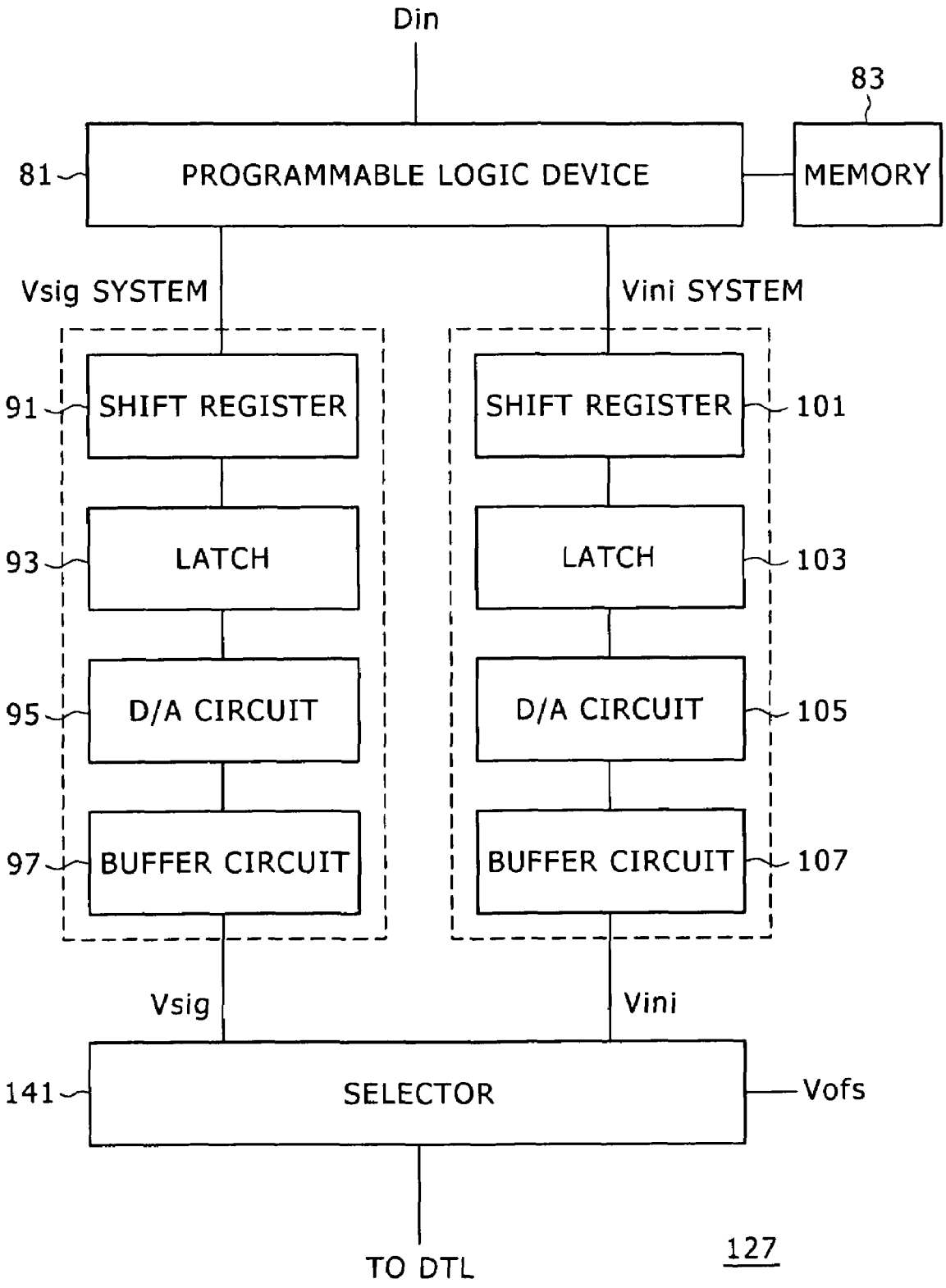
FIG. 35 is a block diagram showing a configuration of a horizontal selector in the organic EL display panel in the second embodiment of the present invention.

FIG. 35 shows a circuit configuration of the horizontal selector 127 as the key device in the organic EL display panel 41 of the second embodiment. The horizontal selector 127 is identical in basic configuration to the horizontal selector 61 previously described in the first embodiment. Therefore, in FIG. 35, portions corresponding to those shown in FIG. 21 are designated with the same reference numerals, respectively.

The horizontal selector 127 is composed of a programmable logic device 81, a memory 83, shift registers 91 and 101, latch circuits 93 and 103, D/A conversion circuits 95 and 105, buffer circuits 97 and 107, and a selector 141.

Of these constituent portions, the novel constituent portion in the horizontal selector 127 is only the selector 141. The selector 141 in the second embodiment is different from the selector 111 in the first embodiment in that the reverse bias potential Vini, the offset signal potential Vofs, and the signal potential Vsig are outputted at timings previously set in a time sequential manner for one horizontal scanning time period. It is noted that the offset signal potential Vofs is a fixed voltage supplied from an external voltage source.

(C-3) Driving Operation

FIGS. 36A to 36E are a timing chart showing a driving operation of the pixel circuit 131 shown in FIG. 34. In this connection, the high potential (emission potential) of the two kinds of power source potentials which are applied to the corresponding one of the current supply lines DSLs is designated with reference symbol Vcc, and the low potential (non-emission potential) thereof is designated with reference symbol Vss.

Figure 36:
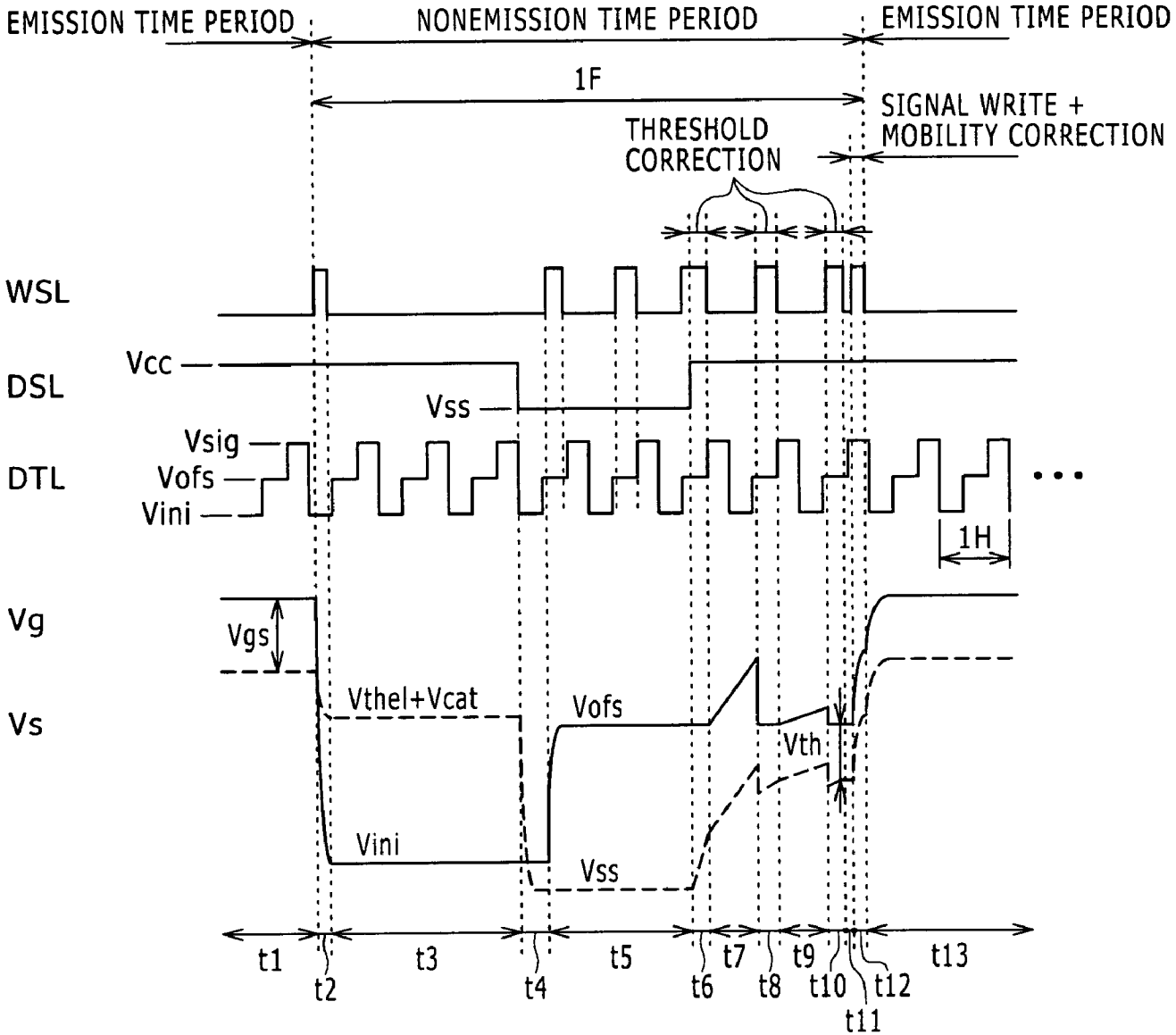
FIGS. 36A to 36E are a timing chart showing an operation for driving the pixel circuit shown in FIG. 34.

Note that, FIG. 36A shows a waveform of a drive pulse applied to the corresponding one of the write control lines WSLs. Here, FIGS. 36A to 36E show an example in which the threshold correction preparing operation or the threshold correcting operation is carried out separately for a plurality of horizontal scanning time periods. FIG. 36B shows a waveform of a drive pulse applied to the corresponding one of the current supply lines DSLs. FIG. 36C shows a waveform of a potential applied to the corresponding one of the signal lines DTLs. FIG. 36D shows a waveform of a gate potential Vg of the drive transistor T32. Also, FIG. 36E shows a waveform of a source potential Vs of the drive transistor T32.

Figure 37:
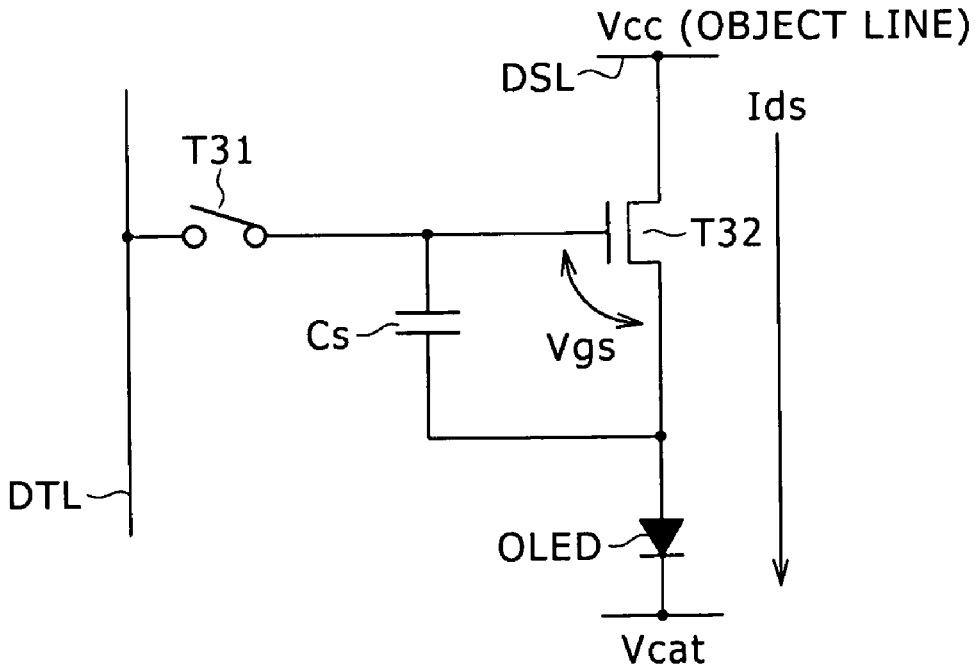
FIGS. 37 to 47 are circuit diagrams explaining operation states in the pixel circuit shown in FIG. 34.

Firstly, FIG. 37 shows an operation state within the pixel circuit 131 in an emission state. At this time, the current supply line DSL is held at the high potential Vcc, and the sampling transistor T31 is controlled so as to be held in an OFF state (t1 in FIGS. 36A to 36E).

Of course, the drive transistor T32 in the phase of the emission operates in the saturated region. Therefore, the current Ids determined depending on the gate-to-source voltage Vgs is supplied from the drive transistor T32 to the organic EL element OLED.

Next, an operation state within the pixel circuit 131 in a non-emission state will be described. The sampling transistor T31 is newly controlled so as to be turned ON while the current supply line DSL is held at the high potential Vcc, thereby starting the non-emission time period (t2 in FIGS. 36A to 36E). At this time, the reverse bias potential Vini is applied to the signal line DTL.

Figure 38:
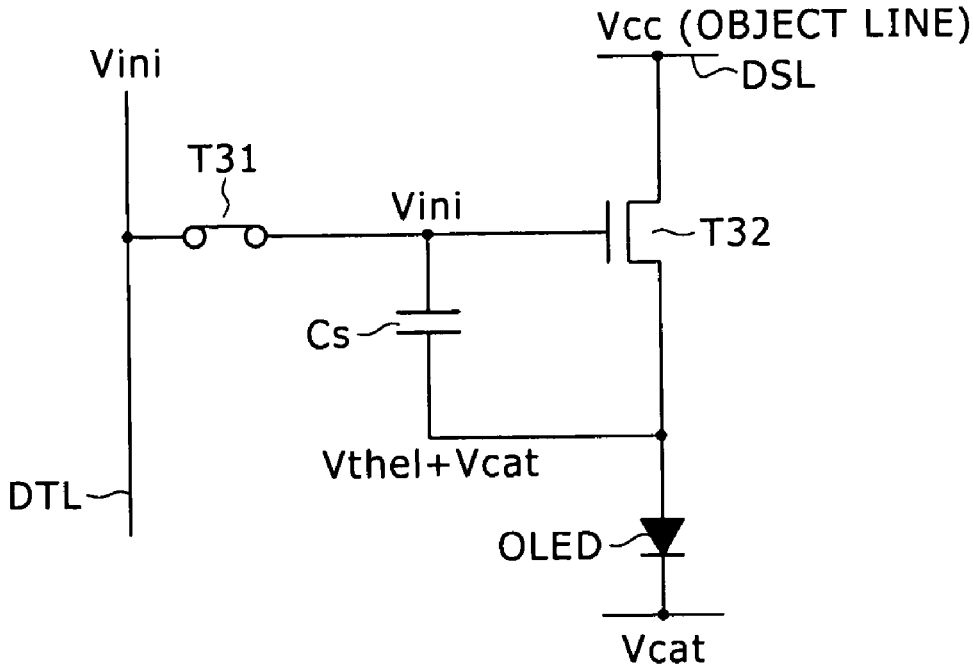

By carrying out this operation, the gate potential Vg of the drive transistor T32 is controlled so as to become equal to the reverse bias potential Vini. FIG. 38 shows an operation state within the pixel circuit 131 at this time point.

At this time, the source potential Vs of the drive transistor T32 drops through the coupling operation of the hold capacitor Cs. During this change in source potential Vs of the drive transistor T32, the gate-to-source voltage Vgs of the drive transistor T32 becomes equal to or smaller than the threshold voltage Vth, which results in that the state of the organic EL element OLED is switched from the emission state over to the non-emission state.

In the case as well of the pixel circuit 131, when the source potential Vs of the drive transistor T32 (the anode potential Vel of the organic EL element OLED) after completion of the coupling operation is equal to or smaller than the sum of the threshold voltage Vthel and the cathode potential Vcat of the organic EL element OLED, the source potential Vs of the drive transistor T32 is held as it is.

On the other hand, when the source potential Vs of the drive transistor T32 after completion of the coupling operation is equal to or larger than the sum of the threshold voltage Vthel and the cathode potential Vcat of the organic EL element OLED, the source potential Vs of the drive transistor T32 converges to the potential of (Vthel+Vcat) owing to the discharge of the electric charges accumulated in the organic EL element OLED. FIG. 38 shows a state in which the source potential Vs of the drive transistor T32 converges to the potential of (Vthel+Vcat).

That is to say, the drive transistor T32 is controlled so as to be set in the state of application of the reverse bias voltage. Of course, the reverse voltage stated here is controlled in such a way that the magnitude of the signal potential Vsig which will be subsequently written to the gate electrode of the drive transistor T32 is reflected in the reverse voltage. For example, when the signal potential Vsig which will be subsequently written to the gate electrode of the drive transistor T32 is the black display potential, the reverse voltage is controlled so as to have a small value accordingly, whereas when the signal potential Vsig which will be subsequently written to the gate electrode of the drive transistor T32 is the white display potential, the reverse voltage is controlled so as to have a value larger than the reverse bias voltage accordingly.

As a result, in the case as well of the pixel circuit 131 in the second embodiment, an amount of change in threshold voltage Vth, in the positive direction, caused for the emission time period can be corrected with the reverse bias voltage which is applied to the gate of the drive transistor T32 for the non-emission time period within the same one frame.

Of course, in this case as well, the magnitude of the reverse bias voltage is preferably, optimally set in consideration of the duty or the like of the emission time occupied in one frame time period.

Figure 39:
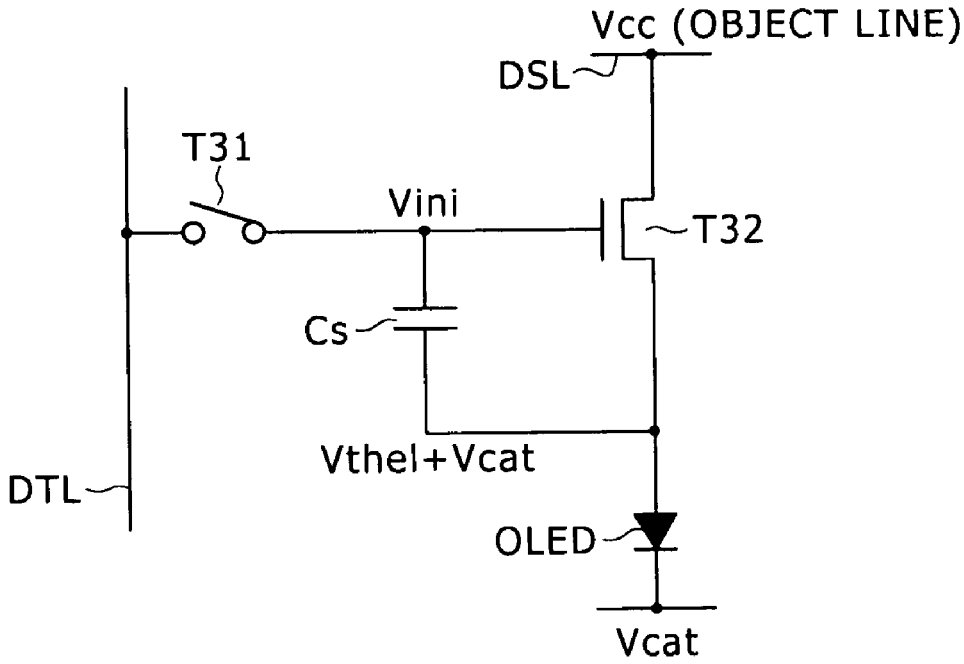

It is noted that after the reverse bias potential Vini is written to the gate electrode of the drive transistor T32, as shown in FIG. 39, the sampling transistor T31 is controlled so as to be turned OFF before another potential of the signal line DTL is written to the gate electrode of the drive transistor T32 (t3 in FIGS. 36A to 36E). As a result, the reverse bias state of the drive transistor T32 is maintained.

Figure 40:
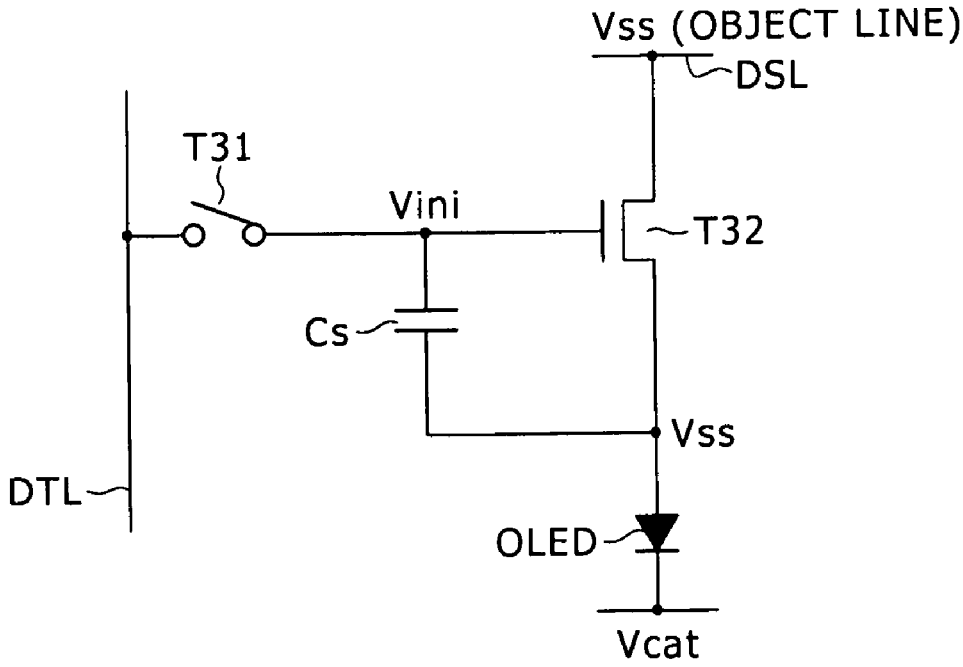

After a lapse of a given time period of this reverse bias state, the power source potential of the current supply line DSL is controlled so as to be switched from the high potential Vcc over to the low potential Vss. FIG. 40 shows an operation state within the pixel circuit 131 at this time point.

The low potential Vss stated here is set at a potential fulfilling a relationship of (Vofs−Vss)>Vth for the purpose of normally carrying out the threshold correcting operation which will be carried out later. By application of the low potential Vss, the potential of the current supply line DSL becomes equal to the source potential Vs of the drive transistor T32. As a result, the anode potential of the organic EL element OLED drops.

Figure 41:
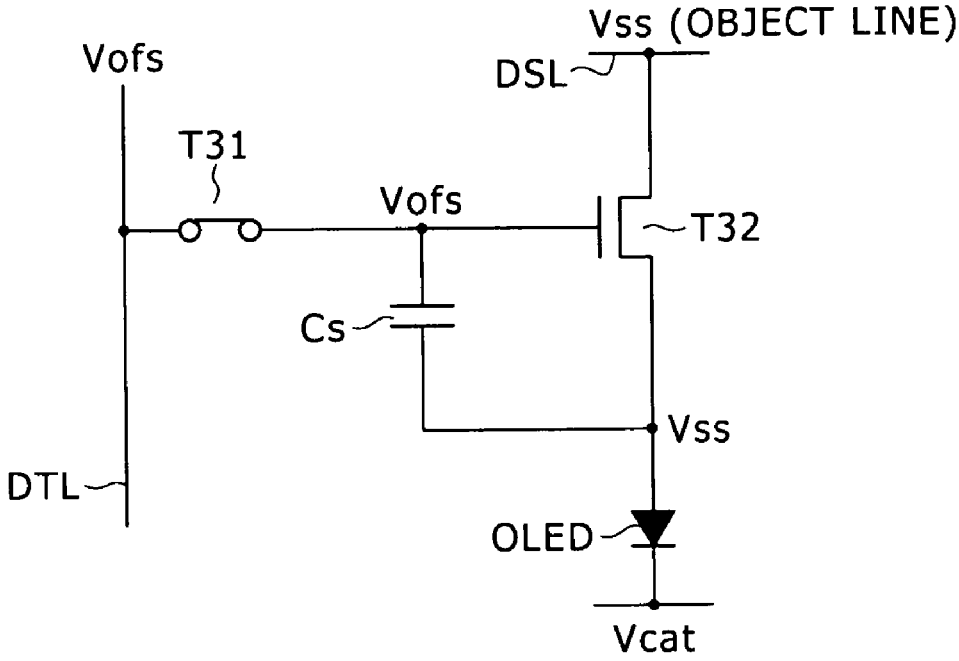

Next, the sampling transistor T31 is controlled so as to be turned ON at a timing at which the potential of the signal line DTL is set at the offset signal potential Vofs (t5 in FIGS. 36A to 36E). It is noted that the current supply line DSL is held at the low potential Vss. FIG. 41 shows an operation state within the pixel circuit 131 at this time point.

Figure 42:
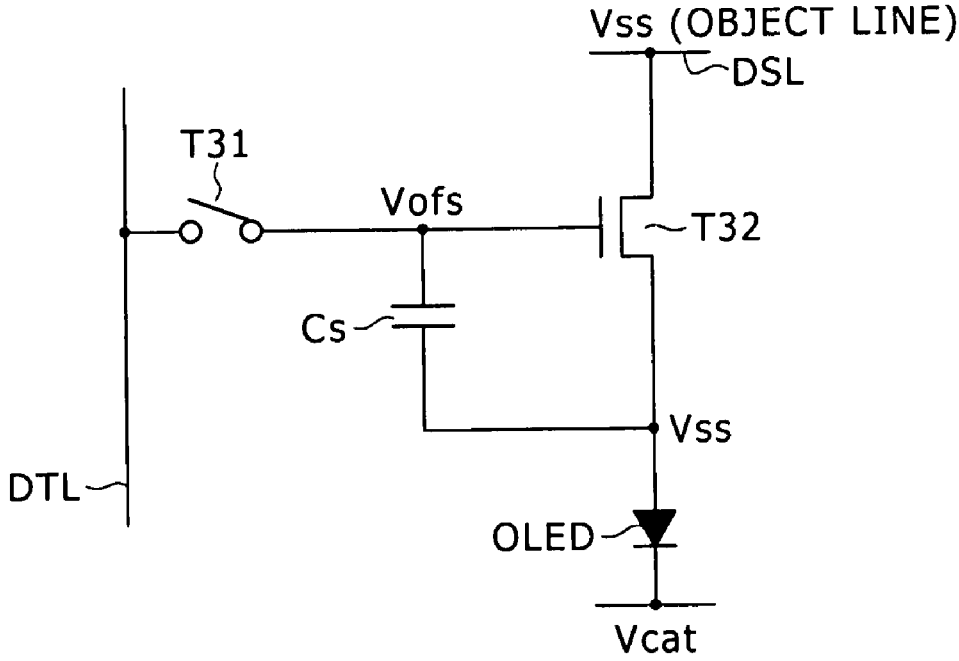

At this time, the gate potential Vg of the drive transistor T32 is controlled so as to be set at the offset signal potential Vofs. This operation is a threshold correction preparing operation. It is noted that for the purpose of avoiding the change in gate potential Vg, for every time period for which the potential of the signal line DTL is set at either the signal potential Vsig or the reverse bias potential Vini other than the offset signal potential Vofs, as shown in FIG. 42, the sampling transistor T31 is controlled so as to be turned OFF.

Figure 43:
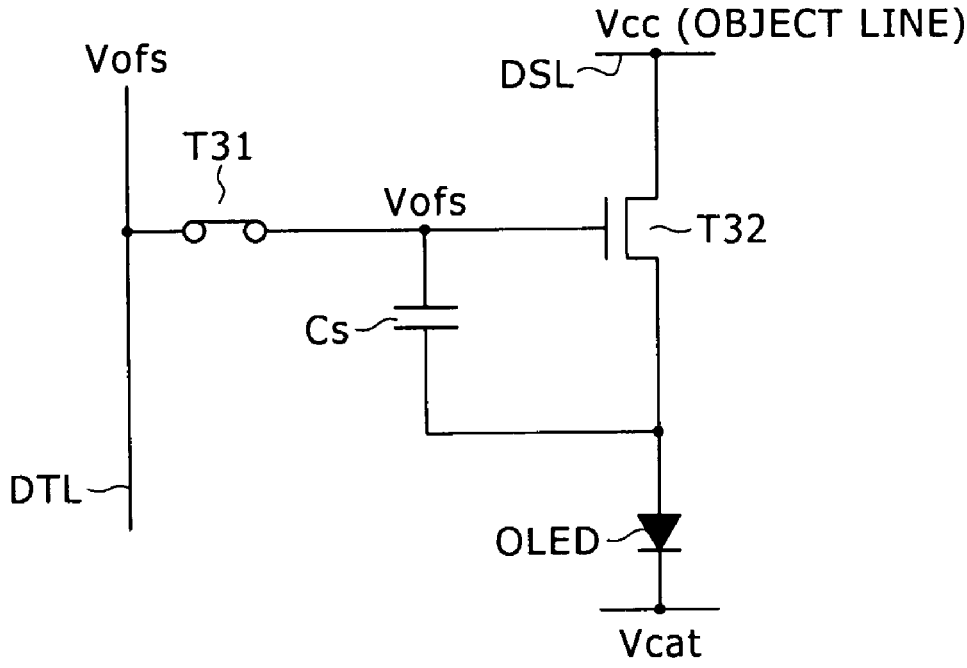

Before long, a timing at which the threshold correcting operation is carried out will come. For a time period for which the offset signal potential Vofs is applied to the signal line DTL, the sampling transistor T31 is controlled so as to be turned ON and the current supply line DSL is controlled so as to be set at the high potential Vcc, thereby carrying out the threshold correcting operation (t6 in FIGS. 36A to 36E). FIG. 43 shows an operation state within the pixel circuit 131 at this time point.

The high potential Vcc is applied to the current supply line DSL while the drive transistor T32 is held in the ON state, thereby starting the threshold correcting operation for the drive transistor T32. Along with this operation, only the source potential Vs starts to rise while the gate potential Vg of the drive transistor T32 is controlled so as to be set at the offset signal potential Vofs.

Figure 44:
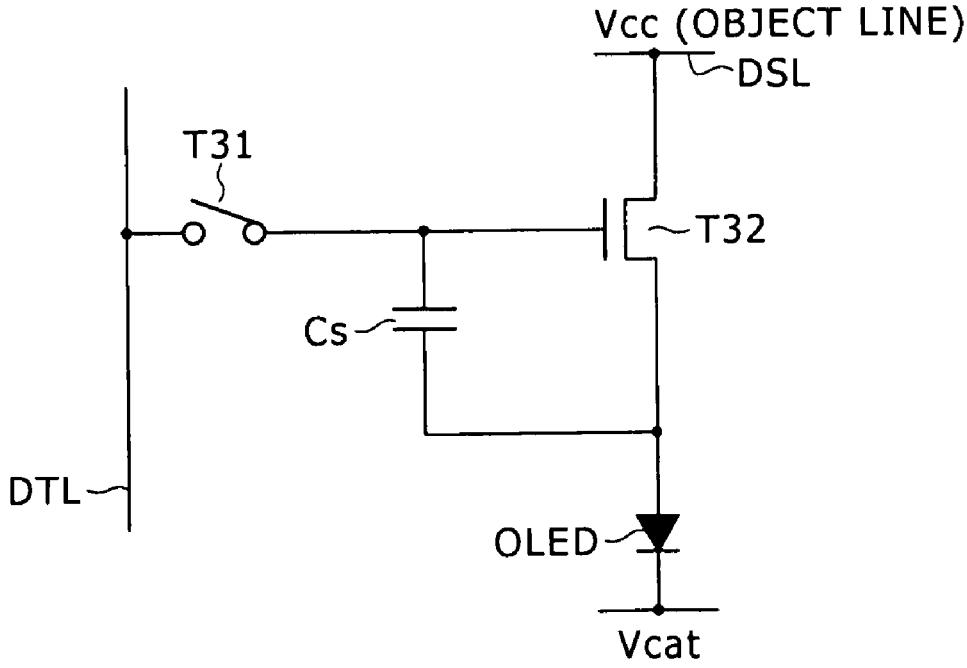

It is noted that in the case of the second embodiment, the three different potentials, that is, the reverse bias potential Vini, the offset signal potential Vofs and the signal potential Vsig repetitively appear in the signal line DTL for one horizontal scanning time period. Therefore, when the time period for supply of the offset signal potential Vofs ends, the sampling transistor T31 is continuously controlled so as to be turned OFF again until a timing at which the offset signal potential Vofs will be supplied next time (t7 in FIGS. 36A to 36E). FIG. 44 shows an operation state within the pixel circuit 131 at this time point.

It is noted that for this time period, the gate electrode of the drive transistor T32 is used as the free end. Therefore, the gate potential Vg also rises in conjunction with the rise of the source potential Vs by carrying out the bootstrap operation following the rise of the source potential Vs.

Before long, when a timing comes at which the offset signal potential Vofs is supplied to the signal line DTL, the sampling transistor T31 is controlled so as to be turned ON again. By carrying out this turn-ON operation, the gate potential Vg of the drive transistor T32 is caused to drop to the offset signal potential Vofs. In this case, the source potential Vs of the drive transistor T32 is caused to drop by a potential corresponding to an amount of coupling of the hold capacitor Cs, and restarts to rise from a state after being caused to drop (t8 in FIGS. 36A to 36E).

When in the threshold correcting operation after the restarting, the gate-to-source voltage Vgs of the drive transistor T32 becomes equal to the threshold voltage Vth, the drive transistor T32, of course, automatically carries out a cut-off operation. However, in the case of the driving operation shown in FIGS. 36A to 36E, even after end of the second round of the threshold correcting operation, the threshold correcting operation is not completed. Thus, after end of the time period for supply of the offset signal potential Vofs, the sampling transistor T31 is continuously controlled so as to be turned OFF again until a timing at which the offset signal potential Vofs will be supplied to the gate electrode of the drive transistor T32 next time (t9 in FIGS. 36A to 36E).

Figure 45:
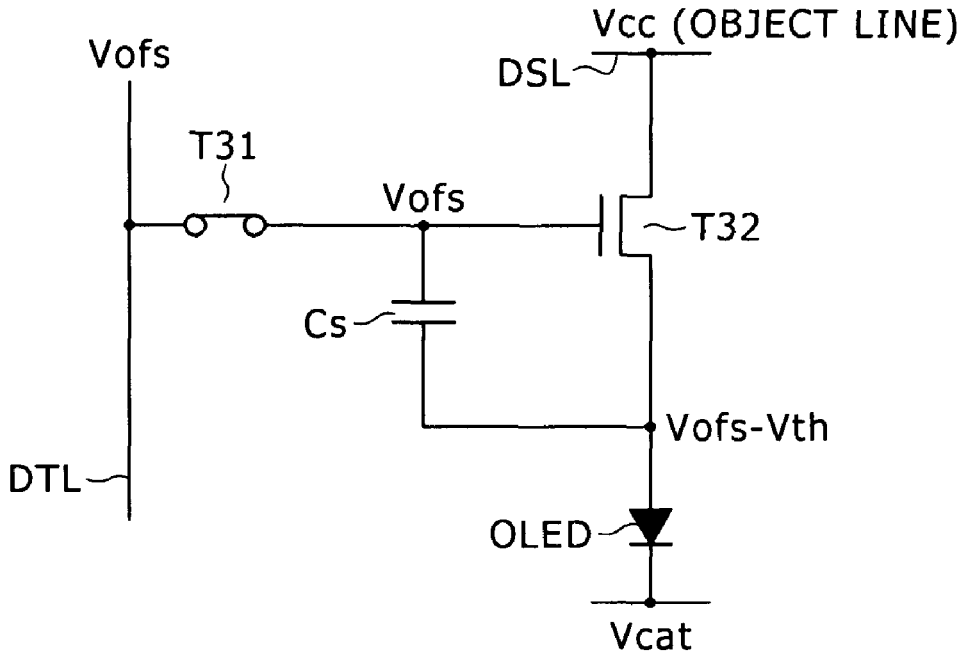

Also, the threshold correcting operation is completed for the time period for the third round of the threshold correcting operation, and the drive transistor T32 automatically carries out the cut-off operation (t10 in FIGS. 36A to 36E). FIG. 45 shows an operation state within the pixel circuit 131 at this time point. It is noted that the source potential Vs of the drive transistor T32 fulfills the relationship of ($Vs=Vofs-Vth \leqq Vcat+Vthel$). Therefore, the organic EL element OLED cannot be controlled so as to be turned ON operation, and thus emits no light at this time.

Figure 46:
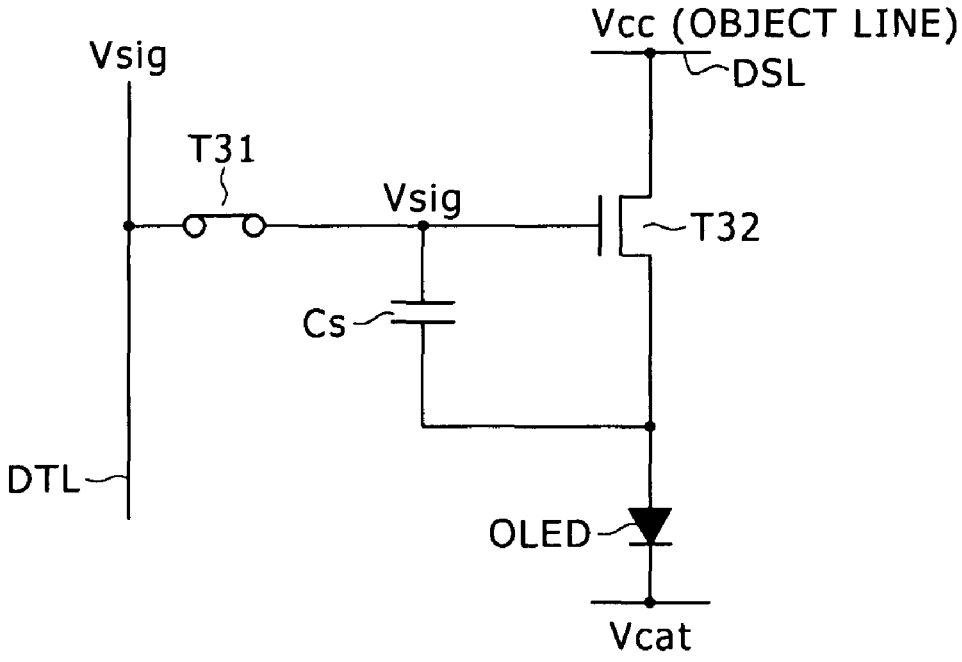

Either immediately after this or after a time period t11 shown in FIGS. 36A to 36E is strode over, the signal potential Vsig is applied to the gate electrode of the drive transistor T32 (t12 in FIGS. 36A to 36E). FIG. 46 shows an operation state within the pixel circuit 131 at this time point.

As previously stated, the signal potential Vsig is the voltage corresponding to the gradation of the corresponding one of the pixels. At this time, the gate potential Vg of the drive transistor T32 is controlled so as to become equal to the signal potential Vsig through the sampling transistor T31. In addition, the source potential Vs of the drive transistor T32 rises with time owing to the current caused to flow from the current supply line DSL into the drive transistor T32.

At this time, the gate-to-source voltage Vgs of the drive transistor T25 is given by Expression (6):

$$Vgs=\{Cel/(Cel+Cs+Ctr)\}\cdot(Vsig-Vofs)+Vth \quad (6)$$

As previously stated in the first embodiment as well, the parasitic capacitance Cel of the organic EL element OLED is larger than each of the capacitance of the hold capacitor Cs, and the parasitic capacitance Ctr of the drive transistor T32. Therefore, the gate-to-source voltage Vgs of the drive transistor T32 converges approximately to the voltage of (Vsig+Vth).

This operation is a mobility correcting operation used as an operation as well for writing the signal potential Vsig. As previously described in the first embodiment, the gate-to-source voltage Vgs stated here has a value in which the mobility μ of the drive transistor T32 is reflected.

Figure 47:
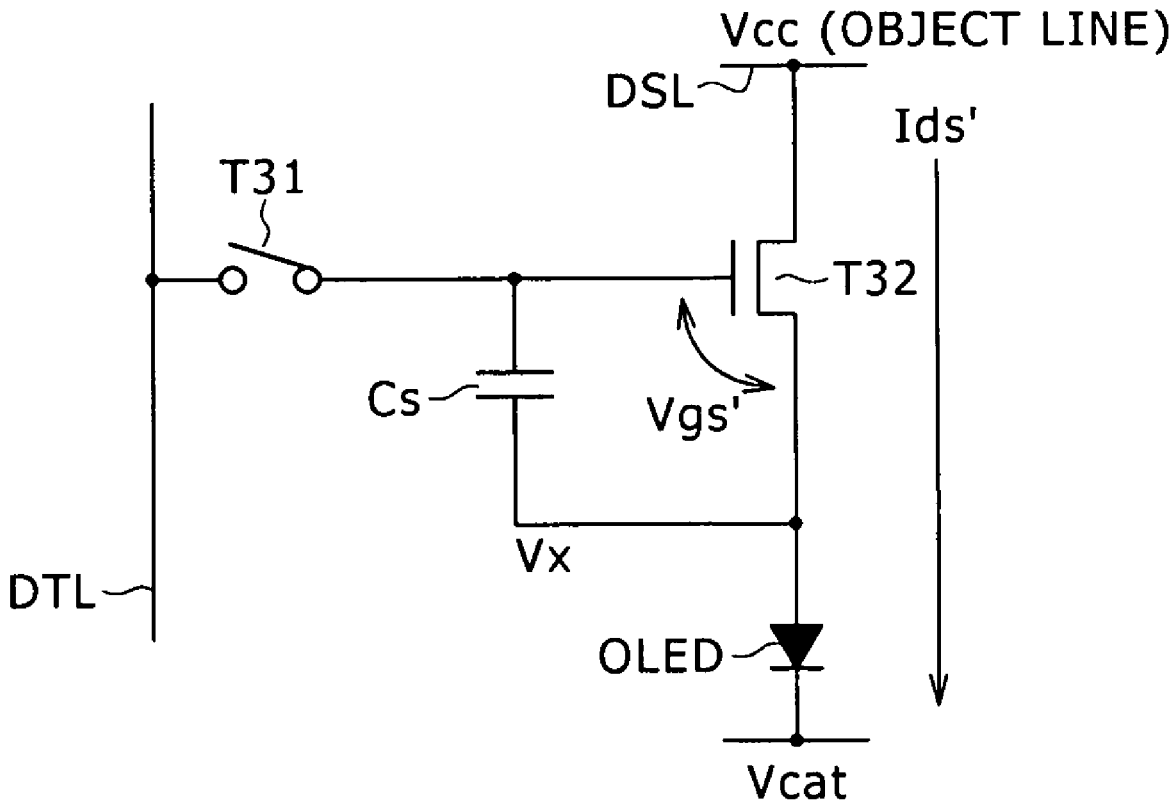

After completion of the mobility correcting operation used as the writing operation as well, the sampling transistor T31 is controlled so as to be turned OFF, thereby starting a new emission time period (t13 in FIGS. 36A to 36E). In this case, a drive current Ids' for the drive transistor T32 is caused to flow into the organic EL element OLED, thereby starting the light emission corresponding to the value of the drive current Ids' in the organic EL element OLED. FIG. 47 shows an operation state within the pixel circuit 131 at this time point.

(C-4) Conclusion

As described above, even in the case where each of the pixel circuits is composed of the two N-channel thin film transistors, similarly to the case of the first embodiment, it is possible to realize the drive technique with which the temporal change in threshold voltage Vth of the drive transistor T32 hardly appears in the drive transistor T32.

Of course, in the case as well of the pixel circuit stated here, both the threshold correcting operation and the mobility correcting operation can be carried out. Therefore, it is possible to effectively suppress occurrence of the picture non-uniformity due to the dispersion of the characteristics of the drive transistors T32.

(D) Third Embodiment (D-1) System Configuration

In a third embodiment, a description will now be given with respect to a method with which the precision for the mobility correcting operation can be further enhanced for the organic EL display panel 41 having the pixel circuit 131 descried in the second embodiment.

Figure 48:
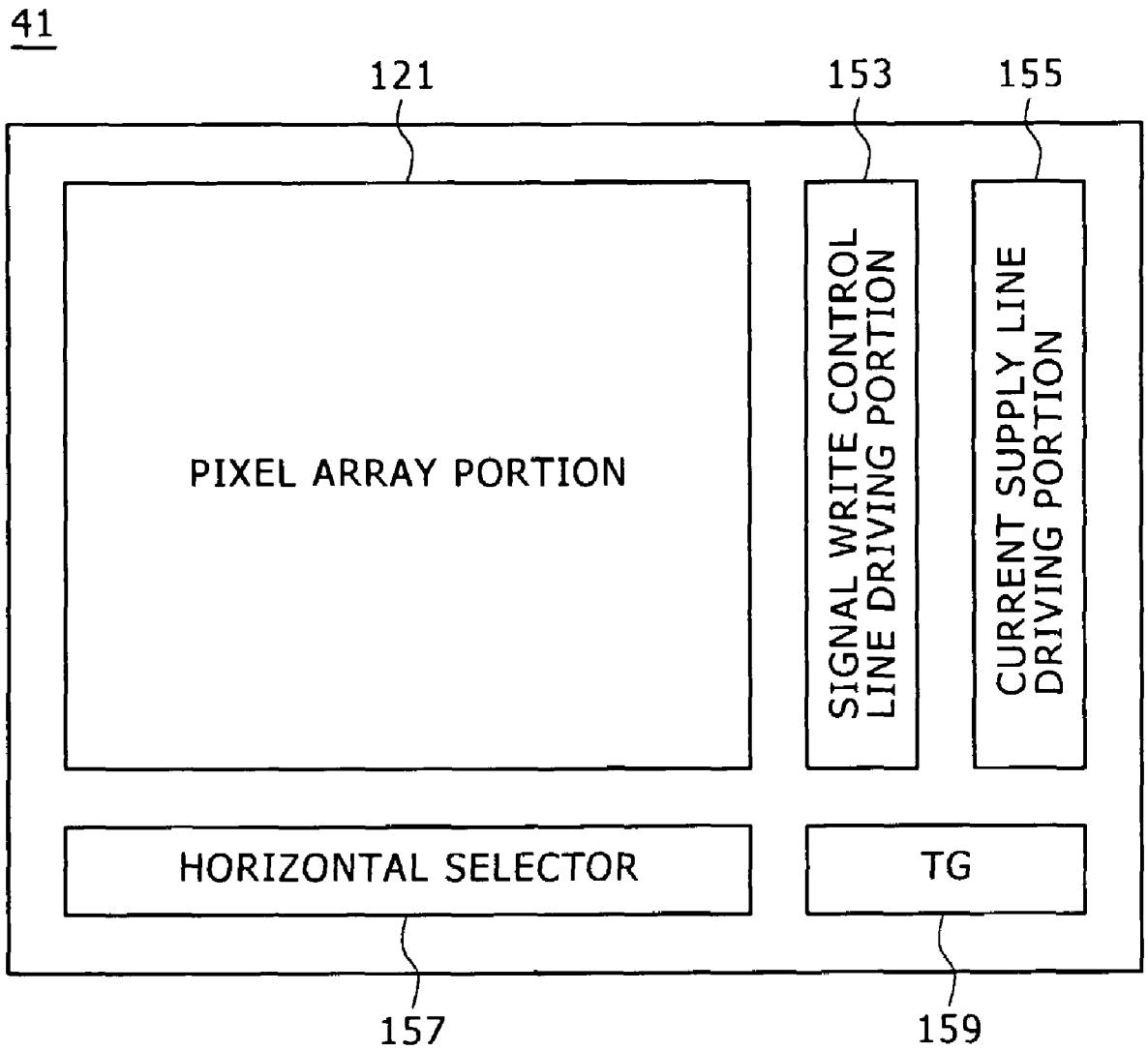
FIG. 48 is a block diagram showing a configuration of an organic EL display panel according to a third embodiment of the present invention.

FIG. 48 shows a system configuration of the organic EL display panel 41. It is noted that in FIG. 48, portions corresponding to those in FIG. 32 are designated with the same reference numerals, respectively.

The organic EL display panel 41 shown in FIG. 48 is composed of the pixel array portion 121, a signal write control line driving portion 153, a current supply line driving portion 155, and a horizontal selector 157 which operate as drive circuits for the pixel array portion 121, and a timing generator 159.

The pixel array portion 121 in the organic EL display panel 41 of the third embodiment has the same configuration as that of the pixel array portion 121 in the organic EL display panel 41 of the second embodiment shown in FIG. 32. That is to say, the pixel circuit 131 is composed of the sampling transistor T31, the drive transistor T32, the hold capacitor Cs, and the organic EL element OLED.

Figure 49:
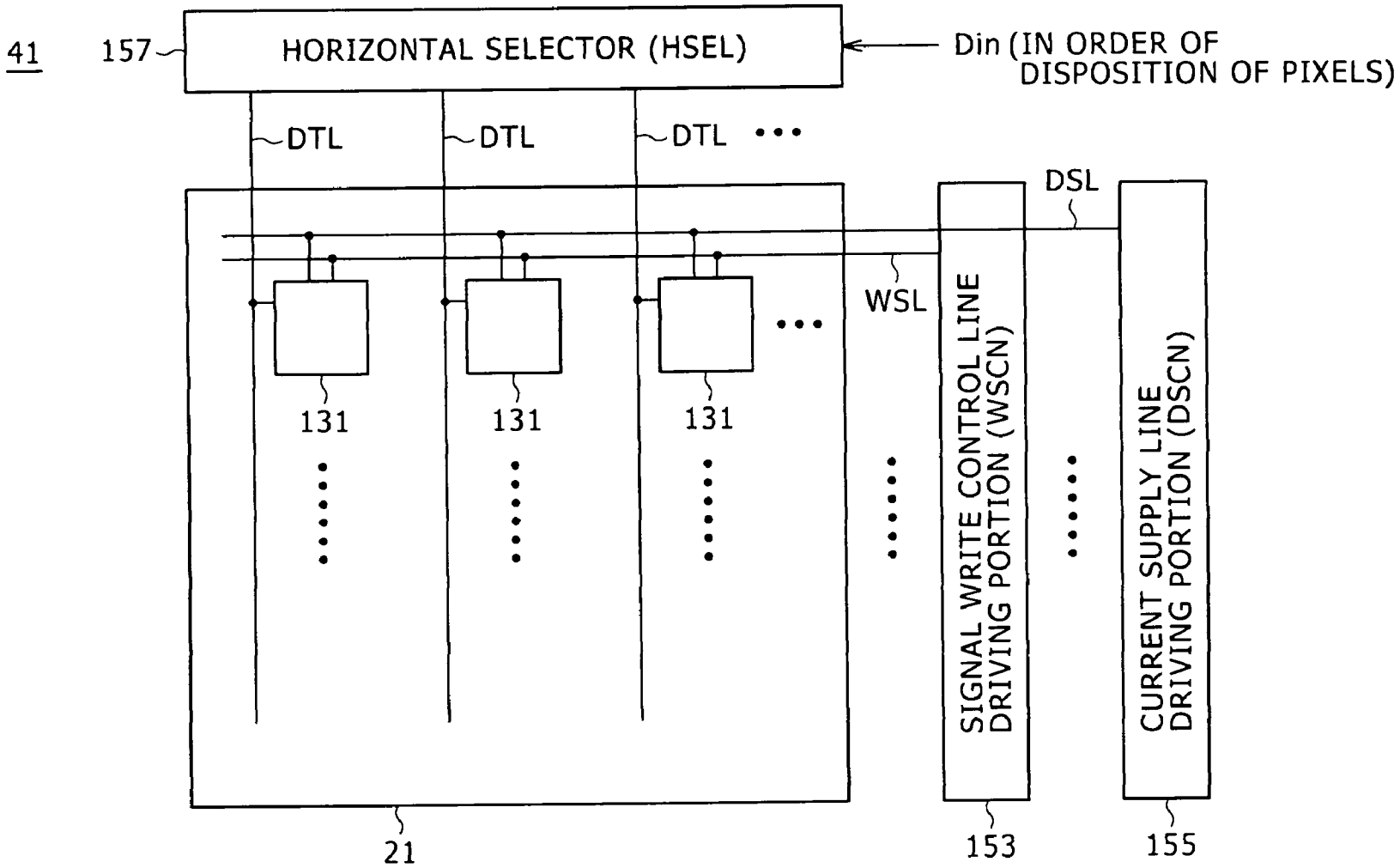
FIG. 49 is a block diagram showing a connection relationship between pixel circuits and each of drive circuits in the organic EL display panel shown in FIG. 48.
Figure 50:
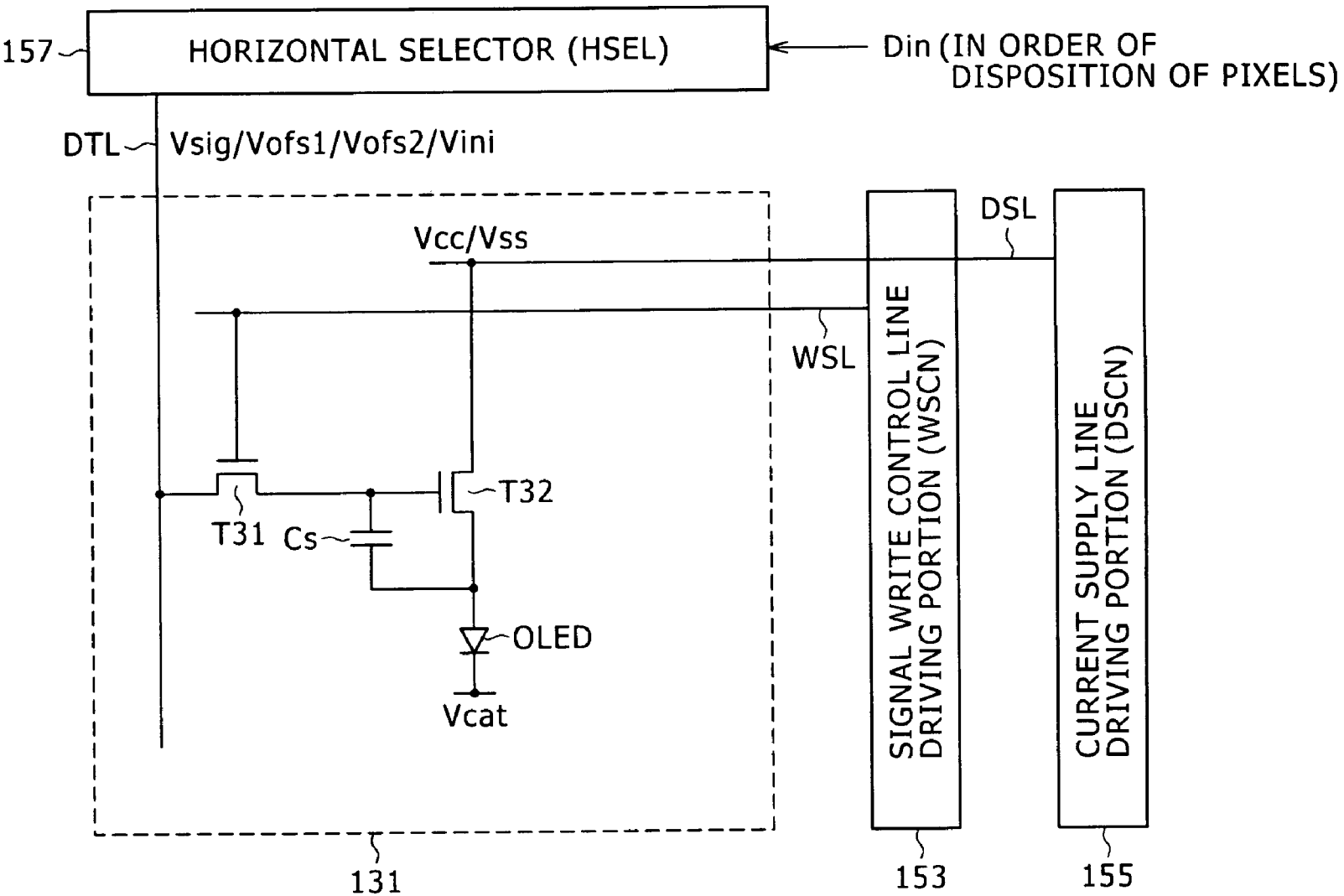
FIG. 50 is a circuit diagram, partly in block, showing a configuration of the pixel circuit in the third embodiment of the present invention.

FIG. 49 shows a connection relationship between the pixel circuits 131 each corresponding to the sub-pixel, and the drive circuits 153, 155 and 157. In addition, FIG. 50 shows a relationship among potentials, of the corresponding one of the signal lines DTLs, which are supplied to the pixel circuit 131 in the organic EL display panel 41 of the third embodiment.

The signal write control line driving portion 153 is the drive circuit by which the sampling transistor T31 is controlled so as to be turned ON/OFF. When the sampling transistor T31 is controlled so as to be turned ON, the potential of the corresponding one of the signal lines DTLs is applied to the gate electrode of the drive transistor T32.

The current supply line driving portion 155 is the drive circuit by which the corresponding one of the current supply lines DSLs is driven with two kinds of high potential Vcc and low potential Vss. In the case of the third embodiment, a low potential time period is set at least once within one frame time period.

Each of these drive circuits 153 and 155 is composed of a shift register having output stages the number of which corresponds to the vertical resolution. Thus, each of the drive circuits 153 and 155 outputs a necessary drive pulse to the corresponding one of the control lines in accordance with the timing signal supplied thereto from the timing generator 159.

The horizontal selector 157 is the drive circuit by which any one of the signal potential Vsig corresponding to the pixel data Din, the reverse bias potential Vini in which the signal potential Vsig is reflected, a first offset signal potential Vofs1, and a second offset signal potential Vofs2 is outputted to the corresponding one of the signal lines DTLs with one horizontal scanning time period as one period.

It is noted that the first offset signal potential Vofs1 corresponds to the offset signal potential Vofs in the second embodiment. In the case of the third embodiment, the second offset signal potential Vofs2 is given in the form of an intermediate potential between the signal potential Vsig and the first offset signal potential Vofs1. The horizontal selector 157 generates the second offset signal potential Vofs2 in accordance with the pixel data Din corresponding to the signal potential Vsig.

Although the order of outputting the signal potential Vsig, the reverse bias potential Vini, the first offset signal potential Vofs1, and the second offset signal potential Vofs2 is arbitrarily set in the third embodiment, the reverse bias potential Vini, the first offset signal potential Vofs1, the second offset signal potential Vofs2, and the signal potential Vsig are outputted from the horizontal selector 156 in this order.

The timing generator 159 is the circuit device for generating the timing pulse necessary for driving the write control lines WSLs and the current supply lines DSLs.

(D-2) Configuration of Horizontal Selector

Figure 51:
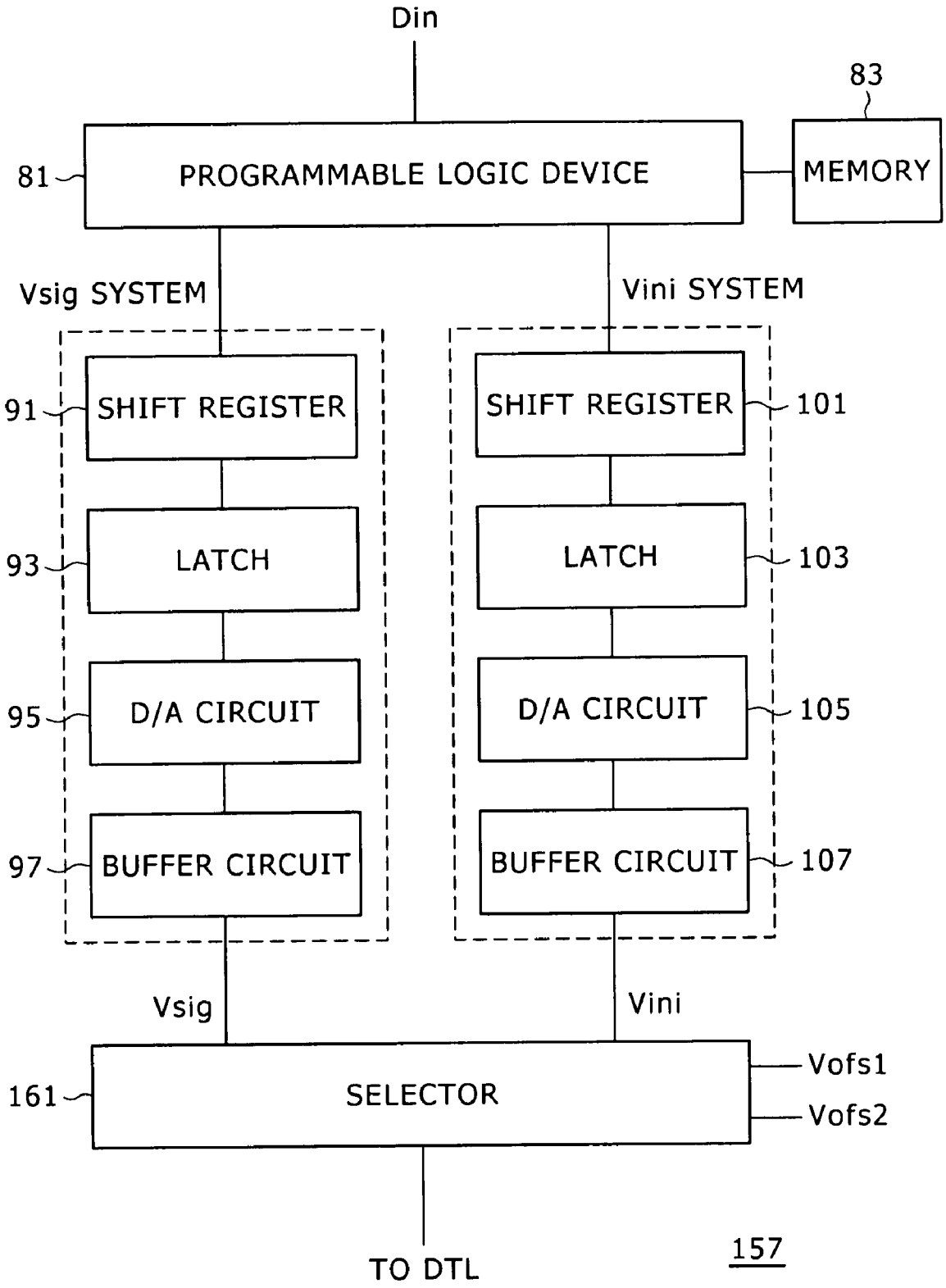
FIG. 51 is a block diagram showing a configuration of a horizontal selector in the organic EL display panel in the third embodiment of the present invention.
Figures 52A, 52B, 52C, 52D, 52E:
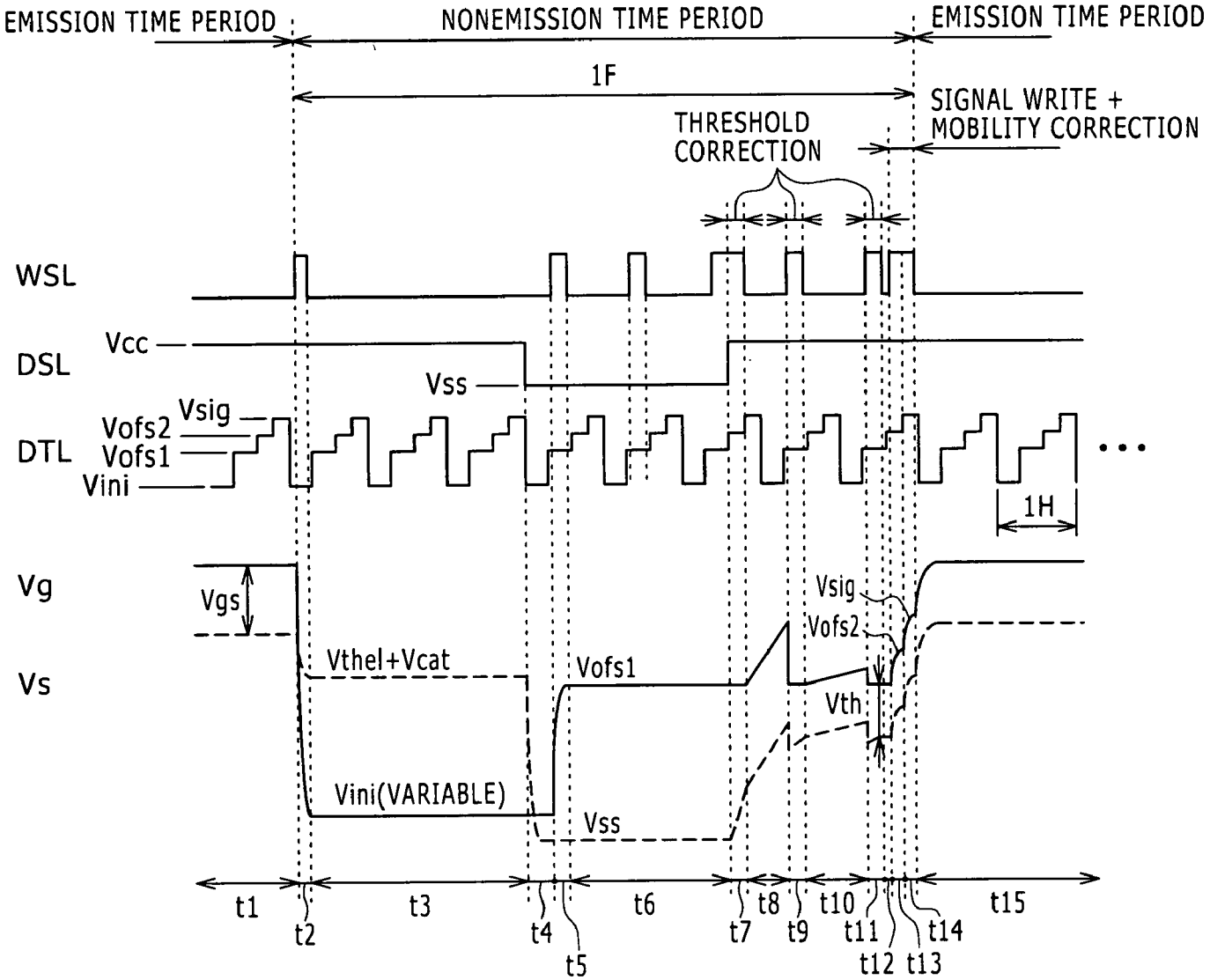
FIGS. 52A to 52E are a timing chart showing an operation for driving the pixel circuit shown in FIG. 50.

FIG. 51 shows a circuit configuration of the horizontal selector 157 as the key device in the organic EL display panel 41 of the third embodiment. It is noted that the horizontal selector 157 is identical in basic configuration to the horizontal selector 127 previously described in the second embodiment. Therefore, in FIG. 51, portions corresponding to those shown in FIG. 35 are designated with the same reference numerals, respectively.

The horizontal selector 157 is composed of a programmable logic device 81, a memory 83, shift registers 91 and 101, latch circuits 93 and 103, D/A conversion circuits 95 and 105, buffer circuits 97 and 107, and a selector 161.

Of these constituent portions, the novel constituent portion in the horizontal selector 157 is only the selector 161. The selector 161 in the third embodiment is different from the selector 141 in the second embodiment in that the reverse bias potential Vini, the first offset signal potential Vofs1, the second offset signal potential Vofs2, and the signal potential Vsig are outputted at timings previously set in a time sequential manner for one horizontal scanning time period.

It is noted that the first offset signal potential Vofs1 corresponds to the offset potential Vofs in the second embodiment. On the other hand, the second offset signal potential Vofs2 is given in the form of the intermediate gradation potential between the maximum potential of the signal potential Vsig, and the first offset signal potential Vofs1. In the third embodiment, the second offset signal potential Vofs2 is regulated in the form of (Vsig−Vofs1)/2.

(D-3) Driving Operation

FIGS. 52A to 52E are a timing chart showing a driving operation of the pixel circuit 131 in the organic EL display panel 41 of the third embodiment.

Figure 53:
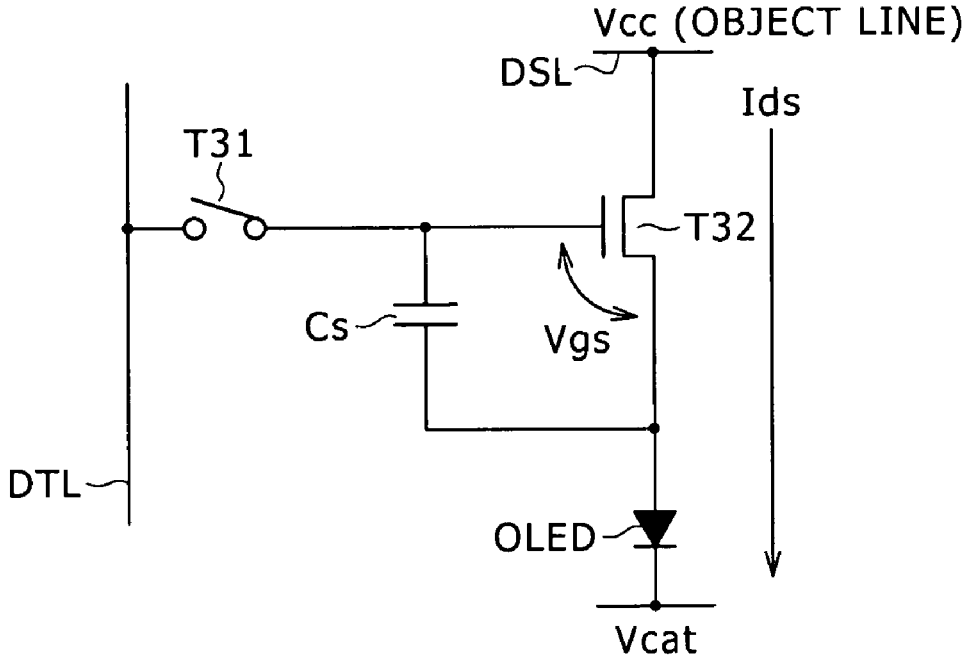
FIGS. 53 to 58 are circuit diagrams explaining operation states in the pixel circuit shown in FIG. 50.

Firstly, FIG. 53 shows an operation state within the pixel circuit 131 in the emission state. At this time, the potential of the current supply line DSL is set at the high potential Vcc, and thus the sampling transistor T31 is held in the OFF state (t1 in FIGS. 52A to 52E).

At this time, the drive transistor T32 is set so as to operate in the saturated region. For this reason, the current Ids caused to flow through the organic EL element OLED gets a value corresponding to the gate-to-source voltage Vgs of the drive transistor T32.

Figure 54:
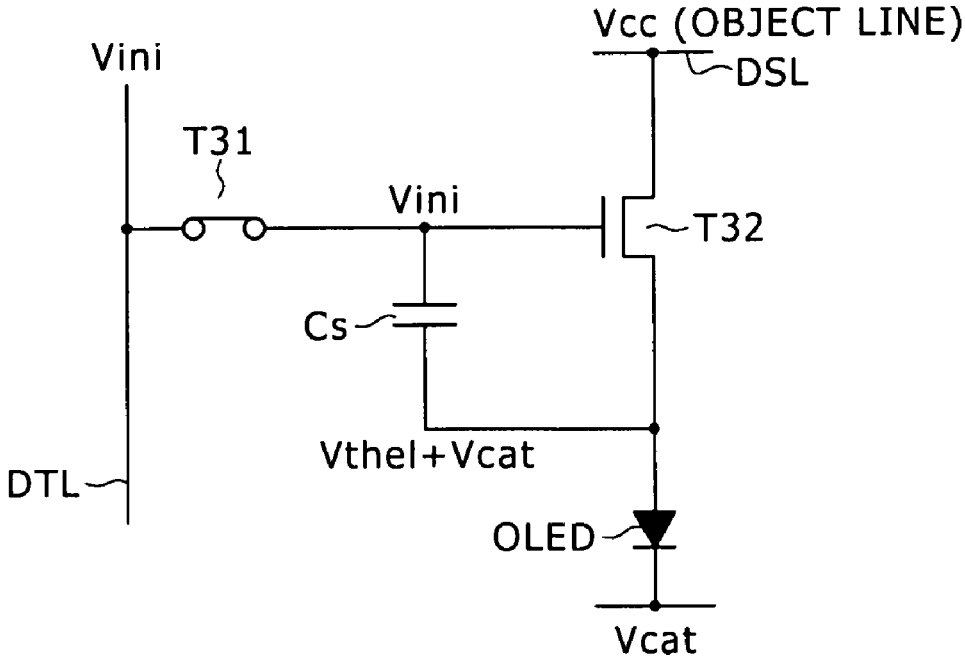

Next, an operation state in the non-emission time period will be described. The sampling transistor T31 is controlled so as to be turned ON while the reverse bias potential Vini is applied to the signal line DTL, thereby starting the non-emission time period (t2 in FIGS. 52A to 52E). FIG. 54 shows an operation state within the pixel circuit 131 at this time point.

At this time, the source potential Vs of the drive transistor T32 drops through the coupling operation of the hold capacitor Cs. It is noted that the organic EL element OLED is turned OFF at a time point when the gate-to-source voltage Vgs of the drive transistor T32 becomes equal to or smaller than the threshold voltage Vth thereof.

In this connection, when the source potential Vs of the drive transistor T32 (the anode potential Vel of the organic EL element OLED) after completion of the coupling operation is equal to or smaller than the sum of the threshold voltage Vthel and the cathode potential Vcat of the organic EL element OLED, the source potential Vs of the drive transistor T32 is held as it is.

On the other hand, when the source potential Vs of the drive transistor T32 after completion of the coupling operation is larger than the sum of the threshold voltage Vthel and the cathode potential Vcat of the organic EL element OLED, the source potential Vs of the drive transistor T32 converges to the potential of (Vthel+Vcat) owing to the discharge of the electric charges accumulated in the organic EL element OLED. FIG. 54 shows a state in which the source potential Vs of the drive transistor T32 converges to the potential of (Vthel+Vcat).

In this connection, the high potential Vcc is applied to the drain electrode of the drive transistor T32, and the reverse bias potential Vini is applied to the gate electrode of the drive transistor T32. That is to say, the reverse bias voltage is applied to the drive transistor T32. It is noted that since the reverse bias potential Vini reflects in the signal potential Vsig in the phase of the signal writing operation, as previously stated, the reverse bias potential Vini operates so as to cancel the change in threshold voltage Vth caused by application of the signal potential Vsig.

After that, the sampling transistor T31 is controlled so as to be turned OFF before the switching of the potential of the signal line DTL (t3 in FIGS. 52A to 52E). It is noted that the state of application of the reverse bias voltage continues.

Figure 55:
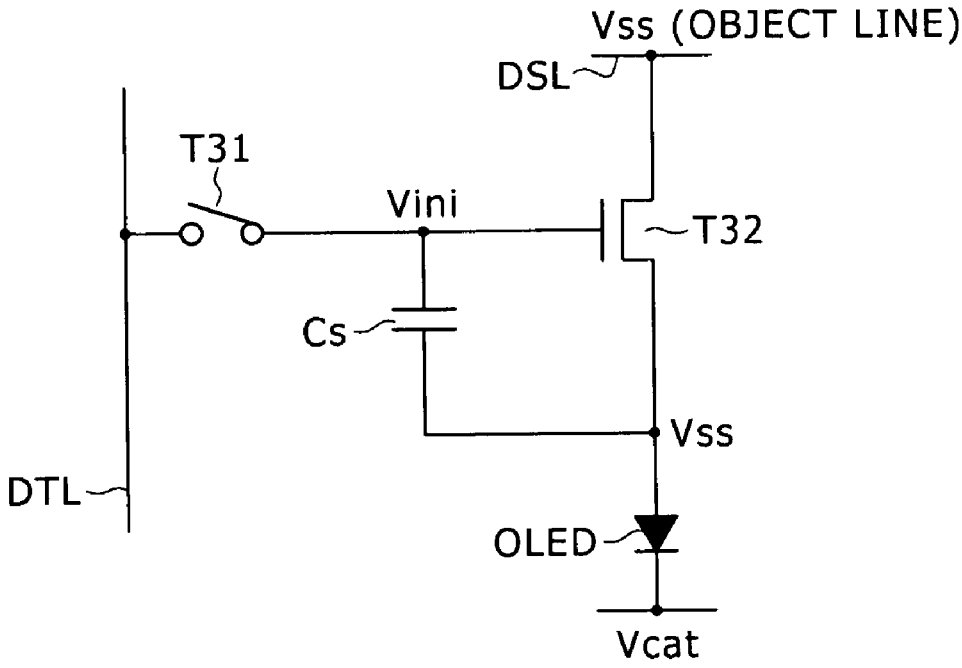

After this reverse bias state elapses for a given time period, the power source potential of the current supply line DSL is controlled so as to be switched from the high potential Vcc over to the low potential Vss (t4 in FIGS. 52A to 52E). FIG. 55 shows an operation state within the pixel circuit 131 at this time point.

At this time, a potential difference between the reverse bias potential Vini, and the potential (the low potential Vss) of the current supply line DSL becomes equal to the gate-to-source voltage Vgs of the drive transistor T32.

Here, when the reverse bias potential Vini is smaller than the potential of (Vss+Vth), the drive transistor T32 is held in the cut-off state.

In the third embodiment, the reverse bias potential Vini is assumed to be smaller than the potential of (Vss+Vth). However, the reverse bias potential Vini is not necessarily assumed to be smaller than the potential of (Vss+Vth).

Next, the sampling transistor T31 is controlled so as to be turned ON at a timing at which the potential of the signal line DTL is set at the first offset signal potential Vofs1 (t5 in FIGS. 52A to 52E). By carrying out this control, the gate potential Vg of the drive transistor T32 transits to the first offset signal potential Vofs1.

Figure 56:
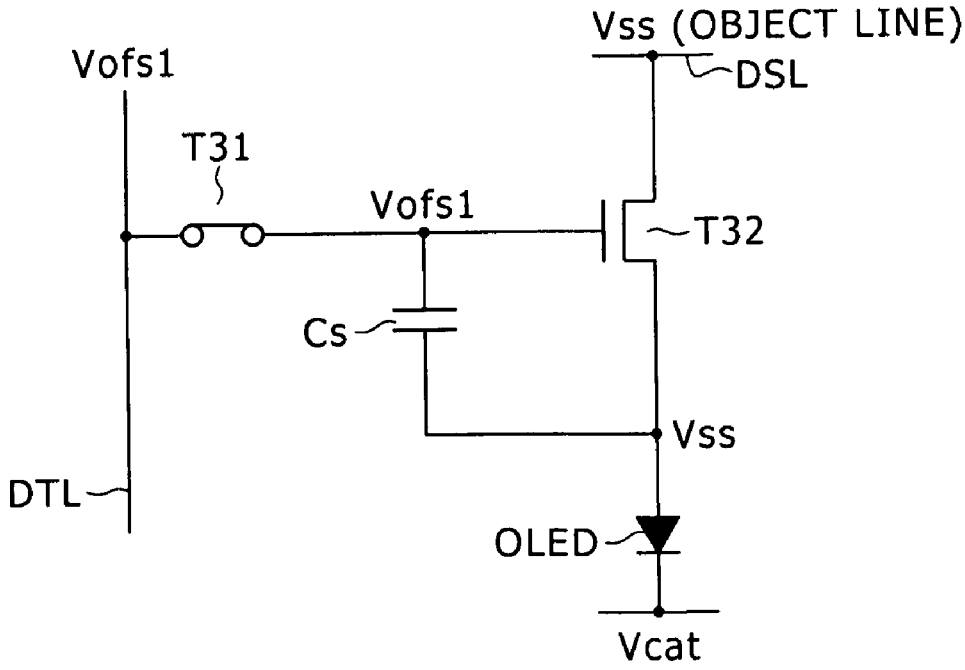

FIG. 56 shows an operation state within the pixel circuit 131 at this time point.

At this time, the gate-to-source voltage Vgs of the drive transistor T32 is given by (Vofs1−Vss).

The gate-to-source voltage Vgs at this time point is set at a larger value than the threshold voltage Vth of the drive transistor T32 in order to secure the carrying-out of the threshold correcting operation.

Figure 57:
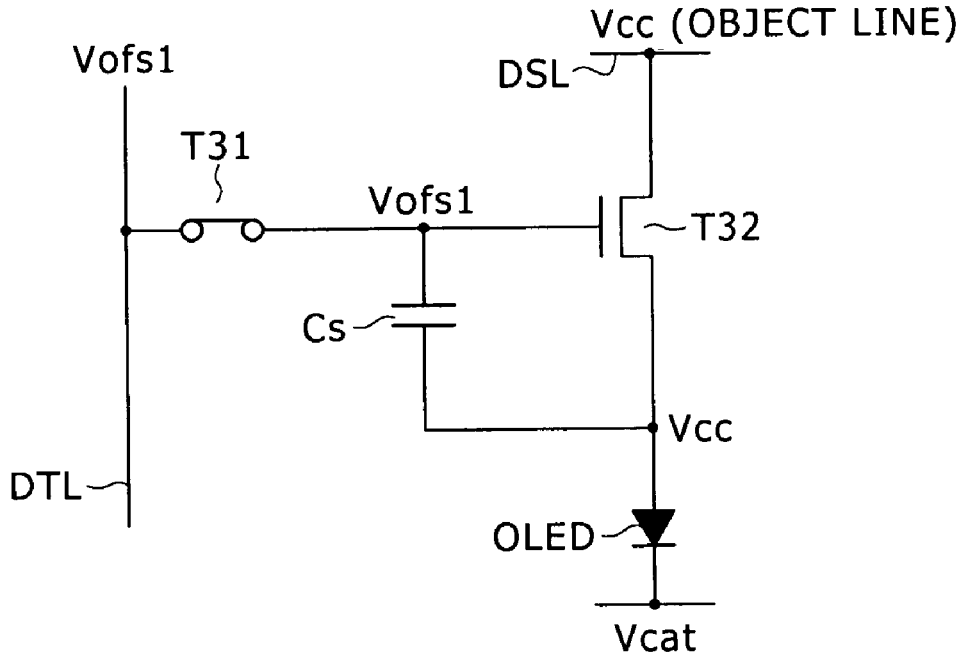

Before long, a timing at which the threshold correcting operation is carried out will come. For a time period for which the first offset signal potential Vofs1 is applied to the signal line DTL, the sampling transistor T31 is controlled so as to be turned ON and the current supply line DSL is controlled so as to be set at the high potential Vcc, thereby carrying out the threshold correcting operation (t7 in FIGS. 52A to 52E). FIG. 57 shows an operation state within the pixel circuit 131 at this time point.

The high potential Vcc is applied to the current supply line DSL while the drive transistor T32 is held in the ON state, thereby starting the threshold correcting operation for the drive transistor T32. Along with this operation, only the source potential Vs starts to rise while the gate potential Vg of the drive transistor T32 is controlled so as to be set at the first offset signal potential Vofs1.

At this time, the current caused to flow through the drive transistor T32 is used to charge both the hold capacitor Cs, and the parasitic capacitance Cel of the organic EL element OLED with the electricity as long as the source potential Vs of the drive transistor T32 (the anode potential Vel of the organic EL element OLED) is equal to or smaller than the potential of (Vcat+Vthel) (as long as the leakage current of the organic EL element OLED is considerably smaller than the current caused to flow through the drive transistor T32).

The source potential Vs of the drive transistor T32 starts to rise with time.

After a lapse of given time, the sampling transistor T31 is controlled so as to be turned OFF. However, the gate-to-source voltage Vgs of the drive transistor T32 at this time point is larger than the threshold voltage Vth of the drive transistor T32. Therefore, the current which is caused to flow from the current supply line DSL into the pixel circuit 131 is caused to flow so as to charge the hold capacitor Cs with the electricity.

Along with this operation, the gate potential Vg of the drive transistor T32 rises in conjunction with the source potential Vs thereof. It is noted that since the reverse bias voltage is applied to the organic EL element OLED, the organic EL element OLED emits no light.

Before long, when a timing comes at which the first offset signal potential Vofs1 is supplied to the signal line DTL, the sampling transistor T31 is controlled so as to be turned ON again. By carrying out the turn-ON operation, the gate potential Vg of the drive transistor T32 is caused to drop to the first offset signal potential Vofs1.

By repetitively carrying out this operation, the gate-to-source voltage Vgs of the drive transistor T32 converges to the threshold voltage Vth of the drive transistor T32 (t9 and t11 in FIGS. 52A to 52E).

It is noted that at this time point, the source potential Vs of the drive transistor T32 fulfills a value equal to or smaller than the potential of (Vcat+Vthel).

After completion of the threshold correcting operation, the sampling transistor T31 is controlled so as to be turned OFF once.

Figure 58:
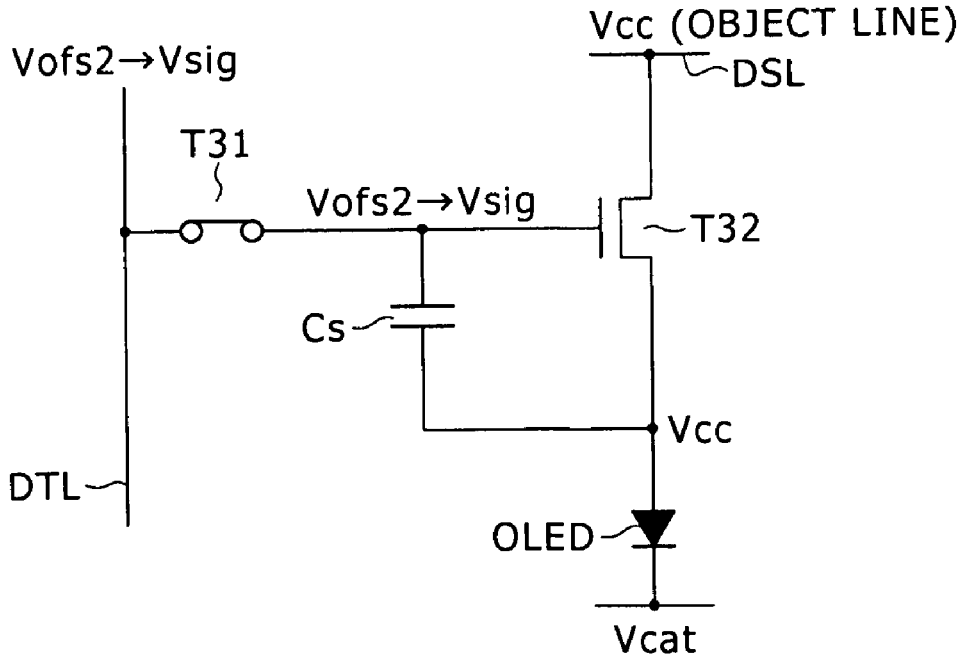

After that, at a time point when the potential of the signal line DTL is set at the second offset signal potential Vofs2, the sampling transistor T31 is controlled so as to be turned ON again (t13 in FIGS. 52A to 52E). The ON state of the sampling transistor T31 continues even after the potential of the signal line DTL is switched from the second offset signal potential Vofs2 over to the signal potential Vsig (t14 in FIGS. 52A to 52E). FIG. 58 shows an operation state within the pixel circuit 131 at this time point.

For this time period t14, the gate potential Vg of the drive transistor T32 is changed from the second offset signal potential Vofs2 over to the signal potential Vsig. In this case, the source potential Vs of the drive transistor T32 rises with time because the current is continuously supplied from the current supply line DSL to the drive transistor T32.

Of course, when the source potential Vs of the drive transistor T32 does not exceed the potential of (Vthel+Vcat) (the leakage current of the organic EL element OLED is considerably smaller than the current caused to flow through the drive transistor T32), the current caused to flow through the drive transistor T32 is used to charge both the hold capacitor Cs, and the parasitic capacitance Cel of the organic EL element OLED with the electricity.

At this time, since the threshold correction operation for the drive transistor T32 has already been completed, the current caused to flow through the drive transistor T32 has a value in which the mobility μ is reflected.

Now, in the case of this sort of mobility correction system, in general, the mobility correction time in the phase of the intermediate gradation display is longer than that in the phase of the white display. In particular, in the case of the drive system in the second embodiment in which the mobility correction is carried out by application of the signal potential Vsig to the gate electrode of the drive transistor T32, a time difference between the mobility correction time in the phase of the white display and the mobility correction in the phase of the intermediate gradation display is large. As a result, the mobility correction about the white display pixel, and the mobility correction about the intermediate gradation pixel cannot be completed within the same write time period.

However, the second offset signal potential Vofs2 is inputted before input of the signal potential Vsig to the gate electrode of the drive transistor T32 as in the case of the third embodiment, which results in that the mobility correction time in the phase of the white display and the mobility correction in the phase of the intermediate gradation display can be each made constant.

Figure 59A:
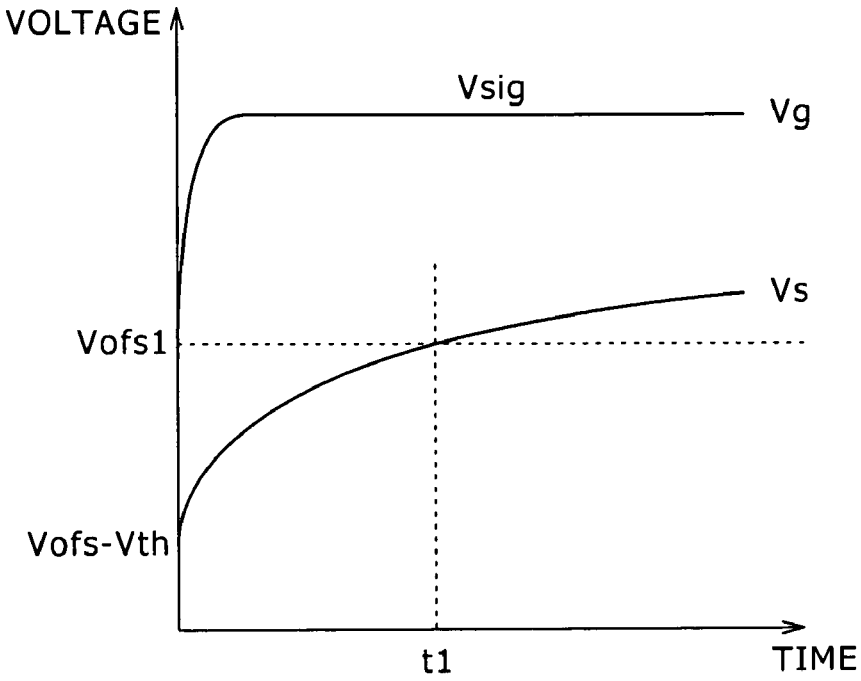
FIGS. 59A to 60B are respectively graphical representations explaining an effect when mobility correction is carried out in two stages.
Figure 59B:
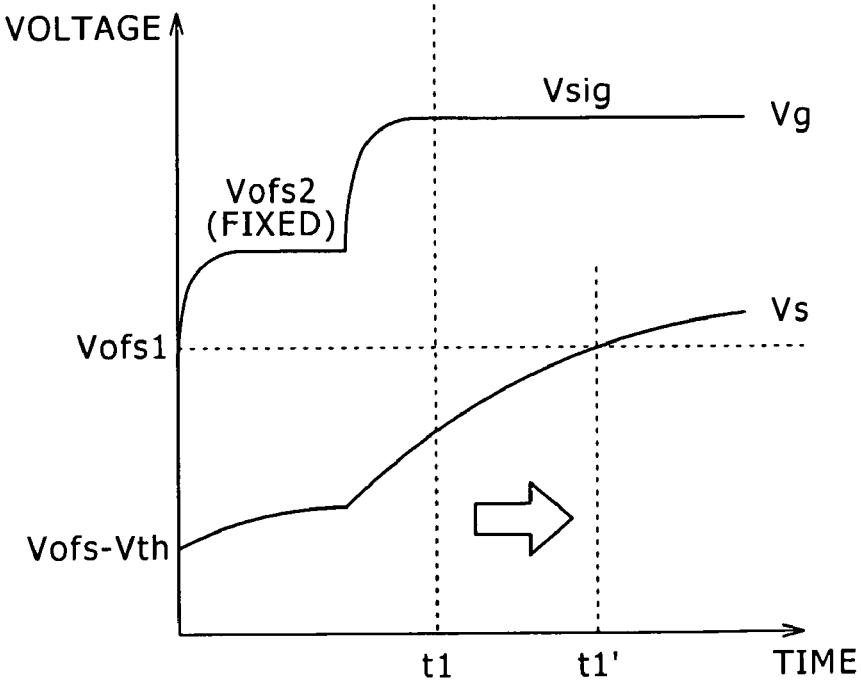

Hereinafter, a concrete description will be given with respect to this operation. FIGS. 59A and 59B show the mobility correction time in the phase of the white display, and FIGS. 60A and 60B show the mobility correction time in the phase of the intermediate gradation display (an example of being near the back display).

Figure 60A:
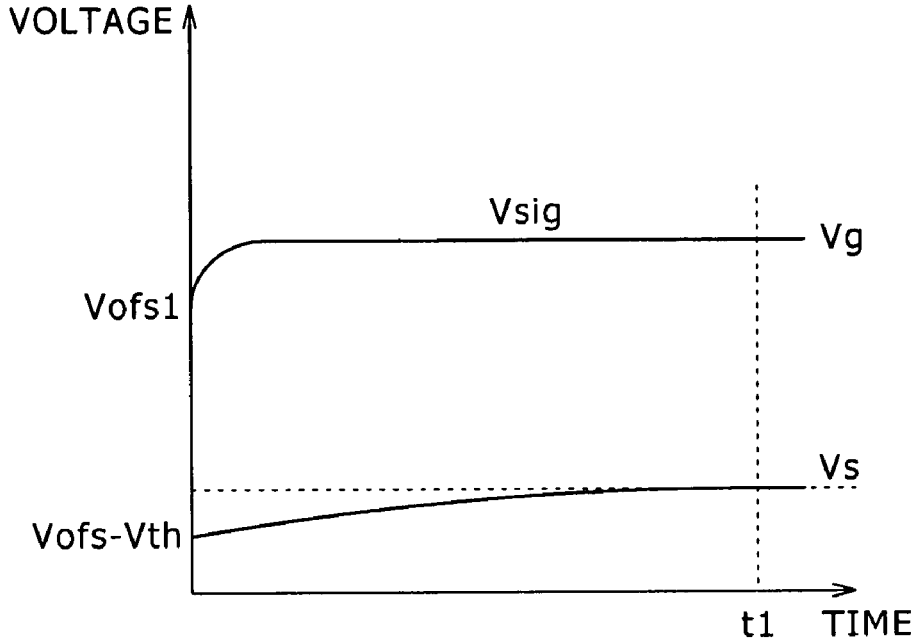
Figure 60B:
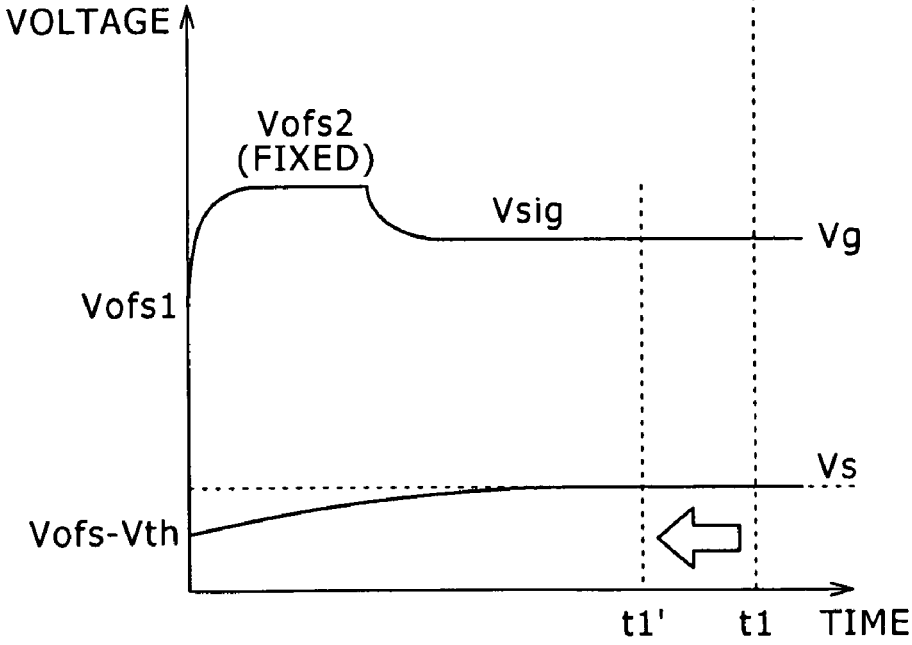

It is noted that FIGS. 59A and 60A respectively show the mobility correcting operations corresponding to the second embodiment, and FIG. 59B and FIG. 60B respectively show the mobility correcting operations corresponding to the third embodiment. In these figures, the mobility correction time corresponding to the second embodiment is indicated by t1, and the mobility correction time corresponding to the third embodiment is indicated by t1'.

Firstly, let us consider the phase of the white display. As shown in FIGS. 59A and 59B, the time required for the mobility correction can be made longer in the case where the second offset signal potential Vofs2 is used than in the case where no second offset signal potential Vofs2 is used.

On the other hand, let us consider the phase of the intermediate gradation display. As shown in FIGS. 60A and 60B, the time required for the mobility correction can be made shorter in the case where the second offset signal potential Vofs2 is used than in the case where no second offset signal potential Vofs2 is used.

That is to say, the correction time in the phase of the white display for which the correction time is essentially enough to be short can be made long, while the connection time in the phase of the intermediate gradation display for which the correction time is essentially enough to be long can be made short. This means that the time required for the mobility correction in the phase of the white display, and the time required for the mobility correction in the phase of the intermediate gradation display can be uniformed to be approximately constant irrespective of the display gradations.

Figure 61:
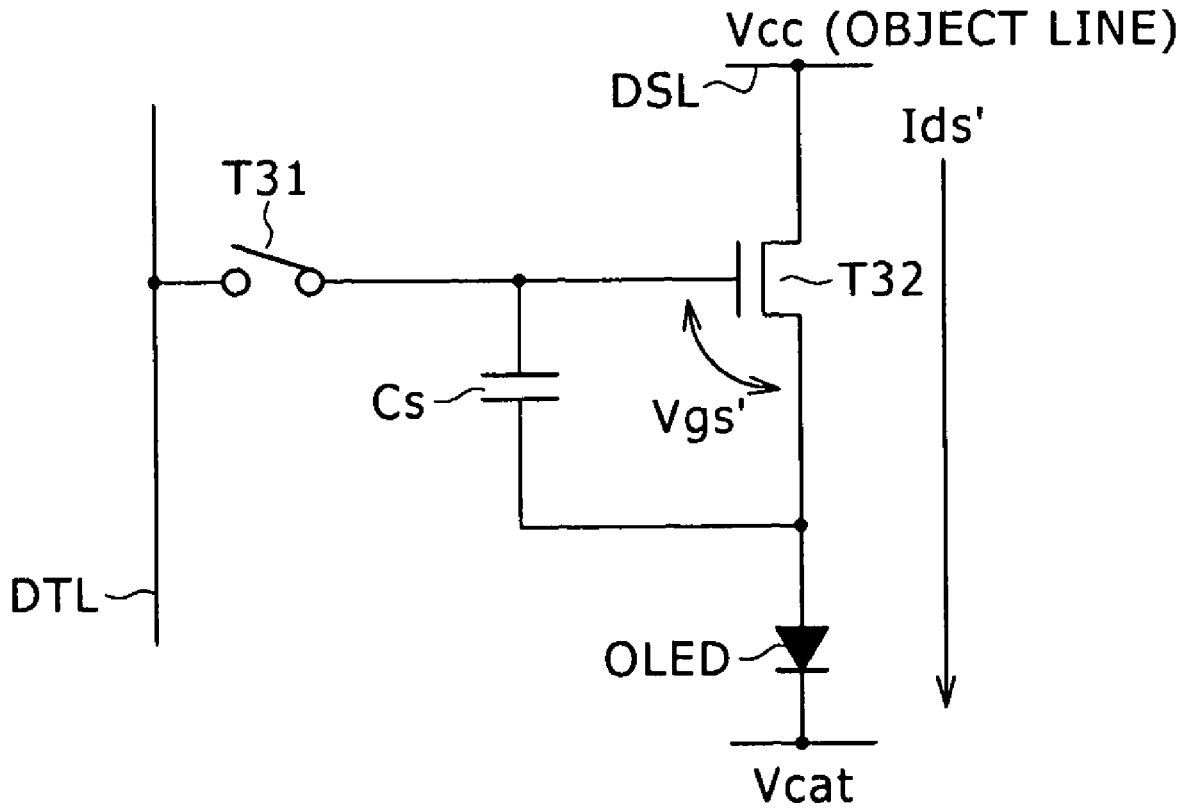
FIG. 61 is a circuit diagram explaining an operation state in the pixel circuit shown in FIG. 50.

Also, after completion of the operation described above, when the sampling transistor T31 is controlled so as to be turned OFF, thereby completing the write operation, the drive current is caused to flow through the organic EL element OLED, thereby starting the emission time period (t15 in FIGS. 52A to 52E). FIG. 61 shows an operation state within the pixel circuit 131 at this time point.

It is noted that the gate-to-source voltage Vgs of the drive transistor T32 is constant. Therefore, the drive transistor T32 causes a constant current Ids' to flow through the organic EL element OLED.

It is noted that the anode potential Vel of the organic EL element OLED continuously rises up to a voltage Vx at which the constant current Ids' is caused to flow through the organic EL element OLED.

(D-4) Conclusion

As described above, in the case of the organic EL display panel described in the third embodiment, in addition to the effect of the second embodiment, the following effect can be realized.

That is to say, the time required for the mobility correction in the phase of the white display, and the time required for the mobility correction in the phase of the intermediate gradation display can be uniformed to be approximately constant irrespective of the display gradations. In other words, the mobility correcting operations can be uniformed for all the pixel circuits. This means that the mobilities μ in the pixels can be corrected in just proportion within the determined time period. As a result, even when the high definition and high speed operation of the organic EL display panel progress, it is possible to realize the drive technique with which non-uniformity or a streak hardly appears in the displayed image.

(E) Other Embodiments (E-1) Other Pixel Circuit

In the first to third embodiments described above, the description has been given with respect to the case where the pixel circuit is composed of the five N-channel thin film transistors (first embodiment), and the case where the pixel circuit is composed of the two N-channel thin film transistors (second and third embodiments).

Figure 62:
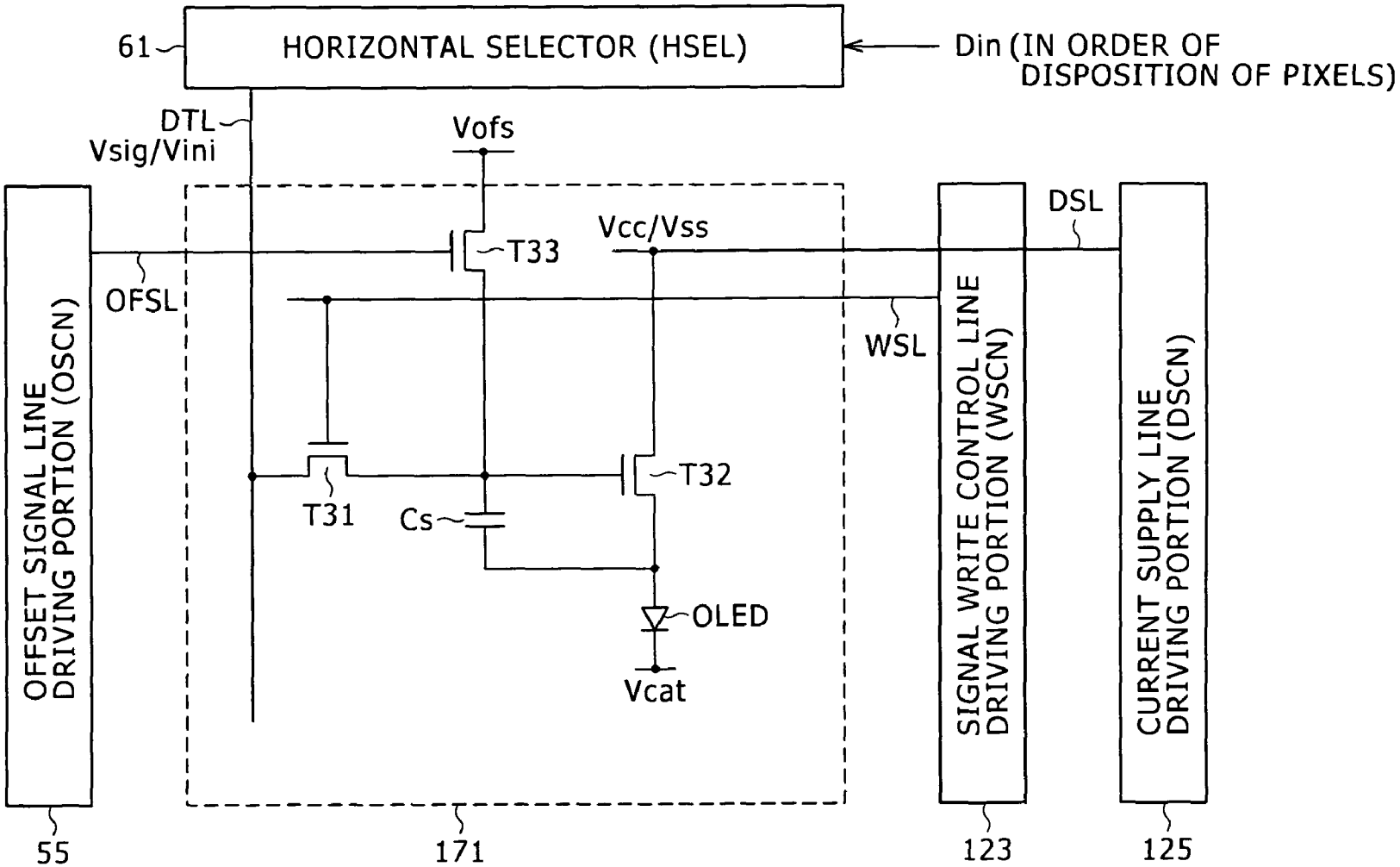
FIG. 62 is a circuit diagram, partly in block, showing a configuration of a pixel circuit in an organic EL display panel according to another embodiment of the present invention.

However, the configuration of the pixel circuit is by no means limited thereto. For example, as shown in FIG. 62, the present invention can also be applied to the case where a pixel circuit 171 is composed of three N-channel thin film transistors. It is noted that in FIG. 62, portions corresponding to those in each of FIGS. 20 and 34 are designated with the same reference numerals, respectively.

The pixel circuit 171 is of an intermediate type between the pixel circuit 71 in the first embodiment, and the pixel circuit 131 in the second embodiment. Also, the feature of the pixel circuit 171 is that the application of the offset signal potential Vofs to the gate electrode of the drive transistor T32 is controlled by a dedicated thin film transistor T33. That is to say, the feature of the second embodiment is that the offset signal potential Vofs which is applied through the corresponding one of the signal lines DTLs is independently applied to the gate electrode of the drive transistor T32 as in the case of the first embodiment. It is noted that the timing of application of the offset signal potential Vofs, and the like are similar to those in the second embodiment.

(E-2) Method of Generating Reverse Bias Potential

In the first embodiment, the description has been given with respect to the case where the pixel data Din' having the size corresponding to the pixel data Din (the signal potential Vsig) is generated in accordance with Expression (3) which is basically, previously set.

However, the organic EL display panel in which the duty of the emission time period occupied in one frame time period can be made variable in accordance with the display contents or the circumferential luminance adopts a mechanism for adaptively switching the relational expression or table applied to the generation of the reverse bias potential Vini based on the variable duty information.

Figure 63:
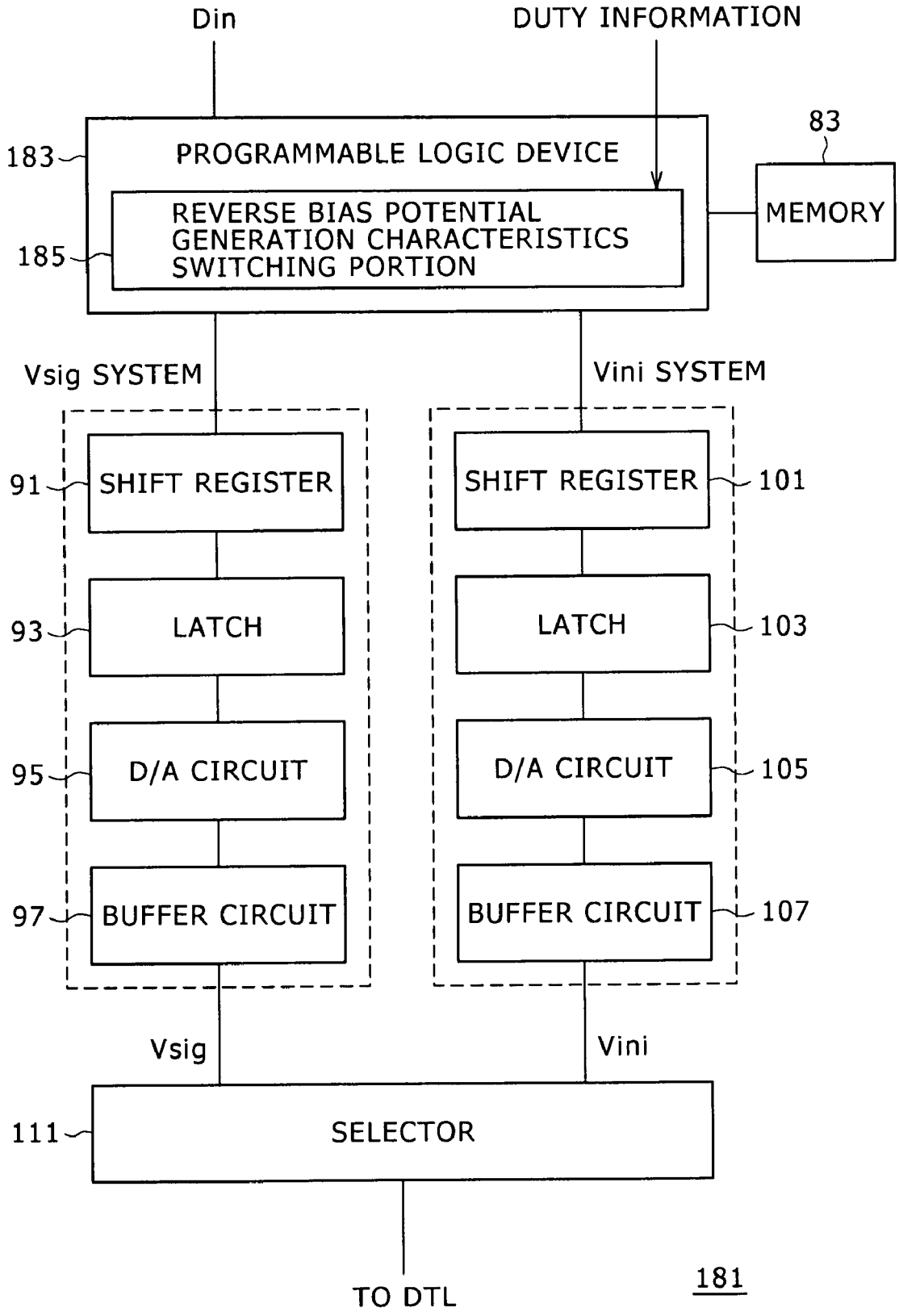
FIG. 63 is a block diagram showing a configuration of a horizontal selector in the organic EL display panel in the another embodiment of the present invention.

FIG. 63 shows a configuration of a horizontal selector 181 corresponding to this mechanism. It is noted that in FIG. 63, portions corresponding to those in FIG. 21 are designated with the same reference numerals, respectively. Also, FIG. 63 shows the configuration in which a reverse bias potential generation characteristics switching portion 185 is mounted within a programmable logic device 183. In this case, all that is required is that the reverse bias potential generation characteristics switching portion 185 executes processing for switching a relational expression (for example, change of a coefficient) or a reference table over to another one in accordance with duty information (information giving the duty of the emission time period within one reference time period) supplied from the outside.

(E-3) Generation of Second Offset Signal Potential Vofs2

In the third embodiment described above, the description has been given with respect to the case where the second offset signal potential Vofs2 is given as the fixed value. However, the second offset signal potential Vofs2 can also be generated in the form of pixel data Din" having a size corresponding to the pixel data Din (the signal potential Vsig).

Figure 64:
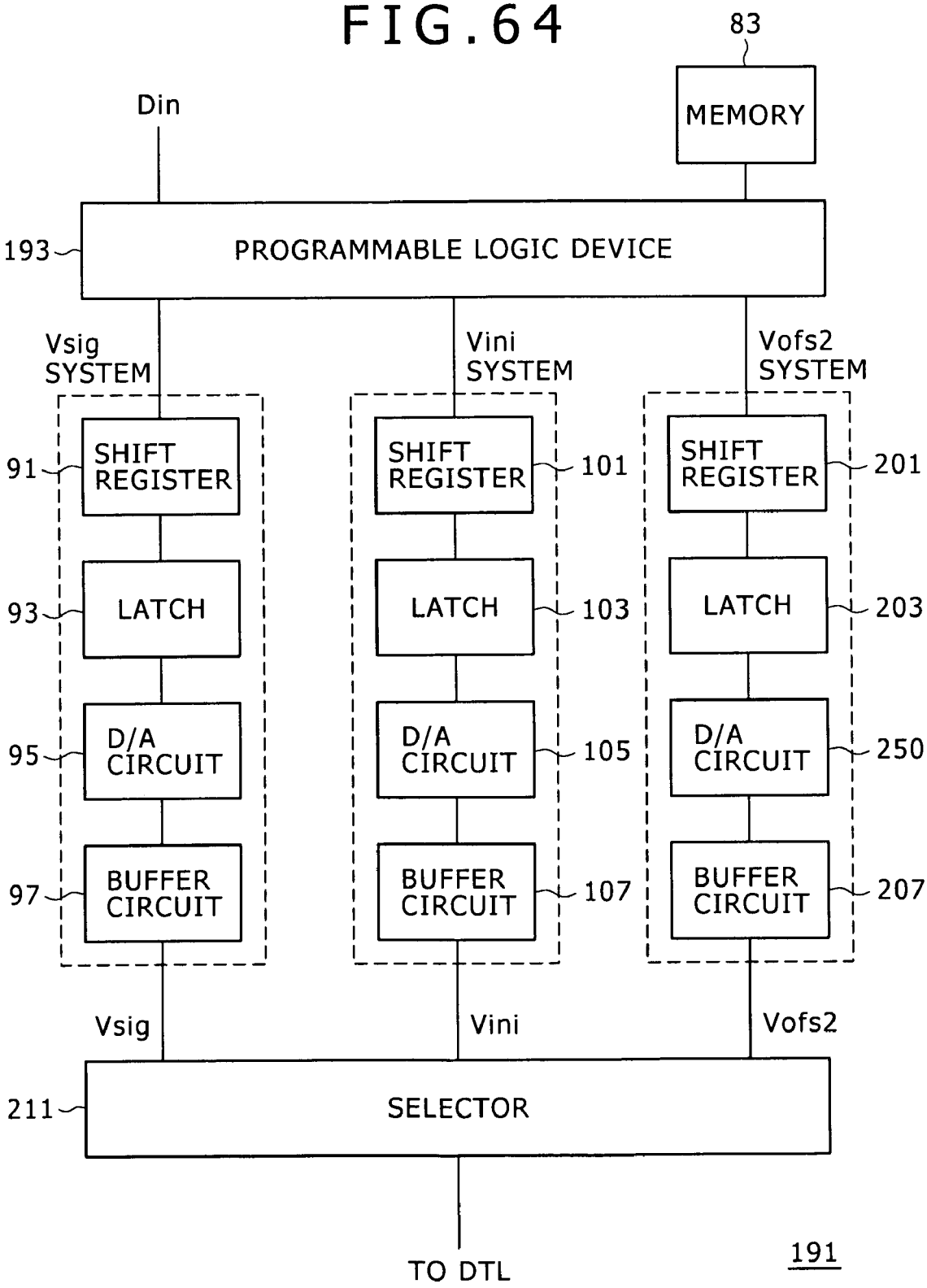
FIG. 64 is a block diagram showing a configuration of a horizontal selector in an organic EL display panel according to still another embodiment of the present invention.

FIG. 64 shows a configuration of a horizontal selector 191 corresponding to this mechanism. It is noted that in FIG. 64, portions corresponding to those in FIG. 21 are designated with the same reference numerals, respectively. Novel constituent portions of the horizontal selector 191 shown in FIG. 64 are a programmable logic device 193, circuit portions of the second offset signal potential Vofs2 system (a shift register 201, a latch circuit 203, a D/A circuit 205, and a buffer circuit 207), and a selector 211.

Of these constituent portions, a function of generating an intermediate potential between the signal potential Vsig and the first offset signal potential Vofs1 is newly added to the programmable logic device 193. For example, the pixel data Din" corresponding to the potential of (Vsig−Vofs1)/2 is generated based on the pixel data Din read out from the memory 83.

Figure 65A:
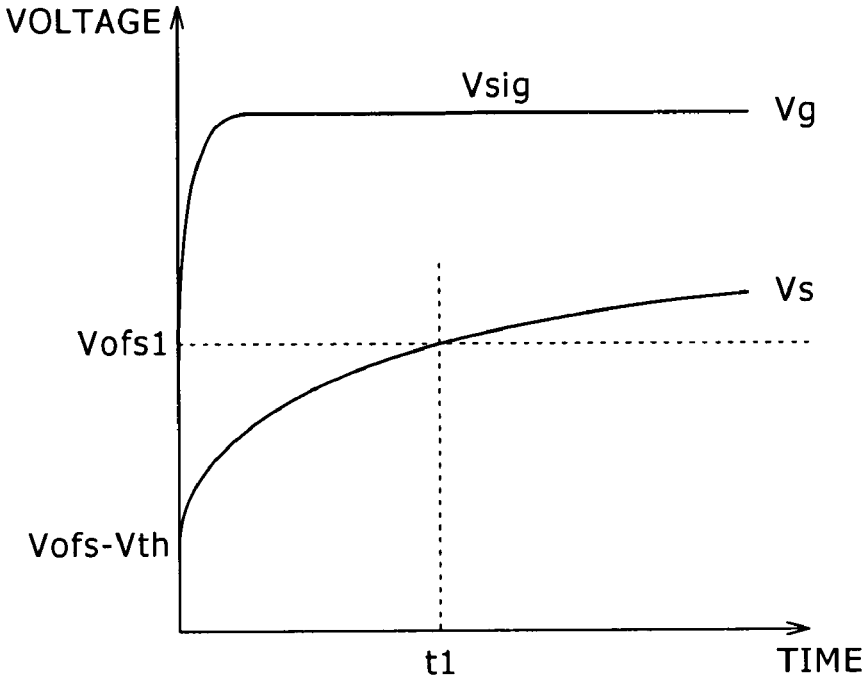
FIGS. 65A and 65B are respectively graphical representations explaining a driving operation, corresponding to the second embodiment, when mobility correction is carried out in two stages.
Figure 65B:
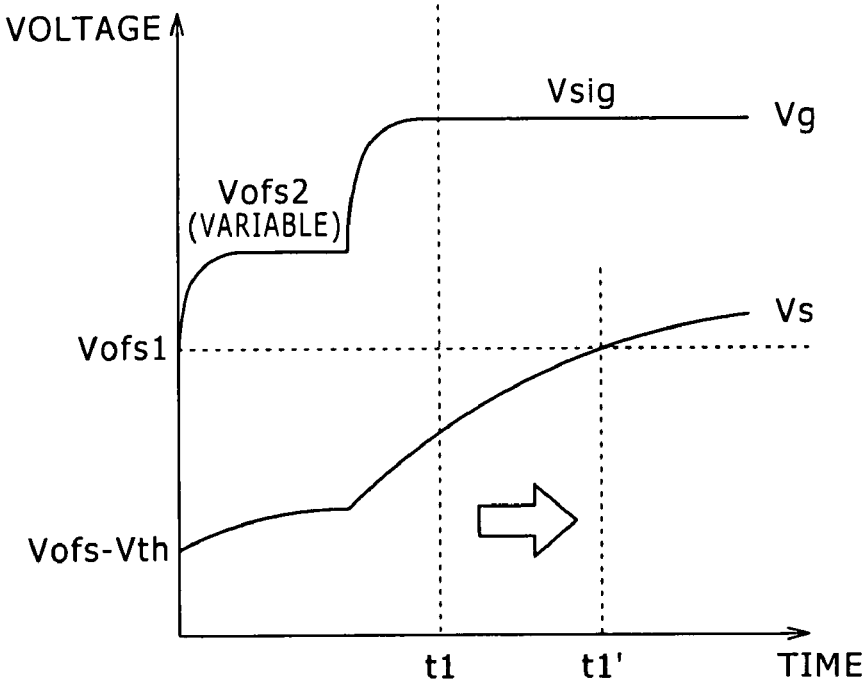
Figure 66A:
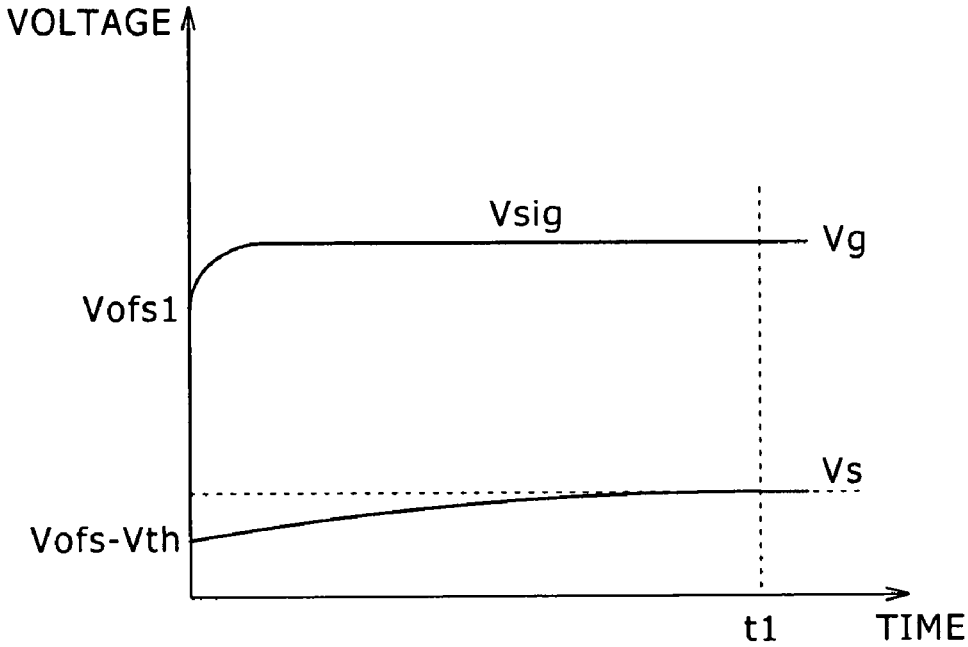
FIGS. 66A and 66B are respectively graphical representations explaining a driving operation, corresponding to the description, when the mobility correction is carried out in the two stages.

FIGS. 65A and 65B respectively show changes in potentials corresponding to this device system, that is, the mobility correcting operation in the phase of the white display. Also, FIGS. 66A and 66B respectively show changes in potentials corresponding to this device system, that is, the mobility correcting operation in the phase of the intermediate gradation display (an example of being near the black display).

Figure 66B:
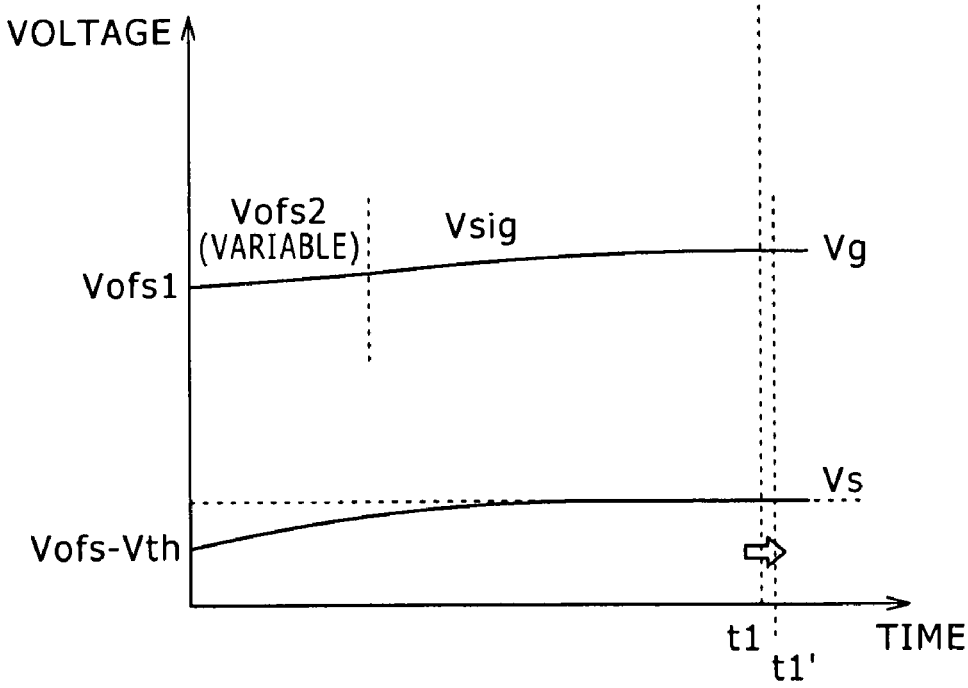

Of FIGS. 65A and 65B, and FIGS. 66A and 66B, FIGS. 65A and 66A show the mobility correcting operation corresponding to the second embodiment, and FIGS. 65B and 66B show the mobility correcting operation corresponding to this description. In this connection, the mobility correction time period corresponding to the second embodiment is indicated by t1, and the mobility correction time period corresponding to this description is indicated by t1'.

In the case as well of this drive system, the mobility correction time in the phase of the white display can be extended by using the second offset signal potential Vofs2. In addition, the mobility correction time in the phase of the intermediate gradation phase can also be extended by using the second offset signal potential Vofs2. However, the extension of the mobility correction time in the phase of the intermediate gradation phase is smaller than that in the case where the gradation value is large (the signal potential Vsig is large).

Therefore, the adoption of this drive system can compress a difference between the mobility correction time in the phase of the white display and the mobility correction time in the phase of the intermediate gradation phase. When this time difference is sufficiently small, the effect of uniforming the time required for the mobility correction in the phase of the white display, and the time required for the mobility correction in the phase of the intermediate gradation display can be further enhanced than in the case of the second embodiment. As a result, the visualized image quality can be enhanced by suppressing the deterioration of the image quality due to excess and deficiency of the mobility correction.

(E-4) Another Application of Reverse Bias Potential Vini

In each of the first to third embodiments described above, the description has been given with respect to the case where the reverse bias potential Vini is applied to the gate electrode of the drive transistor T25 or T32 through the corresponding one of the signal lines DTLs which the horizontal selector drives and controls.

However, the reverse potential Vini may also be applied to the gate electrode of the drive transistor through another wiring. In addition, in this case, the reverse bias potential generating portion can be, of course, disposed outside the horizontal selector.

(E-5) Product Examples (a) Electronic Apparatuses

The present invention has been described so far based on the first to third embodiments of the organic EL display panel. However, the organic EL display panel described above is distributed in the form as well of product forms mounted to various electronic apparatuses. Hereinafter, examples of mounting the organic EL display panel to the various electronic apparatuses.

Figure 67:
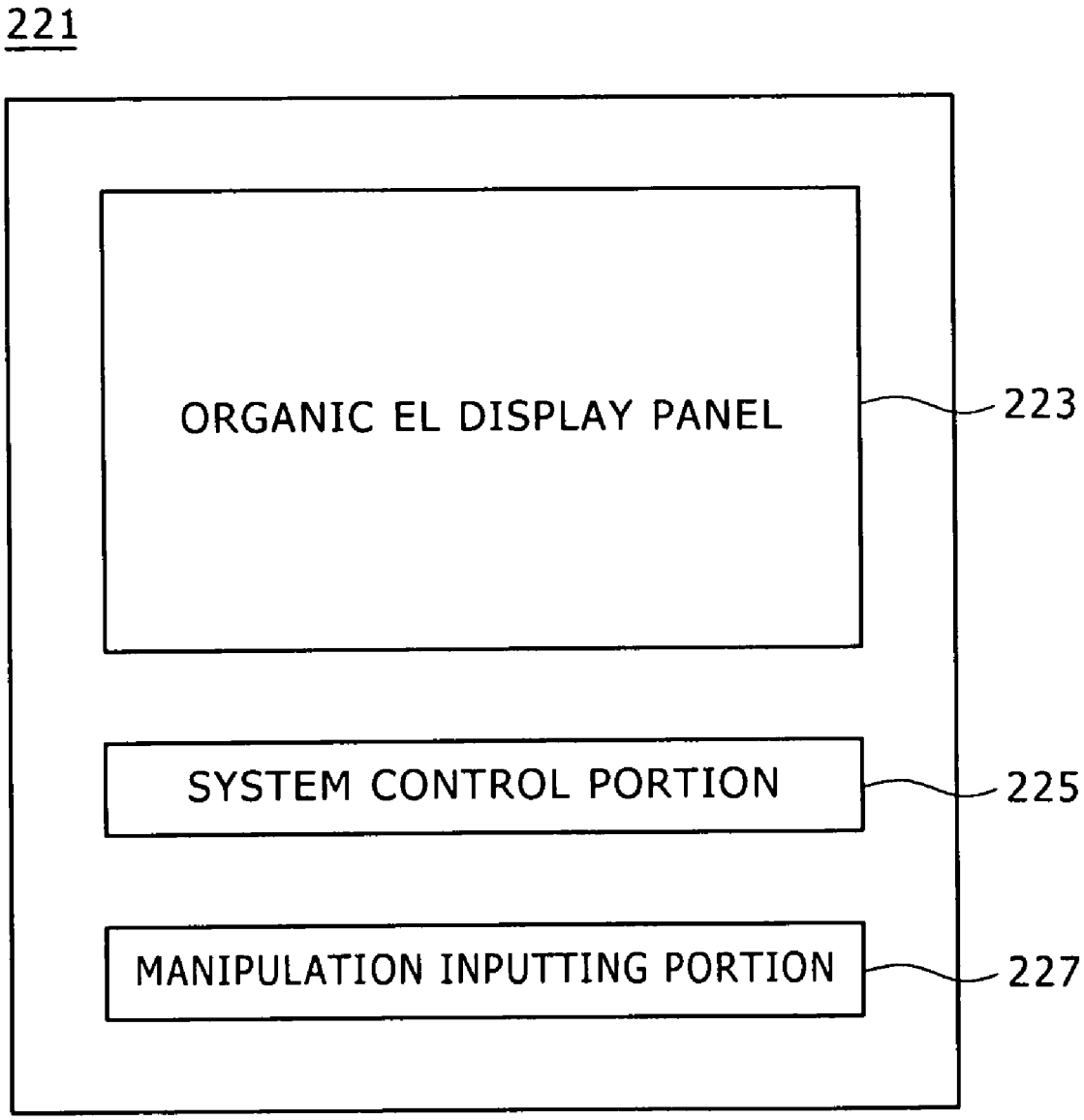
FIG. 67 is a block diagram showing a conceptual configuration of an electronic apparatus.

FIG. 67 shows an example of a conceptual configuration of an electronic apparatus 221. The electronic apparatus 221 is composed of the organic EL display panel 223 described above, a system control portion 225 and a manipulation inputting portion 227. Processing contents which are executed in the system control portion 225 differ depending on the product forms of the electronic apparatus 221. In addition, the manipulation inputting portion 227 is a device for receiving a manipulation input to the system control portion 225. A mechanical interface such as a switch or a button, a graphic interface or the like is used as the manipulation inputting portion 227.

It is noted that the electronic apparatus 221 is by no means limited to an apparatus in a specific field as long as the electronic apparatus 221 is loaded with a function of displaying an image or a video picture data on which is generated within the apparatus or inputted thereto from the outside.

Figure 68:
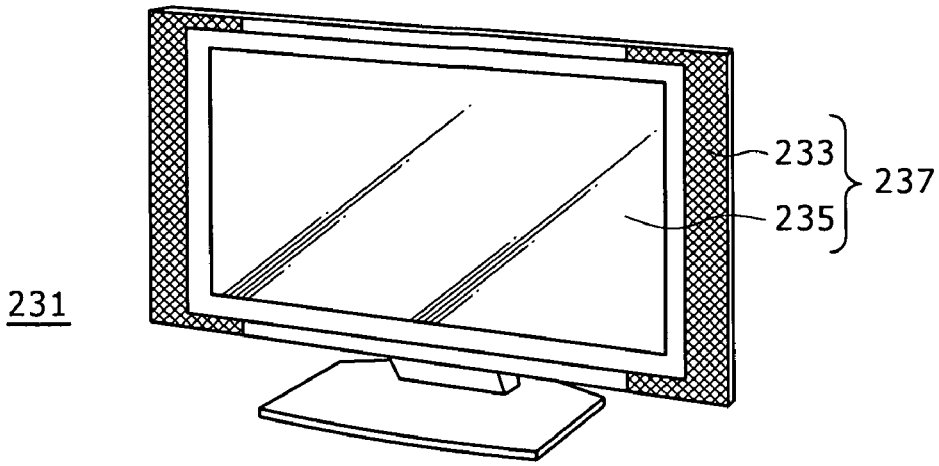
FIG. 68 is a perspective view showing an example of a product of the electronic apparatus.

FIG. 68 shows an example of an exterior appearance in the case where other electronic apparatus is a television set. A display screen 237 composed of a front panel 233, a filter glass 235, and the like is disposed on a front surface of a chassis of a television receiver 231. The display screen 237 portion corresponds to the organic EL display panel described in any one of the first to third embodiments.

Figure 69A:
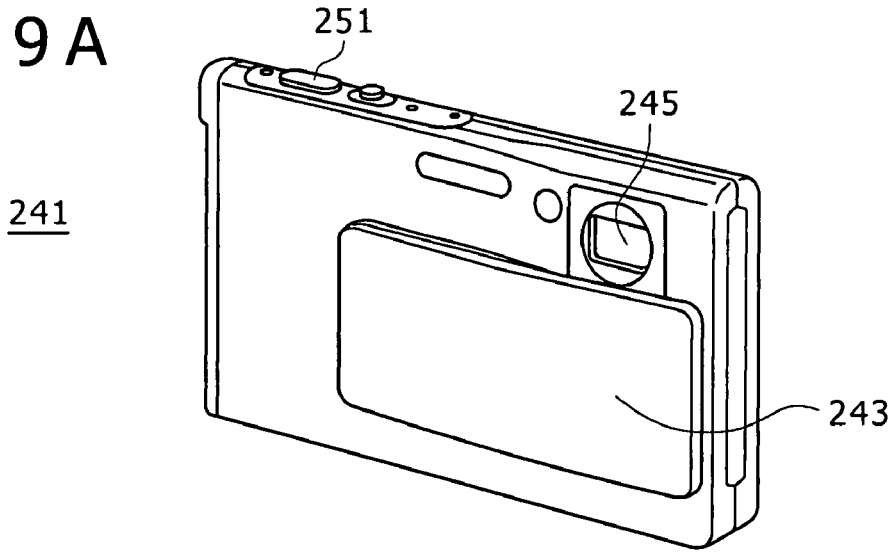
FIGS. 69A and 69B are respectively a perspective view showing another example of a product of the electronic apparatus when viewed from a front side, and a perspective view showing the another example of the product of the electronic apparatus when viewed from a back side.
Figure 69B:
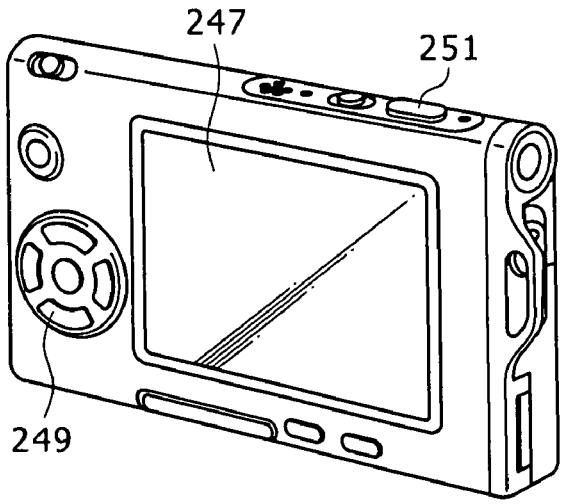

In addition, a digital camera, for example, is supposed as this sort of electronic apparatus 221. FIGS. 69A and 69B show an example of an exterior appearance of a digital camera 241. Here, FIG. 69A is an example of the exterior appearance on a front surface side (on a subject side) of the digital camera 241. Also, FIG. 69B is an example of the exterior appearance on a back surface side (on a photographer side) of the digital camera 241.

The digital camera 241 is composed of a protective cover 243, an image capturing lens 245, a display screen 247, a control switch 249, and a shutter button 251. Of these constituent elements, the display screen 247 portion corresponds to the organic EL display panel described in any one of the first to third embodiments.

Figure 70:
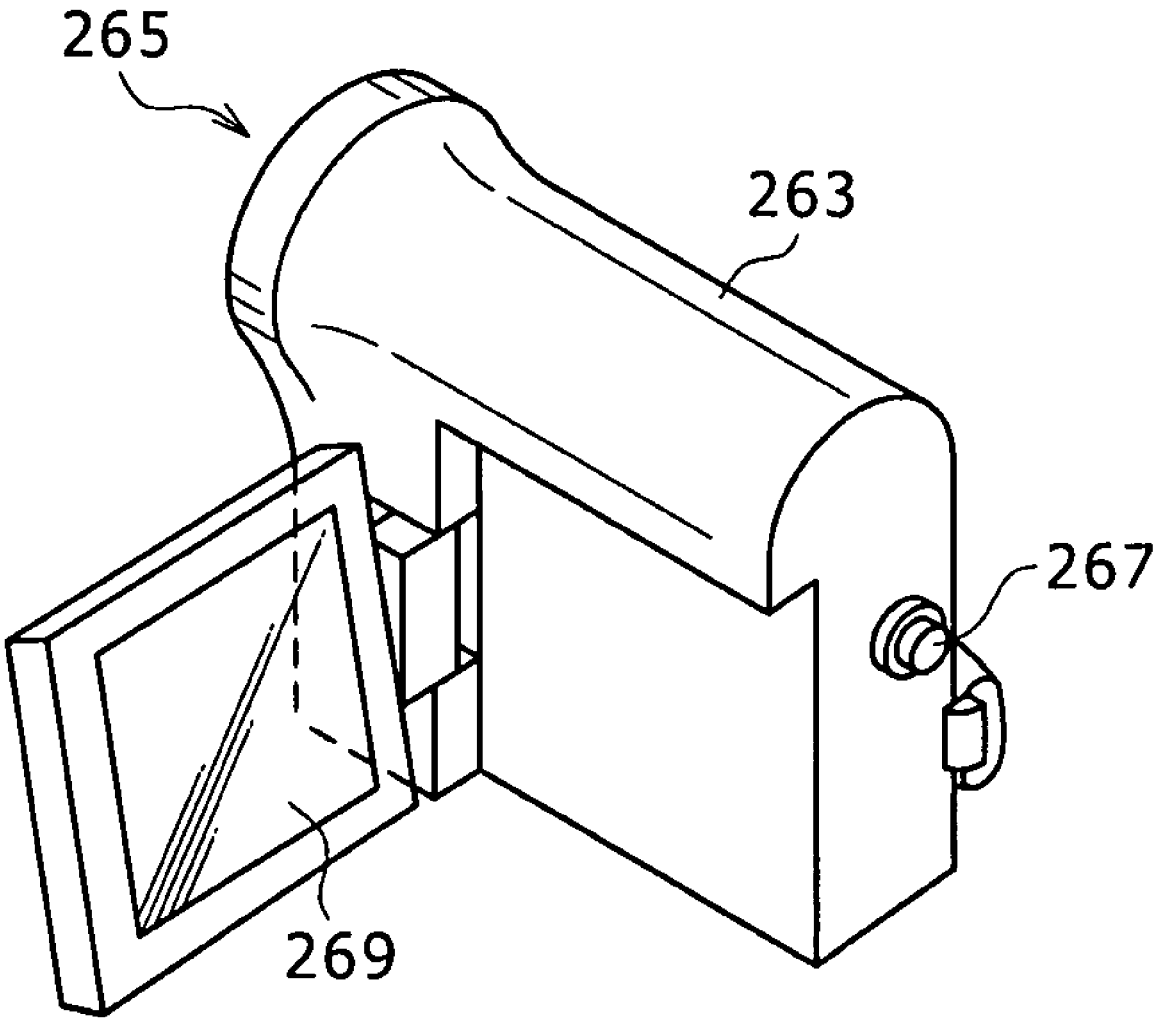
FIG. 70 is a perspective view showing still another example of a product of the electronic apparatus.

In addition, a video camera, for example, is supposed as this sort of electronic apparatus 221. FIG. 70 shows an example of an exterior appearance of a video camera 261.

The video camera 261 is composed of an image capturing lens 265, a start/stop switch 267 for image capturing, and a display screen 269. Here, an image of an object is captured through the image capturing lens 265 provided on the first surface side of a main body 263. Of these constituent elements, the display screen 269 portion corresponds to the organic EL display panel described in any one of the first to third embodiments.

Figure 71A:
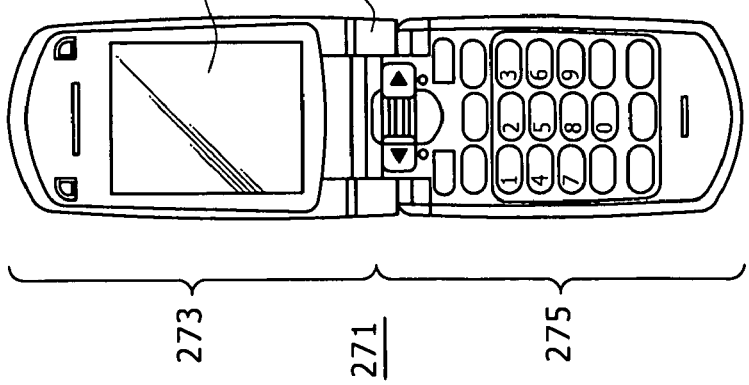
FIGS. 71A to 71G are respectively a front view of yet another example of a product of the electronic apparatus in an open state, a side elevational view thereof in the open state, a front view thereof in a close state, a left side elevational view thereof in the close state, a right side elevational view thereof in the close state, a top plan view thereof in the close state, and a bottom view thereof in the close state.
Figure 71B:
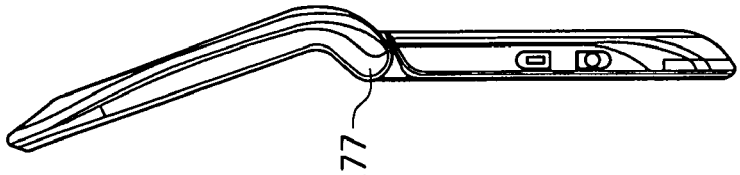
Figure 71D:
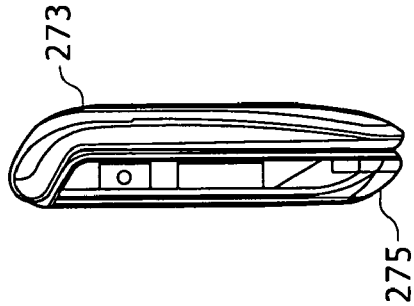
Figure 71C:
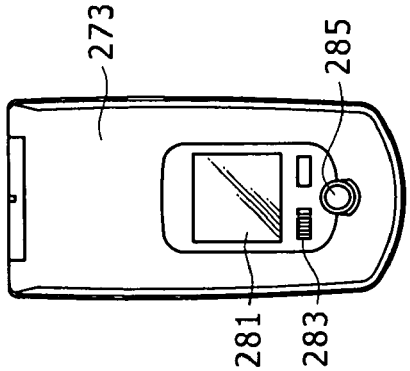
Figure 71E:
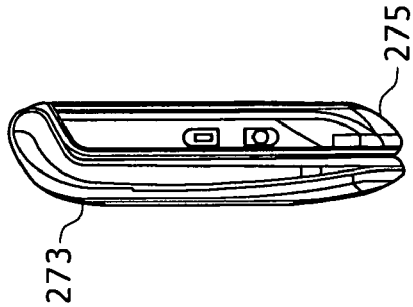
Figure 71F:
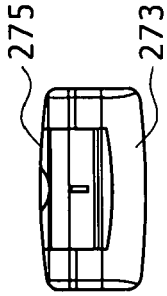
Figure 71G:
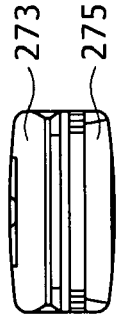

In addition, mobile terminal equipment, for example, is supposed as this sort of electronic apparatus 221. FIGS. 71A to 71G show an example of an exterior appearance of a mobile phone as the mobile terminal equipment. The mobile phone 271 shown in FIGS. 71A to 71G is folding type one. Here, FIG. 71A and 71B show the example of the exterior appearance in a state in which chassis are opened, and FIGS. 71C to 71G show the example of the exterior appearance in a state in which the chassis are folded.

The mobile phone 271 is composed of an upper chassis 273, a lower chassis 275, a connection portion (a hinge portion in this example) 277, a display screen 279, a sub-display screen 281, a picture light 283, and an image capturing lens 285. Of these constituent elements, each of the display screen 279 portion and the sub-display screen 281 corresponds to the organic EL display panel described in any one of the first to third embodiments.

Figure 72:
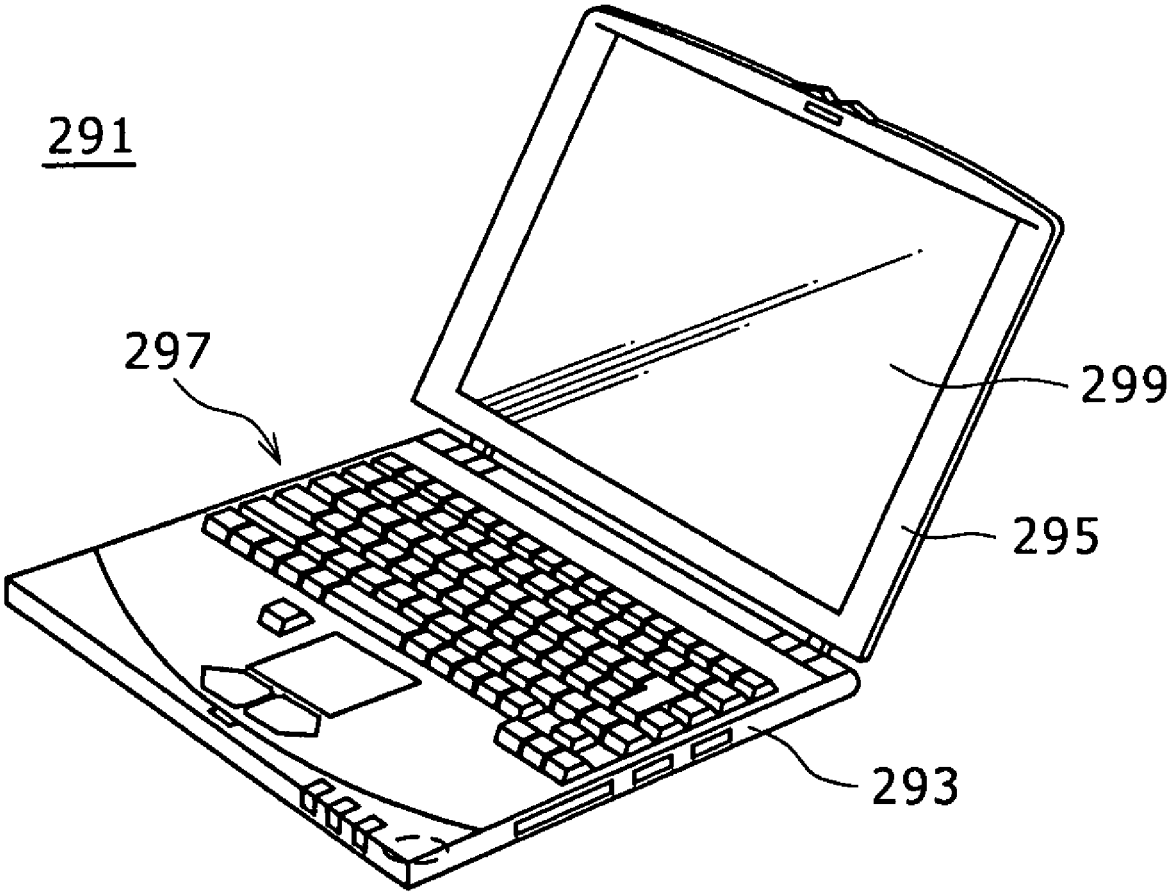
FIG. 72 is a perspective view showing yet another example of a product of the electronic apparatus.

In addition, a computer, for example, is supposed as this sort of electronic apparatus 221. FIG. 72 shows an example of an exterior example of a notebook-size personal computer 291.

The notebook-size personal computer 291 is composed of a lower chassis 293, an upper chassis 295, a keyboard 297, and a display screen 299. Of these constituent elements, the display screen 299 portion corresponds to the organic EL display panel described in any one of the first to third embodiments.

In addition thereto, an audio reproducer, a game machine, an electronic book, an electronic dictionary or the like is supposed as the electronic apparatus 221.

(E-6) Examples of Other Display Devices

In each of the first to third embodiments descried above, the description has been given with respect to the case where the present invention is applied to the organic EL display panel.

However, the drive technique described above can also be applied to other EL display devices. For example, the drive technique described above can also be applied to a display device having LEDs (Light Emitting Diode) disposed therein, or a display device in which light emitting elements each having any other suitable diode structure are disposed on a screen. For example, the drive technique described above can also be applied to an inorganic EL display panel.

(E-7) The Others

Various changes of the first to third embodiments described above can be made within a scope of the gist of the present invention. In addition, various changes and application examples which are created or combined with one another based on the description in the specification are also made.

What is claimed is:

1. An Electro Luminescence (EL) display panel having a pixel structure corresponding to an active matrix drive system, comprising:

a reverse bias potential generating portion configured to generate a reverse bias potential in which a corresponding one of gradation values of pixels is reflected; and a voltage applying portion configured to apply the reverse bias potential to a gate electrode of a drive transistor composing a pixel circuit adapted to operate for a non-emission time period, wherein the reverse bias potential is given by:

$$Vini=Vthel+Vcat-(\alpha Vsig+\beta)(\alpha>0 \text{ and } \beta\geqq 0)$$

where Vini is the reverse bias potential, Vthel is a threshold potential of an EL light emitting element, Vcat is a cathode potential of said EL light emitting element, α and β are coefficients, and Vsig is a signal potential.

2. The EL display panel according to claim 1, wherein said reverse bias potential generating portion generates the reverse bias potential so that a reverse bias voltage corresponding to a high luminance is larger than that corresponding to a low luminance.

3. The EL display panel according to claim 1, wherein said voltage applying portion applies either the reverse bias potential or a signal potential to signal lines in a time division manner.

4. The EL display panel according to claim 1, wherein when a duty of a length of an emission time period occupied in one frame time period is switchable, said reverse bias potential generating portion sets a width of a change in reverse bias potential so that the width of the change in reverse bias potential is proportional to the duty of the emission time period.

5. An electronic apparatus comprising the EL display panel of claim 1.

6. A method of driving an Electro Luminescence (EL) display panel having a pixel structure corresponding to an active matrix drive system, said method comprising the steps of:

generating a reverse bias potential in which a corresponding one of gradation values of pixels is reflected; and applying the reverse bias potential to a gate electrode of a drive transistor composing a pixel circuit adapted to operate for a non-emission time period, wherein the reverse bias potential is given by:

$$Vini=Vthel+Vcat-(\alpha Vsig+\beta)(\alpha>0 \text{ and } \beta\geqq 0)$$

where Vini is the reverse bias potential, Vthel is a threshold potential of an EL light emitting element, Vcat is a cathode potential of said EL light emitting element, α and β are coefficients, and Vsig is a signal potential.

7. The method according to claim 6, wherein generating said reverse bias potential generates the reverse bias potential so that a reverse bias voltage corresponding to a high luminance is larger than that corresponding to a low luminance.

8. The method according to claim 6, wherein applying said reverse bias potential applies either the reverse bias potential or a signal potential to signal lines in a time division manner.

9. The method according to claim 6, wherein when a duty of a length of an emission time period occupied in one frame time period is switchable, generating said reverse bias potential sets a width of a change in reverse bias potential so that the width of the change in reverse bias potential is proportional to the duty of the emission time period.

10. An Electro Luminescence (EL) display panel having a pixel structure corresponding to an active matrix drive system, comprising:

reverse bias potential generating means for generating a reverse bias potential in which a corresponding one of gradation values of pixels is reflected; and voltage applying means for applying the reverse bias potential to a gate electrode of a drive transistor composing a pixel circuit adapted to operate for a non-emission time period, wherein the reverse bias potential is given by:

$$Vini=Vthel+Vcat-(\alpha Vsig+\beta)(\alpha>0 \text{ and } \beta\geqq 0)$$

where Vini is the reverse bias potential, Vthel is a threshold potential of an EL light emitting element, Vcat is a cathode potential of said EL light emitting element, α and β are coefficients, and Vsig is a signal potential.

11. The EL display panel according to claim 10, wherein said reverse bias potential generating means generates the reverse bias potential so that a reverse bias voltage corresponding to a high luminance is larger than that corresponding to a low luminance.

12. The EL display panel according to claim 10, wherein said voltage applying means applies either the reverse bias potential or a signal potential to signal lines in a time division manner.

13. The EL display panel according to claim 10, wherein when a duty of a length of an emission time period occupied in one frame time period is switchable, said reverse bias potential generating means sets a width of a change in reverse bias potential so that the width of the change in reverse bias potential is proportional to the duty of the emission time period.

* * * * *